US007240400B2

(12) United States Patent
Bonham

(10) Patent No.: US 7,240,400 B2
(45) Date of Patent: Jul. 10, 2007

(54) VERTICAL AND HORIZONTAL ADJUSTABLE HINGE ASSEMBLY

(76) Inventor: Brent Bonham, P.O. Box 625, Springville, UT (US) 84663

( * ) Notice: Subject to any disclaimer, the term of this patent is extended or adjusted under 35 U.S.C. 154(b) by 0 days.

(21) Appl. No.: 10/975,044

(22) Filed: Oct. 25, 2004

(65) Prior Publication Data

US 2005/0120517 A1 Jun. 9, 2005

Related U.S. Application Data

(60) Provisional application No. 60/513,668, filed on Oct. 23, 2003.

(51) Int. Cl.
*E05D 7/04* (2006.01)

(52) U.S. Cl. ..... 16/238; 16/252; 16/389

(58) Field of Classification Search ..... 16/238, 16/237, 236, 240, 244–246, 248, 252, 285, 16/307, 389, 86.1, 86.2; 49/397–399, 381, 49/386; D8/323

See application file for complete search history.

(56) References Cited

U.S. PATENT DOCUMENTS 1,216,169 A * 2/1917 Rochester ..... 16/238
2,050,891 A * 8/1936 Maisch ..... 16/340
D101,184 S * 9/1936 Willard ..... D8/323
2,182,548 A * 12/1939 Bash ..... 16/253
2,583,950 A 1/1952 Kirschner
2,657,421 A * 11/1953 Polson ..... 16/238
2,683,279 A * 7/1954 Okerlund et al. ..... 16/245
2,752,014 A * 6/1956 Watson ..... 49/397
2,779,966 A 2/1957 Torchia
2,794,460 A * 6/1957 Grathwol ..... 144/27
2,854,687 A * 10/1958 Baldauf ..... 16/236
D204,872 S * 5/1966 Davis ..... D8/323

(Continued)

FOREIGN PATENT DOCUMENTS

DE 3041573 A * 6/1982

(Continued)

OTHER PUBLICATIONS

Gate Hardware, Hinges Qualipac, Home Improvement Corp.

*Primary Examiner*—Chuck Y. Mah
(74) *Attorney, Agent, or Firm*—Clayton, Howarth & Cannon, P.C.

(57) ABSTRACT

A method and apparatus providing an adjustable hinge configured for a fence post and gate assembly of a fence. The adjustable hinge includes a first bracket operable to be secured to a first portion of the fence and a second bracket operable to be secured to a second portion of the fence. The adjustable hinge also includes a vertical adjustment component, a horizontal adjustment component, a hinge barrel and a collar. The vertical adjustment component is operably coupled to the first bracket and the horizontal adjustment component is operably coupled to the second bracket. The hinge barrel is operable to be rotatably coupled to the vertical adjustment component and the horizontal adjustment component. The collar is operable to be rotatably coupled to the horizontal adjustment component and is operably coupled to the second bracket. With this arrangement, the hinge barrel is operable to be moveable along the vertical adjustment component to vertically adjust the second bracket with respect to the first bracket. Furthermore, the collar is operable to be moveable along the horizontal adjustment component to horizontally adjust the second bracket with respect to the first bracket.

38 Claims, 54 Drawing Sheets

U.S. PATENT DOCUMENTS

| | | | | | |
|---|---|---|---|---|---|
| 3,251,090 | A | * | 5/1966 | Fergison | 16/238 |
| 3,268,946 | A | * | 8/1966 | Case | 16/253 |
| 3,699,615 | A | * | 10/1972 | Duncan | 16/308 |
| 4,293,976 | A | * | 10/1981 | Pittasch et al. | 16/245 |
| 4,330,901 | A | | 5/1982 | Sanders | |
| 4,381,580 | A | | 5/1983 | Hellstrom et al. | |
| 4,590,642 | A | * | 5/1986 | Hesener | 16/241 |
| 4,845,811 | A | * | 7/1989 | Fargnier | 16/308 |
| 5,029,363 | A | * | 7/1991 | Hesener | 16/241 |
| 5,167,049 | A | * | 12/1992 | Gibbs | 16/253 |
| 5,339,493 | A | | 8/1994 | MacIntyre | |
| 5,669,105 | A | * | 9/1997 | Depke | 16/245 |
| 5,694,665 | A | | 12/1997 | Strickland et al. | |
| 5,713,105 | A | * | 2/1998 | Toomey | 16/245 |
| 5,755,011 | A | | 5/1998 | Green et al. | |
| D396,626 | S | * | 8/1998 | Francom | D8/323 |
| 5,933,919 | A | | 8/1999 | Miller et al. | |
| 6,212,734 | B1 | | 4/2001 | Commons | |
| D443,196 | S | * | 6/2001 | Sosa | D8/323 |
| 6,275,504 | B1 | * | 8/2001 | Kim et al. | 370/471 |
| D500,660 | S | * | 1/2005 | Larner et al. | D8/323 |
| 2004/0093689 | A1 | * | 5/2004 | Sosa et al. | 16/301 |
| 2005/0183238 | A1 | * | 8/2005 | McCue et al. | 16/236 |

FOREIGN PATENT DOCUMENTS

| | | | | |
|---|---|---|---|---|
| DE | 29608273 | U1 | * | 9/1996 |
| DE | 19953927 | A1 | * | 5/2001 |
| DE | 2005002661 | U1 | * | 5/2005 |
| EP | 940539 | A2 | * | 9/1999 |
| FR | 2533615 | A | * | 3/1984 |
| FR | 2538839 | A | * | 7/1984 |
| FR | 2665214 | A1 | * | 1/1992 |
| FR | 2679590 | A1 | * | 1/1993 |
| JP | 11050724 | A | * | 2/1999 |

* cited by examiner

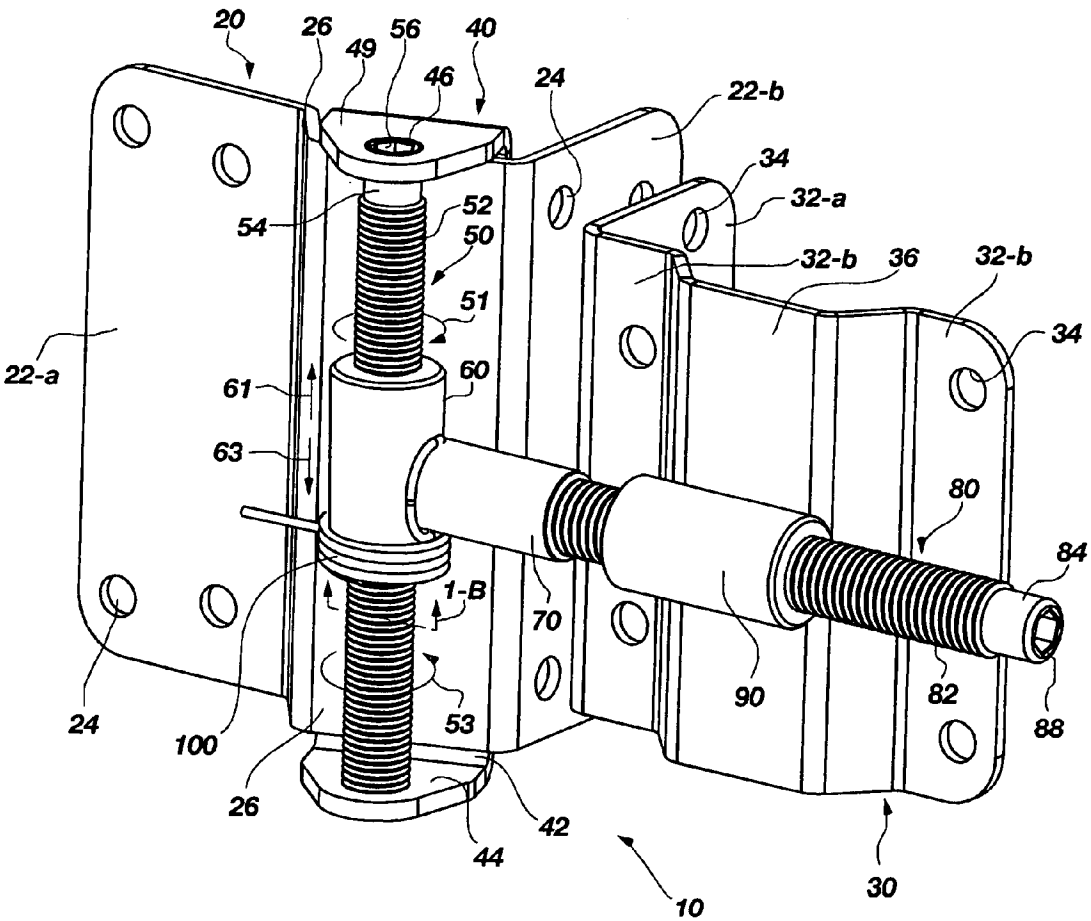
FIG. 1-A
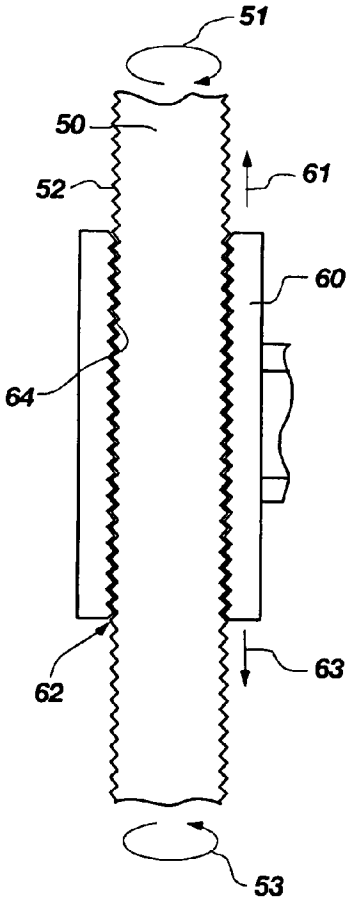
FIG. 1-B

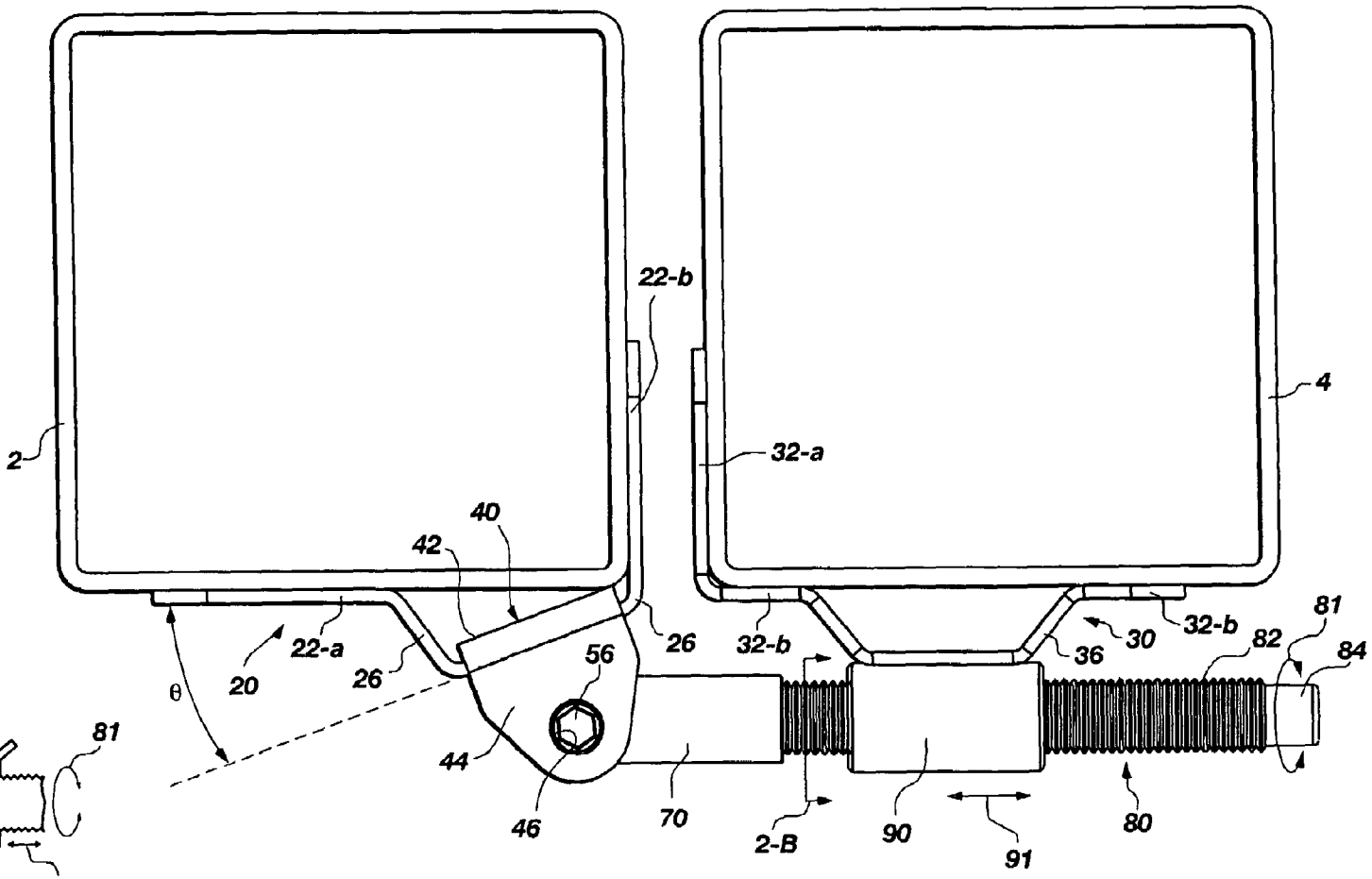
FIG. 2-A
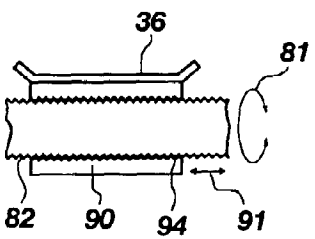
FIG. 2-B

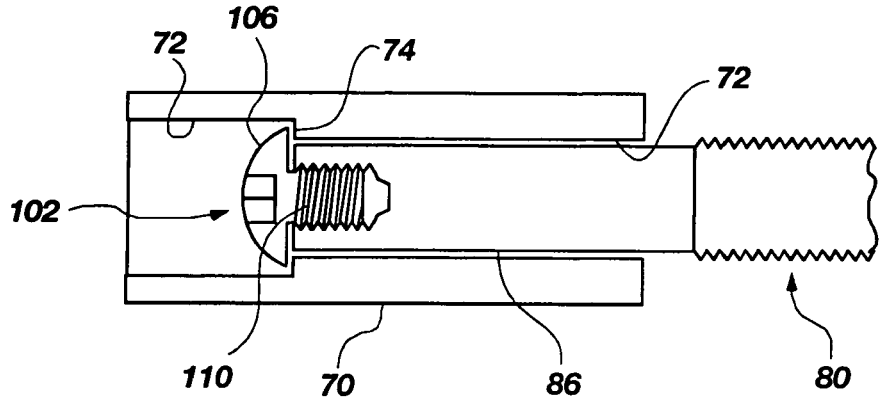
FIG. 3-A
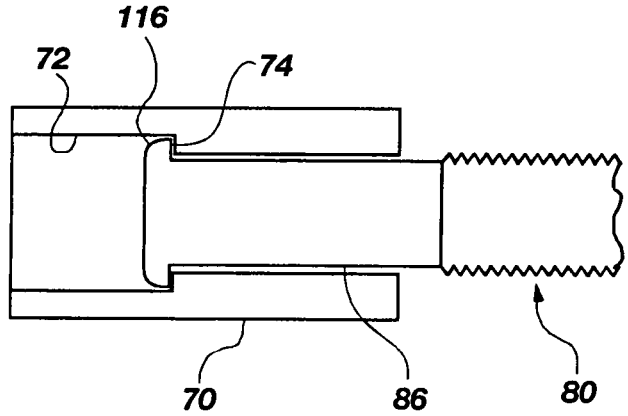
FIG. 3-B
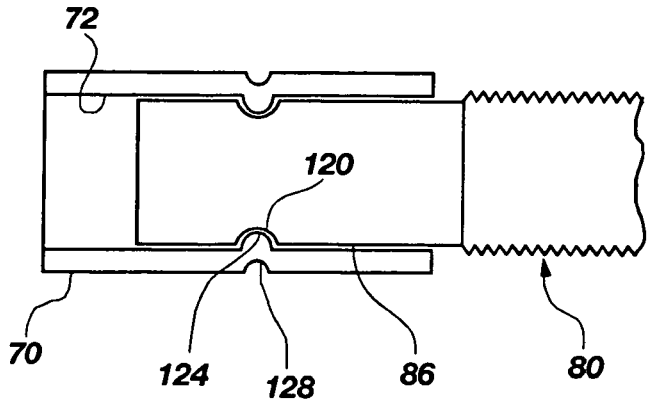
FIG. 3-C

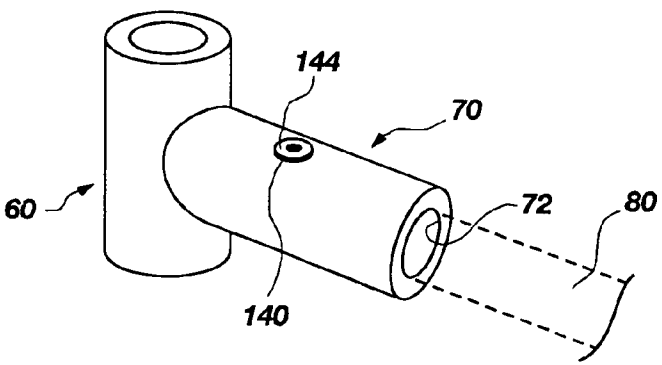
FIG. 3-F
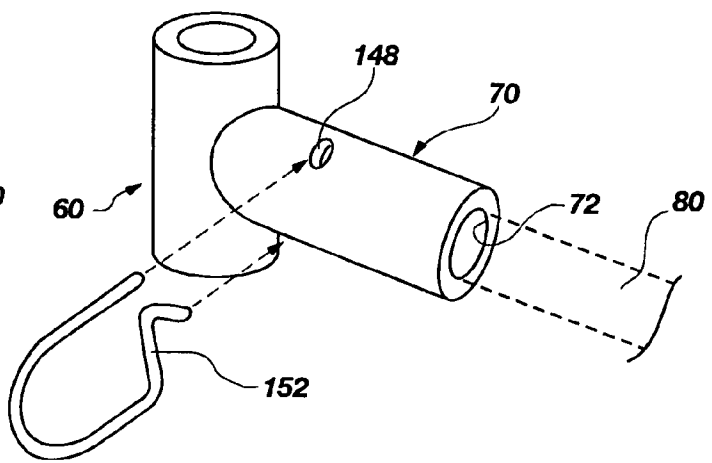
FIG. 3-G
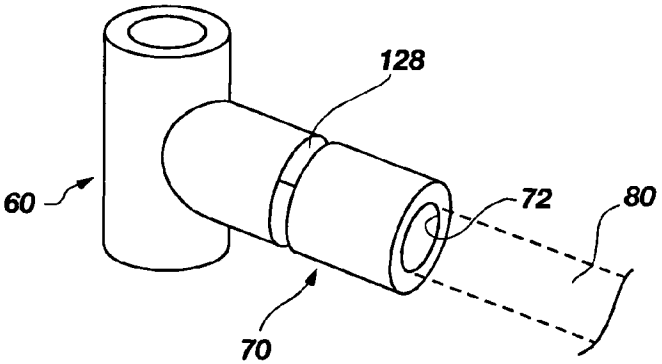
FIG. 3-D
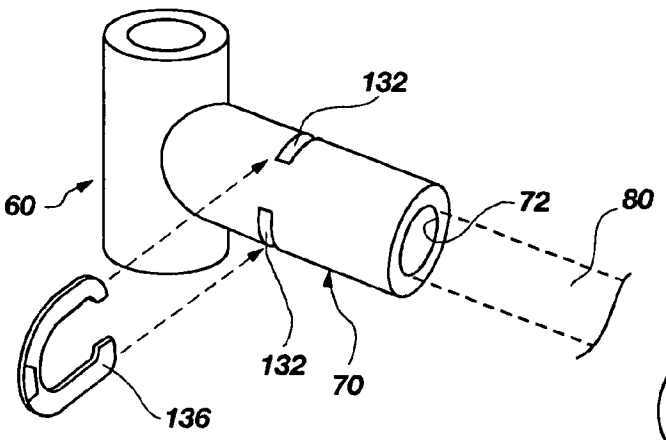
FIG. 3-E

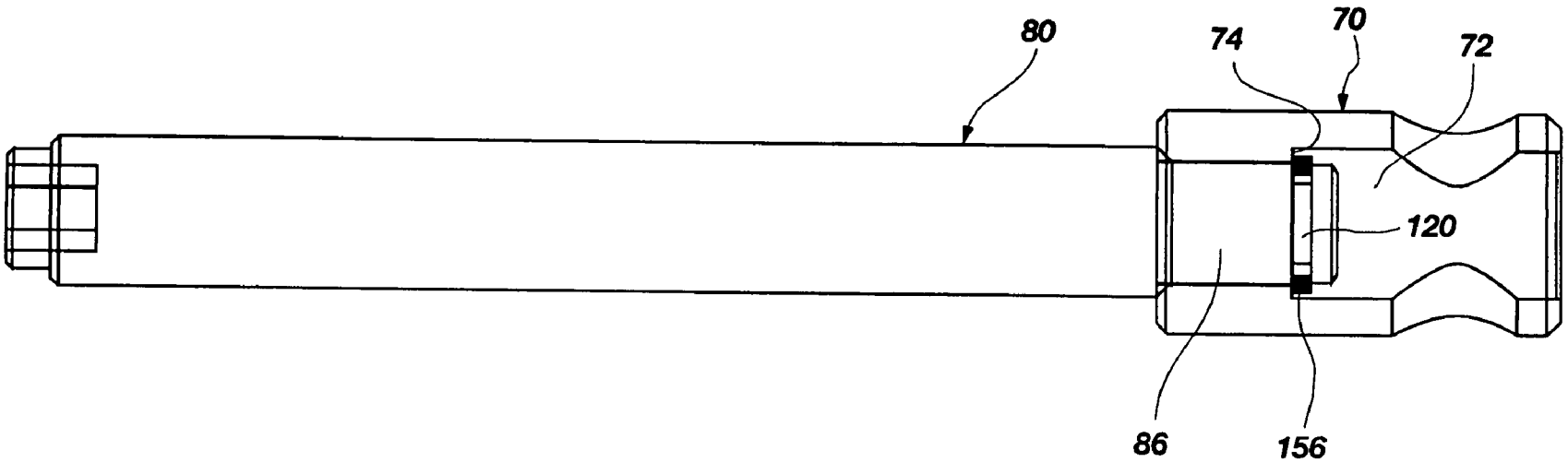
FIG. 3-H

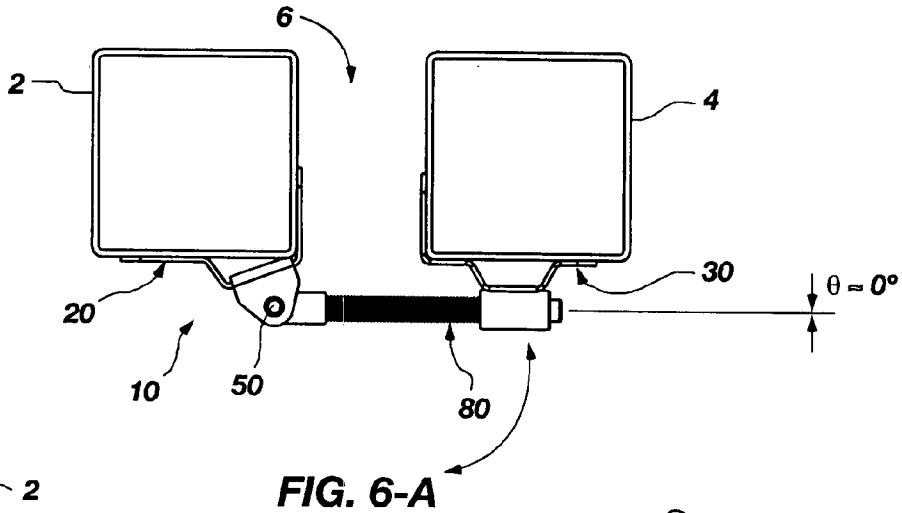
FIG. 6-A
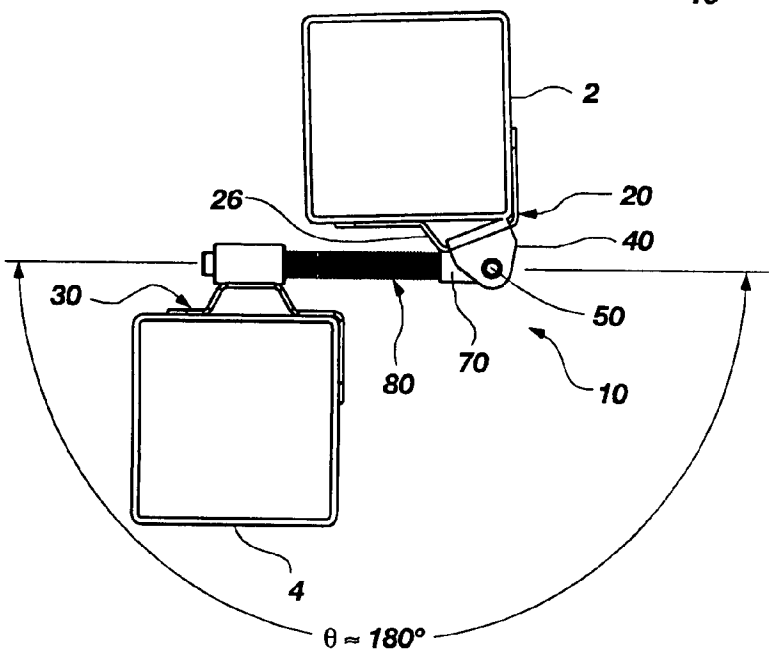
FIG. 6-B
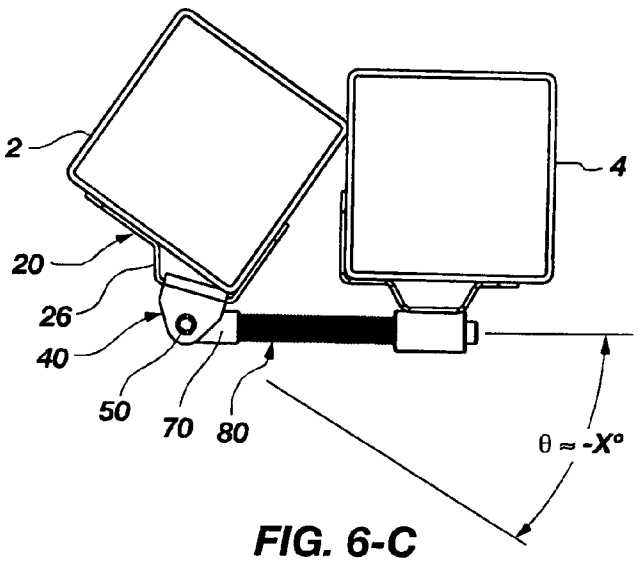
FIG. 6-C

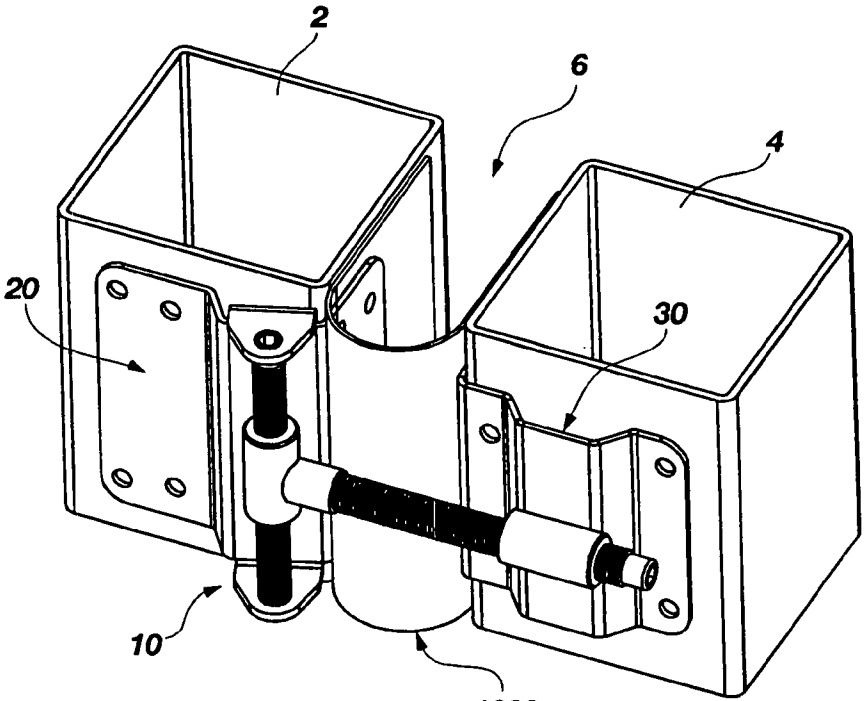
FIG. 33-B
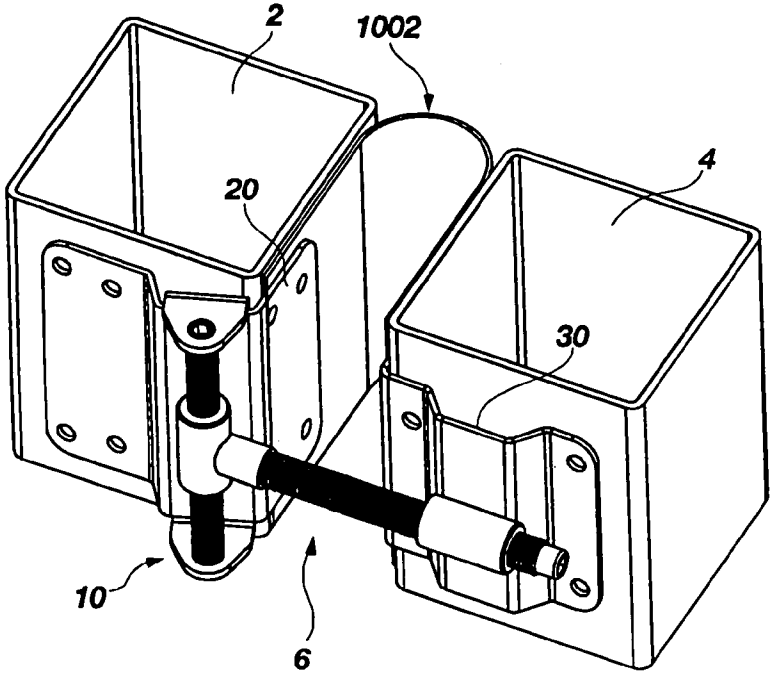
FIG. 33-A

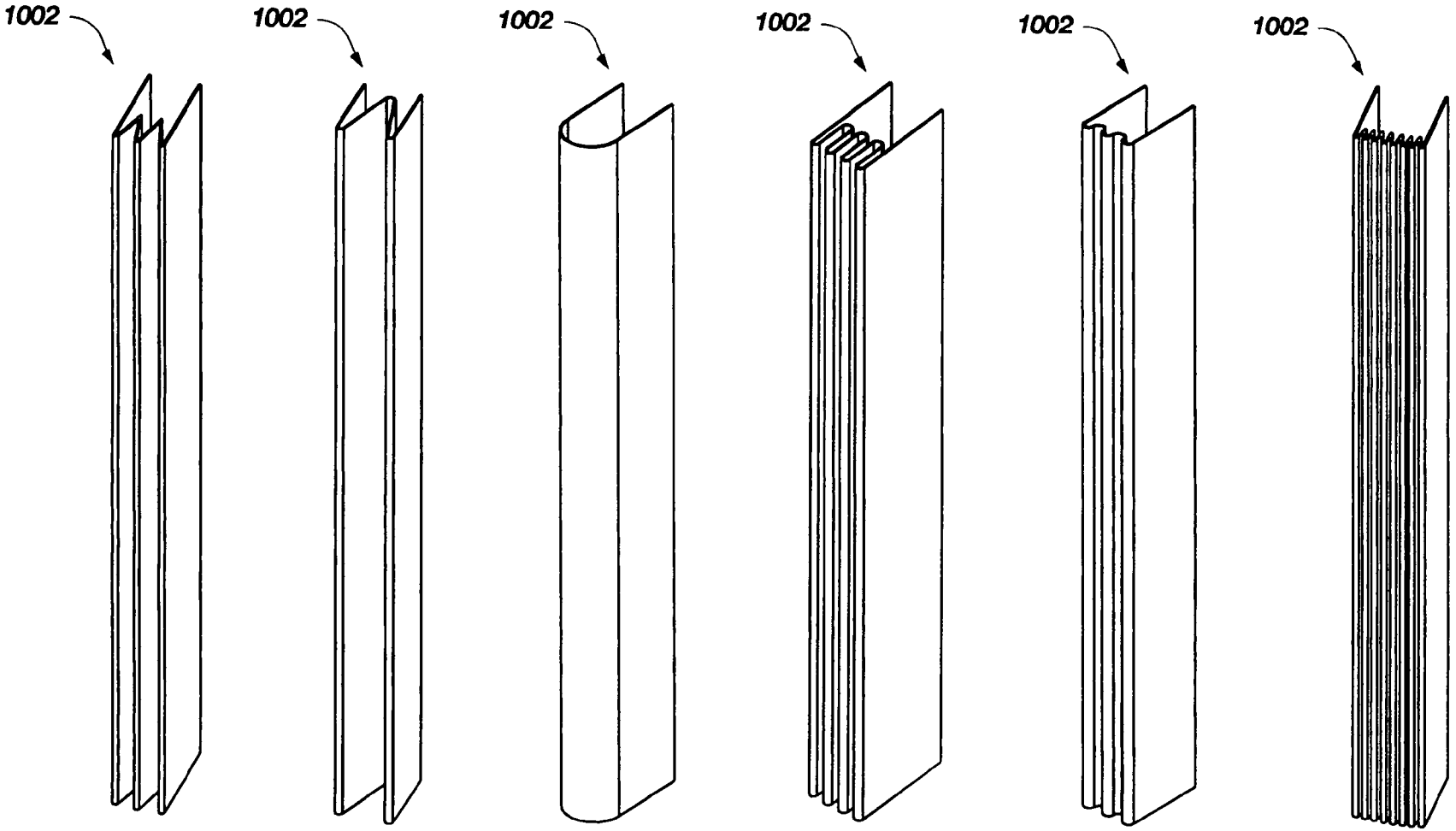
FIG. 34-A FIG. 34-B FIG. 34-C FIG. 34-D FIG. 34-E FIG. 34-F

VERTICAL AND HORIZONTAL ADJUSTABLE HINGE ASSEMBLY

RELATED APPLICATIONS

This application claims priority to U.S. Provisional Application Ser. No. 60/513,668, filed Oct. 23, 2003, and entitled, "Vertical/Horizontal Adjustable Hinge," which is incorporated by reference herein in its entirety.

FIELD OF THE INVENTION

The present invention relates generally to hinge technology. More particularly, the present invention relates to a vertically and horizontally adjustable hinge and various means for carrying out vertical and horizontal adjustment of the hinge for proper and accurate alignment of the hinged components.

BACKGROUND OF THE INVENTION AND RELATED ART

Successfully aligning two hinged components or hinged component assemblies together, such as a hinged gate and fence post assembly, in both the horizontal and vertical directions, can be very difficult. The task of aligning is made all the more difficult in the case of assembling hinged components together that are both large and with heavy. For example, aligning double gates to their fence post counterparts often requires multiple installers, including several to position and hold the gates while others fasten and mount the hinges to the fence posts and the gates. This invariably leads to misalignment of the gates with the fence posts once both sides of the gates are mounted. Misalignment may be the result of improper initial alignment due to misjudgment in the position of the hinges on the respective counterparts. Or, misalignment may occur once the gates are allowed to hang under their own weight. Although the gates and the posts may have been aligned initially, the gates, under their own weight, may cause the hinges to sag. This is especially true over time. For instance, significant settling of the fence and/or gate posts may occur, thus contributing to the misalignment. Or, extended use and environmental conditions may contribute to the misalignment. Another contributing factor to misalignment is the change in ground conditions, such as a rise or fall in grass thatch, shifting or elevational changes in sidewalks, driveways, etc.

In any event, the difficulty in properly aligning the gates to the fence posts using prior known hinges and methods can lead to poor work quality and improper operating relationship between the hinged components. This is particularly true if initial alignment is off, which can occur as installers are often under significant time constraints. If the hinged components are not properly aligned, but the components still function, installers will typically consider the job finished. In those circumstances where the hinged components do not function properly, installers must dismount the hinges and then remount such hinges until proper alignment is obtained. This often leaves unsightly marks and/or holes in the hinged components that must be masked if possible. Proper alignment of hinged components is made even more difficult when the hinged components are supported on a sloped elevation.

Recent hinge technology has addressed some of these alignment problems by providing various embodiments of a hinge assembly capable of adjusting one hinged component relative to the other in the horizontal direction. One such exemplary hinge assembly includes a post bracket and a gate bracket, separable from one another, with a horizontal screw fixed to a vertical pin mounted to the post bracket. The gate bracket is slidably mounted to the horizontal screw with a collar. The gate bracket maintains a position with respect to the horizontal screw with two nuts rotatably mounted to the horizontal screw on both sides of the collar. Horizontal movement of the gate bracket is carried out by rotating one nut about the horizontal screw to another position, sliding the collar to abut the one nut and then rotating the other nut against the collar to place the collar in a fixed position. However, this arrangement for horizontal adjustment is difficult due to the tedious nature of rotating each nut to a new position on the horizontal screw. Moreover, due to the design configuration of the gate and post brackets, little room is available for turning and tightening the nuts. Such horizontal adjustment is even more problematic when it is required on multiple hinge assemblies, such as for an upper and lower hinge on each side of a two-panel gate, as is often the case.

Other types of hinges for mounting doors to a doorjamb of a home have also addressed vertical alignment issues. For example, U.S. Pat. No. 6,212,734 to Commons, U.S. Pat. No. 5,933,919 to Miller et al., and U.S. Pat. No. 4,381,580 to Hellstrom et al. each disclose a hinge assembly having a first hinge and a second hinge for mounting to a respective door frame and door. However, the vertical adjustment for each hinge assembly disclosed in these references is limited to under half the effective length of the vertical pin coupling the first and second hinges together. Such limited vertical adjustment does not solve the large vertical adjustments needed for a large and heavy fence and gate assembly and, further, does not solve several inherent operating or functioning issues, such as that of binding the mounting portions of the hinge assembly during operation or actuation of the gate. Binding may occur when one hinge is adjusted more than its complementary hinge. Furthermore, these prior related hinge assemblies are primarily configured for use with lightweight doors in interior settings, rather than for large and heavy hinged components, such as the fence and gate assembly discussed above.

SUMMARY OF THE INVENTION

It has been recognized that it would be advantageous to provide an improved hinge or hinge assembly well suited for any sized and configured hinged component assembly, but that is primarily suited for larger, heavier, and more bulky hinged component assemblies, such as a fence post and gate assembly, wherein the hinged assembly facilitates the selective and ready adjustment of the hinge assembly, and therefore the hinged component assembly, in both the vertical and horizontal directions, thus achieving more efficient, accurate, and proper alignment of the hinged component assembly without requiring the removal or dismounting of the hinge assembly. Further, it would be advantageous to provide a hinge assembly that addresses and accomplishes vertical and horizontal adjustment without binding the joints between the hinge assembly and the hinged component assembly. Still further, it would be advantageous to provide a hinge assembly configured for easy installation and adjustment without the need for multiple installers.

In light of the foregoing, and in accordance with the invention as embodied and broadly described herein, the present invention features an adjustable hinge assembly configured for use with various hinged components or hinged component assemblies. The adjustable hinge assembly comprises: (a) a post bracket operable to be secured to the post of a fence; (b) a gate bracket operable to be secured to a portion of the gate; (c) a vertical adjustment component operably coupled to the post bracket; (d) a horizontal adjustment component operably coupled to the gate bracket; (e) a hinge barrel operable to be rotatably coupled to the vertical adjustment component and the horizontal adjustment component, the hinge barrel operable to be moveable along the vertical adjustment component to vertically adjust the gate bracket with respect to the post bracket; and (f) a collar operable to be rotatably coupled to the horizontal adjustment component and operably coupled to the gate bracket, the collar operable to be moveable along the horizontal adjustment component to horizontally adjust the gate bracket with respect to the post bracket.

The present invention further features an adjustable hinge configured for a post and gate assembly of a fence, the hinge comprising: (a) a first bracket operable to be secured to a first portion of the fence; (b) a second bracket operable to be secured to a second portion of the fence; (c) a vertical adjustment component operably coupled to the first bracket; (d) a horizontal adjustment component operably coupled to the second bracket; (e) a hinge barrel operable to be rotatably coupled to the vertical adjustment component and the horizontal adjustment component, the hinge barrel operable to be moveable along the vertical adjustment component to vertically adjust the second bracket with respect to the first bracket; and (f) a collar operable to be rotatably coupled to the horizontal adjustment component and operably coupled to the second bracket, the collar operable to be moveable along the horizontal adjustment component to horizontally adjust the second bracket with respect to the first bracket.

The present invention further features a vertically adjusting hinge system configured for a post and gate assembly of a fence, the hinge system comprising: (a) a first adjustable hinge operable to be positioned on the fence, the first adjustable hinge including: a first bracket and a second bracket respectively operable to be secured to a first portion and a second portion of the fence; a first vertical adjustment component operably coupled to the first bracket; a first hinge barrel operable to be rotatably coupled to the first vertical adjustment component and operably coupled to the second bracket, the first hinge barrel operable to be moveable along the first vertical adjustment component to vertically adjust the second bracket with respect to the first bracket; a second adjustable hinge operable to be positioned on the fence and spaced vertically from the first adjustable hinge, the second adjustable hinge including: a third bracket and a fourth bracket respectively operable to be secured to a third portion and a fourth portion of the fence; a second vertical adjustment component operably coupled to the third bracket and operable to be substantially vertically aligned with the first vertical adjustment component with a space therebetween; a second hinge barrel operable to be rotatably coupled to the second vertical adjustment component and operably coupled to the fourth bracket, the second hinge barrel operable to be moveable along the second vertical adjustment component to vertically adjust the fourth bracket with respect to the third bracket; a vertical-adjustment tool operable to be removably coupled between the first vertical adjustment component and the second vertical adjustment component, the vertical-adjustment tool operable to facilitate simultaneous rotation of the first vertical adjustment component and the second vertical adjustment component upon rotation of at least one of the first vertical adjustment component and the second vertical adjustment component, the vertical-adjustment tool operable to facilitate simultaneous movement with common linear displacement of the second bracket and the fourth bracket with respect to the first bracket and the third bracket, respectively, through movement of the first hinge barrel and the second hinge barrel along the first vertical adjustment component and the second vertical adjustment component, respectively.

The present invention further features a vertically adjusting hinge system configured for assembling a gate to a fence, the hinge system comprising: (a) a first adjustable hinge having a first portion and a second portion and configured to be operably coupled to the fence; (b) a first vertical adjustment component operably coupled to the first adjustable hinge; (c) a second adjustable hinge having a third portion and a fourth portion and configured to be operably coupled to the fence and spaced vertically from the first adjustable hinge; (d) a second vertical adjustment component operably coupled to the second adjustable hinge; (e) a vertical-adjustment tool operable to be removably coupled between the first vertical adjustment component and the second vertical adjustment component, the vertical-adjustment tool operable to facilitate simultaneous rotation of the first vertical adjustment component and the second vertical adjustment component upon rotation of at least one of the first vertical adjustment component and the second vertical adjustment component to facilitate simultaneous movement with common linear displacement of the second portion and the fourth portion with respect to the first portion and the third portion, respectively.

The present invention further features a vertical-adjustment tool configured to simultaneously vertically adjust an upper hinge and a lower hinge, the upper hinge having a first portion and a second portion with a first vertical adjustment component operably coupled thereto and the lower hinge having a third portion and a fourth portion with a second vertical adjustment component operably coupled thereto, the vertical-adjustment tool comprising: (a) a shaft having a first end and a second end; and (b) at least one extension member operable to be coupled and spring-loaded at the first end of the shaft; wherein the at least one extension member of the shaft is operable to be removably coupled respectively between the first vertical adjustment component and the second vertical adjustment component, the shaft operable to facilitate simultaneous rotation of the first vertical adjustment component and the second vertical adjustment component upon rotation of at least one of the first vertical adjustment component and the second vertical adjustment component to facilitate simultaneous movement with common linear displacement of the second portion and the fourth portion with respect to the first portion and the third portion, respectively.

The present invention further features an adjustable hinge configured for a post and gate assembly of a fence, the hinge comprising: (a) a first bracket operable to be secured to a first portion of the fence; (b) a second bracket operable to be secured to a second portion of the fence; (c) a vertical adjustment component having a longitudinal length, the vertical adjustment component operably coupled to the first bracket so that the vertical adjustment component is vertically positioned and suspended laterally from the first bracket, the vertical adjustment component including a threaded outer surface along at least half the longitudinal length of the vertical adjustment component; and (d) a hinge barrel operable to be rotatably coupled to the vertical adjustment component and operably coupled to the second bracket, the hinge barrel including a threaded inner surface having a thread configuration corresponding to a thread configuration of the threaded outer surface of the vertical adjustment component, the hinge barrel operable to movably traverse along at least half the longitudinal length of the vertical adjustment component upon rotation of the vertical adjustment component to vertically adjust the second bracket with respect to the first bracket.

The present invention further features an adjustable hinge configured for a post and gate assembly of a fence, the hinge comprising: (a) a fixed bracket operable to be secured to a fence post; (b) a movable bracket operable to be secured to a movable portion of the fence; and (c) a vertical adjustment component having a longitudinal length with un upper coupling portion and a lower coupling portion, the vertical adjustment component operably coupled to the fixed bracket at the upper coupling portion and the lower coupling portion so that the vertical adjustment component is vertically positioned and suspended laterally from the fixed bracket; (d) wherein the movable bracket is operably coupled to the vertical adjustment component and operable to movably traverse substantially an entire distance defined between the upper coupling portion and the lower coupling portion along the longitudinal length of the vertical adjustment component so that the movable bracket is vertically movable with respect to the fixed bracket.

The present invention further features an adjustable hinge configured for a post and gate assembly of a fence, the hinge system comprising: (a) a first bracket operable to be secured to a first portion of the fence; (b) a second bracket operable to be secured to a second portion of the fence; (c) a horizontal adjustment component operably coupled to the second bracket and the first bracket, the horizontal adjustment component including a threaded outer surface; and (d) a collar operable to be rotatably coupled to the horizontal adjustment component and operably coupled to the second bracket, the collar including a threaded inner surface operable to substantially match the threaded outer surface of the horizontal adjustment component, the collar operable to be moveable along the horizontal adjustment component upon rotation of the horizontal adjustment component to horizontally adjust the second bracket with respect to the first bracket.

The present invention further features a horizontally adjusting hinge system configured for assembling a gate to a fence, the hinge system comprising: (a) a first adjustable hinge having a first portion and a second portion and configured to be operably coupled to the fence; (b) a first horizontal adjustment component operably coupled to the first adjustable hinge; (c) a second adjustable hinge having a third portion and a fourth and configured to be operably coupled to the fence and spaced vertically from the first adjustable hinge; (d) a second horizontal adjustment component operably coupled to the second adjustable hinge; (e) a horizontal-adjustment tool operable to be removably coupled between the first horizontal adjustment component and the second horizontal adjustment component, the horizontal-adjustment tool operable to facilitate simultaneous rotation of the first horizontal adjustment component and the second horizontal adjustment component upon rotation of at least one of the first horizontal adjustment component and the second horizontal adjustment component to facilitate simultaneous horizontal movement with common linear displacement of the second portion and the fourth portion with respect to the first portion and the third portion, respectively.

The present invention further features a horizontal-adjustment tool configured to simultaneously horizontally adjust an upper hinge and a lower hinge, the upper hinge having a first portion and a second portion with a first horizontal adjustment component operably coupled thereto and the lower hinge having a third portion and a fourth portion with a second horizontal adjustment component operably coupled thereto, the horizontal-adjustment tool comprising: (a) a vertical shaft having a first end and a second end with an extendable portion therebetween; (b) a first gear member coupled to the first end of the vertical shaft and operable to translate rotation between the first horizontal adjustment component and the vertical shaft; and (c) a second gear member coupled to the second end of the vertical shaft and operable to translate rotation between the second horizontal adjustment component and the vertical shaft, wherein the first gear member and the second gear member are operable to be operably coupled respectively to the first horizontal adjustment component and the second horizontal adjustment component, the vertical shaft coupled to the first gear member and the second gear member each operable to act in conjunction to facilitate simultaneous rotation of the first horizontal adjustment component and the second horizontal adjustment component upon rotation of at least one of the first horizontal adjustment component and the second horizontal adjustment component to facilitate simultaneous horizontal movement with common linear displacement of the second portion and the fourth portion with respect to the first portion and the third portion, respectively.

The present invention further features an adjustable hinge system for a post and gate assembly, comprising: (a) a post bracket operable to be secured to the post of a fence; (b) a gate bracket operable to be secured to a portion of the gate; (c) a vertical hinge barrel coupled to the post bracket; (d) a horizontal adjustment component operably coupled to the gate bracket and the vertical hinge barrel; and (e) a horizontal collar movably coupled to the horizontal adjustment component and operably coupled to the gate bracket, the horizontal collar operable to be moveable along the horizontal adjustment component to horizontally adjust the gate bracket with respect to the post bracket.

The present invention further features various embodiments of a gap filler configured to cover the gap between the hinged components, and to improve the visual look of the hinged component assembly. The gap filler typically extends the entire length or height of the gap.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 1-A illustrates a perspective front view of an adjustable hinge, according to an embodiment of the present invention;

FIG. 1-B illustrates a cross-sectional view taken along line 1A in FIG. 1, depicting a rotatable coupling between a hinge barrel and vertical adjustment component of the adjustable hinge;

FIG. 2-A illustrates a top view of the adjustable hinge, depicting the configuration of the adjustable hinge for mounting to a post and gate assembly;

FIG. 2-B illustrates a cross-sectional view taken along line 2A in FIG. 2, depicting a rotatable coupling between a collar and horizontal adjustment component of the adjustable hinge;

FIG. 3-A illustrates a cross-sectional view of a swivel joint and horizontal adjustment component portions of the adjustable hinge taken along line 3 in FIG. 2, depicting a rotatable coupling between the swivel joint and horizontal adjustment component with a fastener, according to an embodiment of the present invention;

FIG. 3-B illustrates a cross-sectional view of the swivel joint and horizontal adjustment component portions, depicting the rotatable coupling between the swivel joint and horizontal adjustment component with a flange portion, according to another embodiment of the present invention;

FIG. 3-C illustrates a cross-sectional view of the swivel joint and horizontal adjustment component portions, depicting the rotatable coupling between the swivel joint and horizontal adjustment component with a respective crimp and groove assembly, according to another embodiment of the present invention;

FIG. 3-D illustrates a perspective view of the swivel joint coupled with a hinge barrel, depicting the crimp, shown in FIG. 3-C, formed in an outer surface of the swivel joint;

FIG. 3-E illustrates a perspective view of the swivel joint coupled with the hinge barrel, depicting a channel formed in the outer surface of the swivel joint configured to receive a clip member to provide the rotatable coupling between the swivel joint and horizontal adjustment component, according to an embodiment of the present invention;

FIG. 3-F illustrates a perspective view of the swivel joint coupled with the hinge barrel, depicting a post operable to be positioned in a hole formed in the swivel joint to provide the rotatable coupling between the swivel joint and horizontal adjustment component, according to another embodiment of the present invention;

FIG. 3-G illustrates a perspective view of the swivel joint coupled with the hinge barrel, depicting a hole defined in the swivel joint and operable to receive a pin to provide the rotatable coupling between the swivel joint and horizontal adjustment component, according to another embodiment of the present invention;

FIG. 3-H illustrates a cut-away side view of still another embodiment of means for coupling the horizontal adjustment component to the swivel joint;

FIGS. 6-A–6-C illustrate several top views of one exemplary adjustable hinge as coupling together two hinged components in the form of a post and a pivoting gate, and the relationship between the various components of the adjustable hinge, as well as the relationship between the post, a fence (not shown), and the gate, at different operating positions;

FIG. 11-B illustrates an annular groove formed in the longitudinal bore of the swivel joint to receive and support, from opposing sides, a snap ring as contained within the annular groove of the horizontal adjustment component;

FIG. 33-A is a perspective view of a gap filler according to one exemplary embodiment of the present invention;

FIG. 33-B illustrates the same gap filler embodiment of FIG. 33-A, only the gap filler is positioned in a reverse configuration to be proximate the adjustable hinge;

FIG. 34-A illustrates a gap filler embodiment as comprising a standard depth triple corrugated configuration;

FIG. 34-B illustrates a gap filler embodiment as comprising an extended depth double corrugated configuration; FIG. 34-C illustrates a gap filler embodiment as comprising a u-shaped configuration similar to the u-shaped configuration described above;

FIG. 34-D illustrates a gap filler embodiment as comprising a standard depth quadruple corrugated configuration;

FIG. 34-E illustrates a gap filler embodiment as comprising a shallow depth and triple corrugated configuration;

FIG. 34-D illustrates a gap filler embodiment as comprising a shallow depth corrugated configuration having several tight segments;

DETAILED DESCRIPTION OF EXEMPLARY EMBODIMENTS

Figure 54:
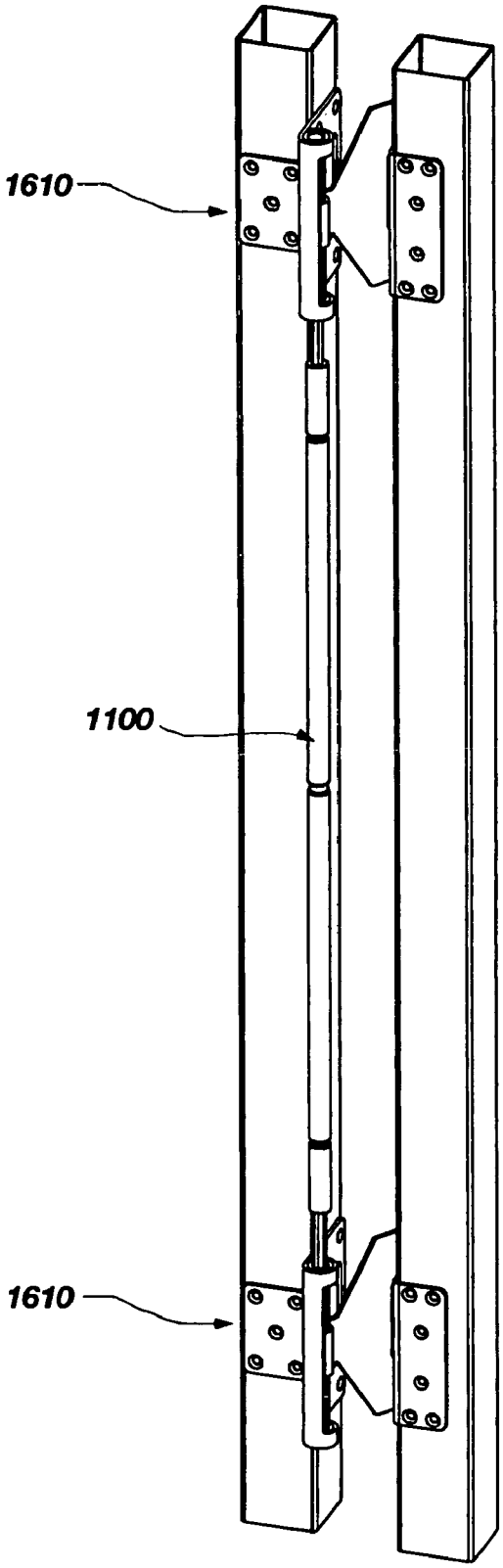
FIG. 54 illustrates a perspective view of two complementary concealed hinge assemblies as used to hinge together a fence post and a gate.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 54, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

In general, the present invention describes an adjustable hinge or adjustable hinge assembly for pivotally coupling together various types of hinged components, such as a gate to a fence, a door to a doorjamb, and others. The present invention adjustable hinge provides both horizontal and vertical adjustment of the hinged components with respect to one another through the manipulation of vertical and horizontal adjustment components operable as part of the adjustable hinge assembly. Several different embodiments of the hinge assembly are described and set forth herein, as well as various accessory components and tools operable with the hinge assembly.

As such, the following more detailed description is divided into sections for convenience to the reader.

Vertically and Horizontally Adjusting Hinge Assembly

With reference to FIGS. 1, 1-A, and 2, illustrated is an adjustable hinge assembly 10 (hereinafter adjustable hinge 10) according to one exemplary embodiment, wherein the adjustable hinge 10 is configured to be mountable to a hinged component assembly for the purpose of pivotally supporting the separate hinged components making up the hinged component assembly, and for facilitating both the horizontal and vertical alignment of the hinged components with respect to one another. One type of exemplary hinged component assembly comprises a post and gate assembly, such as the one shown and illustrated in FIGS. 1–2, wherein one hinged component is comprised of a post 2 and the other is comprised of a gate 4. The post and gate-type hinged assembly, although exemplary, will be used herein in describing the configurations and functions of the present invention adjustable hinge. Of course, other types, designs, styles, and configurations of hinged component assemblies are contemplated. As such, the post-type and gate-type hinged component assembly should not be construed as limiting in any way.

In effect, the adjustable hinge 10 is configured to secure in place and align the hinged components relative to one another, as well as to facilitate the pivoting or rotation of at least one hinged component about the other. An advantage of the present invention adjustable hinge 10 over prior related hinges is that it is also configured to selectively facilitate both vertical and horizontal adjustment of the hinge, and therefore the hinged components, relative to one another by way of the vertical adjustment component 50 and the horizontal adjustment component 80. Vertical and/or horizontal adjustment of the hinge assembly 10 may be effectuated at any time, such as during installation or after installation at periodic times as needed, by rotating or driving one or both of the vertical and horizontal adjustment components 50 and 80. Moreover, the adjustable hinge 10 is configured to provide the ability to achieve both considerable or fine adjustments in both the horizontal and vertical directions, depending upon the degree of misalignment of the hinged components. It should be recognized herein that adjustment of the adjustable hinge 10, and therefore the hinged components attached or coupled to the adjustable hinge 10 is achieved by rotating or turning the vertical and horizontal adjustment components 50 and 80. Unlike many prior related hinges or hinge assemblies where the hinge components are stationary, or that require manipulation of the bracket, the spinning nature of the vertical and horizontal adjustment components 50 and 80 and their interaction with the fixed structural components on each of the respective post and gate brackets 20 and 30 allows these components to be individually and selectively turned to effect adjustment within the adjustable hinge 10.

As shown, the adjustable hinge 10 comprises a post bracket 20 configured to engage with and be mounted to a post 2, and a gate bracket 30 configured to engage with and be mounted to a gate 4. The post bracket 20 comprises at least one post mounting portion 22 sized and configured to interface with at least a portion of a surface of the post 2. In a more preferred embodiment, such as the one shown, the post bracket 20 comprises first and second post mounting portions 22-*a* and 22-*b* in the form of flanges that are offset from one another in a substantially perpendicular orientation, wherein each of the post mounting portions 22-*a* and 22-*b* comprise one or more mounting holes 24 formed and extending therethrough. The post mounting portions 22-*a* and 22-*b* are sized and configured to engage and abut complementary sides of the post 2. The post mounting portions 22 can be mounted and secured to the post 2 with any suitable fastener, such as bolts, screws, rivets, etc., through the mounting holes 24. The post bracket 20 also comprises an extension portion 26 formed between the post mounting portions 22-*a* and 22-*b*. The extension portion 26 of the post bracket 20 functions to offset a pivot bracket 40 coupled thereto, and therefore the vertical adjustment component 50, from the post mounting portions 22. The pivot bracket 40 includes a back portion 42 with arm members 44 extending orthogonally, in a common direction, from longitudinal ends of the back portion 42. The back portion 42 can be secured to an inside surface of the extension portion 26 so that the arm members 44 extend outward from the extension portion 26 and post 2. Each of the arm members 44 includes an arm opening 46 defined therethrough so that each arm opening 46 is aligned with the other. Such arm openings 46 are sized and configured to receive the vertical adjustment component 50 so that the vertical adjustment component 50 is rotatably coupled, end-to-end, within the arm openings 46. In this manner, the vertical adjustment component 50 is positioned vertically between the arm members 44 and supported laterally away or offset from the post mounting portion 22 of the post bracket 20.

Moreover, the pivot bracket 40 may be situated on an angle. As shown, the extension portion 26 supporting the pivot bracket 40 comprises extension sides of two different lengths, thus allowing the extension portion 26 to be racked out at an angle. Supporting the pivot bracket 40 on the extension portion 26 allows the pivot bracket 40 to be racked out and oriented on an angle as well. In the exemplary embodiment of FIG. 2-A, the pivot bracket 40 is shown oriented on an angle θ with respect to the post mounting portion 22-*a*. As so oriented, the back portion 42 of the pivot bracket 40 comprises one edge in contact with the corner of the post 2, with the opposing edge offset from the post 2.

Having the extension portion 26 and the pivot bracket 40, and therefore the hinge barrel 60, racked out at an angle and having an edge of the back portion 42 in contact with the corner of the post 2 has several advantages. First, it provides a purchase or register for locating the post bracket 20 on the post 2 while mounting adjustable hinge 10 to the post 2. One edge of the back portion 42 of the pivot bracket 40 contacts the post 2 at its corner to set the proper depth for the post mounting portion 22-*b*. Once set, the post mounting bracket 20 may be properly secured in place. As such, installation accuracy is greatly improved. Second, the geometries and configuration of the adjustable hinge 10 are improved. Third, greater access is provided for power tools to engage both driving components 56 and 88 of the vertical and horizontal adjustment components 50 and 80, thus allowing both vertical and horizontal adjustments to be made with ease. Fourth, the extended geometry reduces the likelihood that the horizontal adjustment component 80 will bind with the post bracket 20 before the gate 4 hits the fence during an overswing situation (such as in the case of a double gate). Fifth, the moment of torque that the adjustable hinge must withstand in the event the gate 4 does hit the fence is reduced. Other advantages will be apparent to those skilled in the art.

As indicated, the adjustable hinge 10 comprises a vertical adjustment component 50 operably coupled to the extension portion 26 of the post bracket 20 to facilitate vertical adjustment of the gate 4 with respect to the post 2 by rotation of the vertical adjustment component 50. As depicted, the extension portion 26 can extend outward from the post mounting portions 22-*a* and 22-*b* in a racked-out manner so as to off-set the vertical adjustment component 50 from the surface of the post 2 at a pre-determined distance. In operation, the vertical adjustment component 50 is configured to selectively facilitate the vertical adjustment and alignment of the post bracket 20 with respect to the gate bracket 30, and therefore the post 2 with respect to the gate 4 as attached thereto, respectively, by rotating or being rotated. Indeed, actuating the vertical adjustment component 50 effectively functions to raise or lower the gate bracket 30, and therefore the gate 4, as the post bracket 20 is typically secured to the post 2, which is anchored to the ground. As will be recognized by one skilled in the art however, as configured, actuation of the vertical adjustment component 50 may function to raise or lower either the post bracket 20 or the gate bracket 30, such as during installation.

The vertical adjustment component 50 can include a threaded outer surface 52. Such threaded outer surface 52 can extend continuously along at least a portion of the longitudinal length of the vertical adjustment component 50 and/or extend continuously along substantially an entire distance of the longitudinal length between portions of the vertical adjustment component 50 coupled to the arm members 44 of the pivot bracket 40. The vertical adjustment component 50 also includes a driving component 56 located at each end of the vertical adjustment component 50. Such a driving component 56 can be a recessed portion formed within the ends of the vertical adjustment component 50 or the driving component 56 can be an independent structure coupled to the ends of the vertical adjustment component 50. In either case, the driving component 56 is configured to receive with a tool, such as a hex drive bit, capable of rotatably driving the vertical adjustment component 50 to effectuate vertical adjustment within the adjustable hinge 10. The driving component 56, or at least the portion thereof receiving the tool, can be configured with any suitable geometric shape, such as a hex shape, that is formed to receive or mate with a common sized and shaped and complementary driving tool, such as a hex shaped hex drive bit.

With respect to FIGS. 1 and 1(*a*), the vertical adjustment component 50 can be coupled to a hinge barrel 60. The hinge barrel 60 can include a bore 62 extending longitudinally therethrough. Such hinge barrel 60 can include a threaded inner surface 64 having a thread configuration corresponding to a thread configuration of the threaded outer surface 52 of the vertical adjustment component 50. With this arrangement, as the vertical adjustment component 50 is caused to be rotated, the hinge barrel 60 displaces vertically or is vertically displaced about the vertical adjustment component 50 via the mating relationship between the threaded inner surface 64 of the hinge barrel 60 and the threaded outer surface 52 of the vertical adjustment component 50. The hinge barrel 60 displaces vertically upward or downward depending on the rotational direction induced within the vertical adjustment component 50. For example, rotation of the vertical adjustment component 50 in the direction indicated by rotational arrow 51 functions to displace the hinge barrel 60 vertically upward about the vertical adjustment component 50, as indicated by arrow 61. Likewise, rotation of the vertical adjustment component 50 in the opposite direction, as indicated by rotational arrow 53, functions to displace the hinge barrel vertically downward about the vertical adjustment component 50, as indicated by arrow 63.

As the hinge barrel 60 is integrally formed with or coupled to the swivel joint 70 coupling the horizontal adjustment component 80, and as the horizontal adjustment component 80 is operably coupled to the gate bracket 30 through the collar 90, any bi-rotational adjustment or manipulation of the vertical adjustment component 50 that results in vertical bi-directional movement or displacement of the hinge barrel 60, translates into a corresponding vertical bi-directional movement or displacement of the gate bracket 30, and therefore the gate 4, due to the fact that the post 2 is typically anchored into the ground and incapable of movement. As such, bi-rotationally adjusting or manipulating the vertical adjustment component 50 functions to raise or lower the gate 4 with respect to the post 2, thus allowing the gate 4 and the post 2 to be properly aligned in the vertical. Of course, as will be recognized by one skilled in the art, in the event the hinged components within a hinge assembly comprise two moveable structures (rather than one being anchored), bi-rotational adjustment or manipulation of the vertical adjustment component 50 may translate into the vertical bi-directional displacement of either hinged component, depending upon the particular configuration of the hinge assembly.

With reference again to FIGS. 1–2-B, the adjustable hinge 10 further comprises a horizontal adjustment component 80 operably coupled to the gate bracket 30, wherein the horizontal adjustment component 80 is configured to facilitate the horizontal adjustment and alignment of the post bracket 20 with respect to the gate bracket 30, and therefore the post 2 with respect to the gate 4 as attached thereto, respectively. The gate bracket 30 comprises at least one gate mounting portion 32 sized and configured to interface with at least a portion of one or more surfaces of the gate 4. In a more preferred embodiment, such as the one shown, the gate bracket 30 comprises first and second gate mounting portions 32-*a* and 32-*b* in the form of flanges that are offset from one another in a substantially perpendicular orientation, wherein each of the gate mounting portions 32-*a* and 32-*b* comprise one or more mounting holes 34 formed and extending therethrough. The gate mounting portions 32-*a* and 32-*b* are sized and configured to engage and abut complementary sides of the gate 4. The gate mounting portions 32 can be mounted and secured to the gate 4 with any suitable fastener, such as bolts, screws, rivets, etc., placed through the mounting holes 34. The gate bracket 30 further comprises a raised portion 36 formed with and extending outward from the gate mounting portion 32-*b*. Such raised portion 36 is configured to support the horizontal adjustment component 80. Moreover, the raised portion 36 is configured to extend outward a distance in order to located the horizontal adjustment component 80 in an offset manner from the gate mounting portion 32-*b*, as well as to locate and support the horizontal adjustment component 80 substantially within a common plane as the vertical adjustment component 50.

As shown in FIGS. 1–2-B, the horizontal adjustment component 80 is supported on the raised portion 36 by a collar 90, which is securely coupled to the raised portion 36. The collar 90 can be securely fixed to an outer surface of the raised portion 36 by any suitable means, such as welding. The collar 90 includes a collar bore 92 sized and configured to receive the horizontal adjustment component 80. The collar bore 92 can include a threaded inner surface 94, or it may comprise a smooth inner surface and some type of securing means to keep the horizontal adjustment component 80 in place.

Referring again to FIGS. 1 and 2, similar to the vertical adjustment component 50, the horizontal adjustment component 80 can include a threaded outer surface 82 having a thread configuration corresponding to a thread configuration of the threaded inner surface 94 of the collar 90. As such, rotation of the horizontal adjustment component 80, as indicated by bi-rotational arrow 81, facilitates horizontal movement of the collar 90 about the horizontal adjustment component 80, as indicated by bi-linear arrow 91, via the threaded inner surface 94 of the collar 90 and the threaded outer surface 84 of the horizontal adjustment component 80. The threaded outer surface 82 can extend continuously along at least a portion of the longitudinal length of the horizontal adjustment component 80 between a first end portion 84 and a second end portion 86 (see FIG. 3), or the threaded outer surface 82 can extend continuously along substantially an entire distance of the longitudinal length of the horizontal adjustment component 80 between the first and second end portions 84 and 86.

The first end portion 84 of the horizontal adjustment component 80 can be a free-end, as shown, and can comprise a driving component 88 located thereon, wherein the driving component 88 is configured in a similar manner as the driving component previously set forth above in discussing the vertical adjustment component 50. As such, the driving component 88 is configured to receive and be rotationally driven by a tool, such as a drill having a complementary hex drive bit supported therein. Preferably, the driving component 56 of the vertical adjustment component 50 is the same as the driving component 88 of the horizontal adjustment component 80 for ease and speed of installation.

The second end portion 86 of the horizontal adjustment component 80 is operably coupled to the hinge barrel 60 so that the horizontal adjustment component 80 and the gate bracket 30 are allowed to pivot about the hinge barrel 60, and more particularly about the vertical adjustment component 80 and the post bracket 20. In one exemplary embodiment, the end portion 86 of the horizontal adjustment component 80 is coupled to the hinge barrel 60 through use of a swivel joint 70. The swivel joint is operably coupled to the hinge barrel 60 via any known attachment or coupling means, such as welding, soldering, etc., and the horizontal adjustment component 80 is operably coupled to the swivel joint 70 using any known means for coupling. The swivel joint 70 functions to prevent separation of the horizontal adjustment component 80 and the hinge barrel 60, while at the same time allowing the horizontal adjustment component 80 to spin or rotate within the swivel joint 70 for adjustment purposes. It is also by means of the hinge barrel 60 and swivel joint 70 that the post bracket 20 and gate bracket 30 are operably coupled to each other such that the gate bracket 30 is allowed to pivot or rotate about the post bracket 30 when the adjustable hinge 10 is properly installed, thus allowing the gate 4 to open and close.

The swivel joint 70 can extend orthogonally from the hinge barrel 60 and can include a swivel bore (not shown) configured to receive an end portion of the horizontal adjustment component 80. With this arrangement, the horizontal adjustment component 80, as disposed within the swivel joint 70 and the collar 90, and the vertical adjustment component 50, as disposed within the hinge barrel 60, are positioned substantially orthogonal with respect to one another and are positioned in substantially a common plane.

With the post bracket 20 and gate bracket 30 operably coupled to each other via the hinge barrel 60 and swivel joint 70, rotation of the horizontal adjustment component 80 facilitates movement or displacement of the collar 90 about the longitudinal length of the horizontal adjustment component 80, and thus, horizontal movement of the gate bracket 30 with respect to the post bracket 20, and also the gate 4 with respect to the post 2. The available distance the collar 90 is allowed to displace or traverse about the horizontal adjustment component 80 corresponds to the dimensions of the collar 90, as well as the number of threads making up the threaded outer surface 82. Such a distance can vary depending on the chosen dimensions of the horizontal adjustment component 80, the number of threads, and the size of the collar 90 as long as structural integrity is maintained in the adjustable hinge 10 and as will be recognized by those skilled in the art.

Likewise, rotation of the vertical adjustment component 50 facilitates movement or displacement of the hinge barrel 60 about the longitudinal length of the vertical adjustment component 50, and thus, vertical movement of the gate bracket 30 with respect to the post bracket 20, and also the gate 4 with respect to the post 2. The available distance the hinge barrel 60 is allowed to displace or traverse about the vertical adjustment component 50 corresponds to the dimensions of the hinge barrel 60, as well as the number of threads making up the threaded outer surface 52 of the vertical adjustment component 50. This distance can vary to any suitable distance depending on the chosen dimensions of the vertical adjustment component 50, the number of threads, and the size of the hinge barrel 60 as long as structural integrity is maintained in the adjustable hinge 10 and as will be recognized by those skilled in the art.

The adjustable hinge 10 further comprises optional means for biasing the hinged component assembly, such that as one hinged component pivots about the other, it does so in a biased manner. Means for biasing functions to induce a moment force within the adjustable hinge 10, which moment force creates a tendency within the adjustable hinge 10 to pivot the hinged components to a reduced force position, such as a closed position. Means for biasing may comprise any type known in the art, such as a torsion spring, a coil spring, a gravity-cam system, and others. In addition, means for biasing may be configured in several different ways to bias one hinged component with respect to the other. In the embodiment shown, means for biasing comprises an external torsional spring 100 that is disposed about the vertical adjustment component 50 and that engages both the post bracket 20 and the swivel joint 70. The external torsional spring 100 is located below and adjacent the hinge barrel 60. In this arrangement, the torsional spring 100 biases the pivoting gate bracket 30 with respect to the post bracket 20, particularly as the gate bracket 30 is pivoted away from its closed position. Other torsional spring configurations and placement positions are contemplated, such as above the hinge barrel 60, or on both sides of the hinge barrel 60. In addition, one continuous double spring may be utilized on both sides of the swivel joint 70 to add spring strength and durability. In essence, the adjustable spring 10 allows the gate 4 to swing open and closed, or pivot, about the post 2, while means for biasing functions to induce a force within the adjustable hinge 10 that tends to cause the gate 4 to swing or pivot from a respectively increased moment force position (e.g., an open position) to a respectively reduced moment force position (e.g., a closed position). The function and concept of means for biasing, as applied to a hinge or hinge assembly, is well known in the art, and is therefore not discussed in any greater depth herein.

As indicated above, the horizontal adjustment component 80 is coupled to the swivel joint 70 using any means for coupling known to those skilled in the art. Several different exemplary means for coupling are presented herein. However, these are not meant to be limiting in any way, but are merely set forth to provide an illustration of some of the different variations of the several possible means for coupling. One exemplary embodiment of means for coupling is illustrated in FIG. 3-A, wherein means for coupling comprises a fastener 102 having a head portion 106 and a threaded shaft portion 110 for coupling to the horizontal adjustment component 80. The fastener 102 is located between the swivel joint 70 and the horizontal adjustment component 80, and functions to securely couple the horizontal adjustment component 80 within the swivel joint 70. Specifically, as shown, the swivel joint 70 comprises a swivel bore 72 defined therethrough with the second end portion 86 of the horizontal adjustment component 80 at least partially extending and contained within the swivel bore 72. In this embodiment, the second end portion 86 can include a recessed portion formed within the second end portion 86 configured to receive the fastener 102 therein. The fastener 102 is configured to facilitate the rotatable coupling of the horizontal adjustment component 80 within the swivel joint 70 in that the head 106 of the fastener 102 abuts with and slidably rotates against or about a ledge 74 defined or formed within the inner surface of the swivel bore 72. As such, the head 106 of the fastener 102 includes a larger diameter than a diameter of the horizontal adjustment component 80. The fastener 102 can be any suitable fastener, such as a screw, bolt, rivet, etc., and is shown in FIG. 3 as a screw.

FIG. 3-B illustrates another embodiment of means for coupling the horizontal adjustment component 80 to the swivel joint 70. This embodiment is similar to the embodiment of FIG. 3-A in that a bore 72 is formed or defined with in the swivel joint 70, wherein the bore 72 comprises a ledge 74. However, unlike the embodiment of FIG. 3-A where an independent fastener is coupled to the end portion 86 of the horizontal adjustment member 80, in this embodiment, the horizontal adjustment component 80 comprises a flange portion 116 located on its end portion 86. The flange portion 116 can be configured as an annular member that extends outward from the end portion 86 of the horizontal adjustment component 80, or it can be configured to comprise segments that extend outward from the end portion 86. Similar to the fastener 102 in FIG. 3-A, the flange portion 116 is configured to abut with and slidably rotate about or against the ledge 74 formed in the swivel bore 72. In one aspect, the flange 116 can be formed from the end portion 86 itself by any suitable method, such as by stamping to form a swage, upset or flare. In another aspect, the flange 116 may be a separate structural member molded and/or welded to the end portion 86. In still another aspect, the flange 116 may comprise a separate structural member that is removably coupled to the end portion 86. In any event, the flange portion 116 comprises a larger diameter than the horizontal adjustment component 80, and suitable to extend over the ledge 74 to secure the horizontal adjustment component 80 in place within the swivel joint 70.

FIGS. 3-C–3-D illustrate still another embodiment of means for coupling the horizontal adjustment component 80 to the swivel joint 70. In this embodiment, the horizontal adjustment component 80 comprises a continuous annular groove 120 formed in its second end portion 86. The inside surface of the swivel joint 70 comprises a protrusion 124 sized and configured to correspond with the annular groove 120 to couple the horizontal adjustment component 80 to and within the swivel joint 70, as well as to facilitate rotation of the horizontal adjustment component 80 within the swivel joint 70. The protrusion 124 can be formed by any suitable method and may comprise a single annular structure, or one or more individual protrusions. In one aspect, the protrusion 124 is formed by crimping the swivel joint 70, thus forming an annular crimp portion 128 in its outside surface. FIG. 3-D illustrates a perspective view of such an annular crimp portion 128 formed in the swivel joint 70 as extending orthogonally from the hinge barrel 60. Other methods of forming the protrusion 124 will be recognized by those skilled in the art.

FIG. 3-E illustrates a perspective view of still another embodiment of means for coupling the horizontal adjustment component 80 to the swivel joint 70. In this embodiment, one or more slots 132 are formed through the swivel joint 70 extending into the swivel bore 72. With the slots 132 defined in the swivel joint 70, an external clip 136 or wire can be slid over the swivel joint 70, such that a portion of the external clip 136 is disposed within the slots 132 for the purpose of engaging and rotatably securing the horizontal adjustment component 80 in place. A complementary groove portion (see annular groove 120 in FIG. 3-C) is formed in the horizontal adjustment component 80 to receive the portion of the external clip 136 extending through the slots 132 in the swivel joint. The relationship between the clip 136 and the horizontal adjustment component 80 functions to keep the horizontal adjustment component 80 from sliding within the swivel bore 72. With the external clip 376 rotatably coupling the horizontal adjustment component 80 to the swivel joint 70 as indicated, the horizontal adjustment component 80 is allowed to rotate within the swivel joint 70 to facilitate horizontal adjustment of the adjustable hinge. Moreover, in this embodiment, the clip 136 can be selectively disengaged from the horizontal adjustment component 80 and the swivel joint 70, thus allowing the horizontal adjustment component 80 to be removed from the swivel joint 70, thereby, allowing easy removal and replacement of the gate from the fence post.

FIG. 3-F illustrates a perspective view of still another embodiment of means for coupling the horizontal adjustment component 80 to the swivel joint 70. In this embodiment, the swivel joint 70 can include an opening 140 formed through the swivel joint 70 extending into the swivel bore 72. A post 144 or any other suitable structure may be inserted into the opening 140 a distance sufficient to engage a corresponding groove (see annular groove 120 in FIG. 3-C) formed in the horizontal adjustable component 80, similarly as discussed above. The post 144 is configured to be disposed in the annular groove of the horizontal adjustment component 80 to facilitate the rotatable coupling of the horizontal adjustment component 80 to the swivel joint 70. The post 144 can be any suitable post, such as a rivet, threaded fastener, dowel, twist pin, etc. The post 144 can also be configured to facilitate selective removal and insertion of the horizontal adjustment component 80 from the swivel joint 70, thereby, allowing easy removal of the gate from the post if necessary.

FIG. 3-G illustrates a perspective view of still another embodiment of means for coupling the horizontal adjustment component 80 to the swivel joint 70. In this embodiment, the swivel joint 70 comprises an opening 148 formed therein that is sized and configured to receive a pin 152 configured to extend into and through the opening 148 to engage an annular groove (see annular groove 120 in FIG. 3-C) formed in the second portion of the horizontal adjustment component 80. The pin 152 may comprise any configuration capable of securing the horizontal adjustment component 80 in place within the swivel joint 70, while facilitating its selective rotation for purposes of adjusting the adjustable hinge. The pin 152 is also preferably configured to accommodate easy removal and insertion in the event the horizontal adjustment component 80 is to be removed from the swivel joint 70.

FIG. 3-H illustrates a cut-away side view of still another embodiment of means for coupling the horizontal adjustment component 80 to the swivel joint 70. This embodiment is similar to the embodiment of FIG. 3-A in that a bore 72 is formed or defined with in the swivel joint 70, wherein the bore 72 comprises a ledge 74. However, unlike the embodiment of FIG. 3-A where an independent fastener is coupled to the end portion 86 of the horizontal adjustment member 80, in this embodiment, the end portion 86 comprises an annular groove 120 sized and configured to receive a snap ring 156 as known in the art. The snap ring 156 is sized and configured to rotatably secure the horizontal adjustment member 80 in place within the swivel joint 70. Similar to the fastener 102 in FIG. 3-A, the snap ring 156 is configured to abut with and slidably rotate about or against the ledge 74 formed in the swivel bore 72 as it comprises a larger diameter than the horizontal adjustment component 80, and is sized and configured to be seated against the ledge 74 as shown to secure the horizontal adjustment component 80 in place within the swivel joint 70, as well as to facilitate its rotation for horizontal adjustment of the adjustable hinge.

Figure 4:
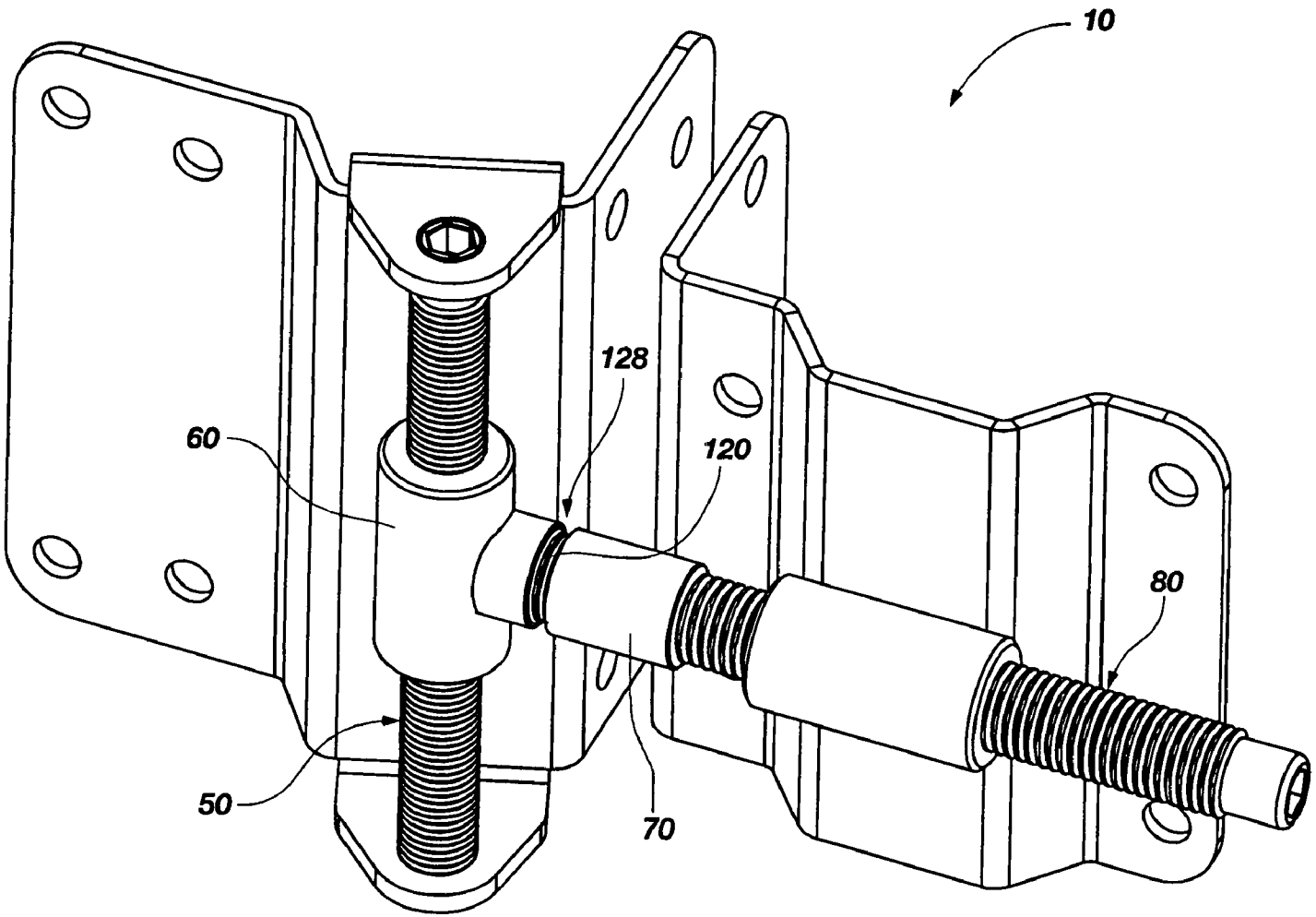
FIG. 4 illustrates a perspective view of an adjustable hinge according to another exemplary embodiment, wherein the adjustable hinge comprises an alternative configuration of the swivel joint as operably related to the hinge barrel disposed about the vertical adjustment component.

Referring now to FIG. 4, shown is a perspective view of an adjustable hinge according to another exemplary embodiment. Specifically, FIG. 4 illustrates the adjustable hinge 10 as comprising an alternative configuration of the swivel joint 70 as operably related to the hinge barrel 60 disposed about the vertical adjustment component 50. In this embodiment, the horizontal adjustment component 80 is inserted within the swivel joint 70. Once properly positioned, a crimp 128 is formed within the swivel joint 70, wherein the crimp 128 forms a protrusion 124 (see FIG. 3-C) that extends down into an annular groove 120 formed within the horizontal adjustment component 80. FIG. 4 comprises, at the location of the crimp 128, a cut-away section in order to illustrate the annular groove 120 formed in the horizontal adjustment component 80. This embodiment is similar to the one described in FIGS. 3-C and 3-D.

FIG. 4 further illustrates how the swivel joint 70 may be integrally formed with the hinge barrel 60 rather than being a separate and independent structure that is coupled to the hinge barrel 60 as the embodiment illustrated in FIG. 1. As integral components, the swivel joint 70 and the hinge barrel 60 may be machined from a solid block, or cast as a single structure.

Figure 5:
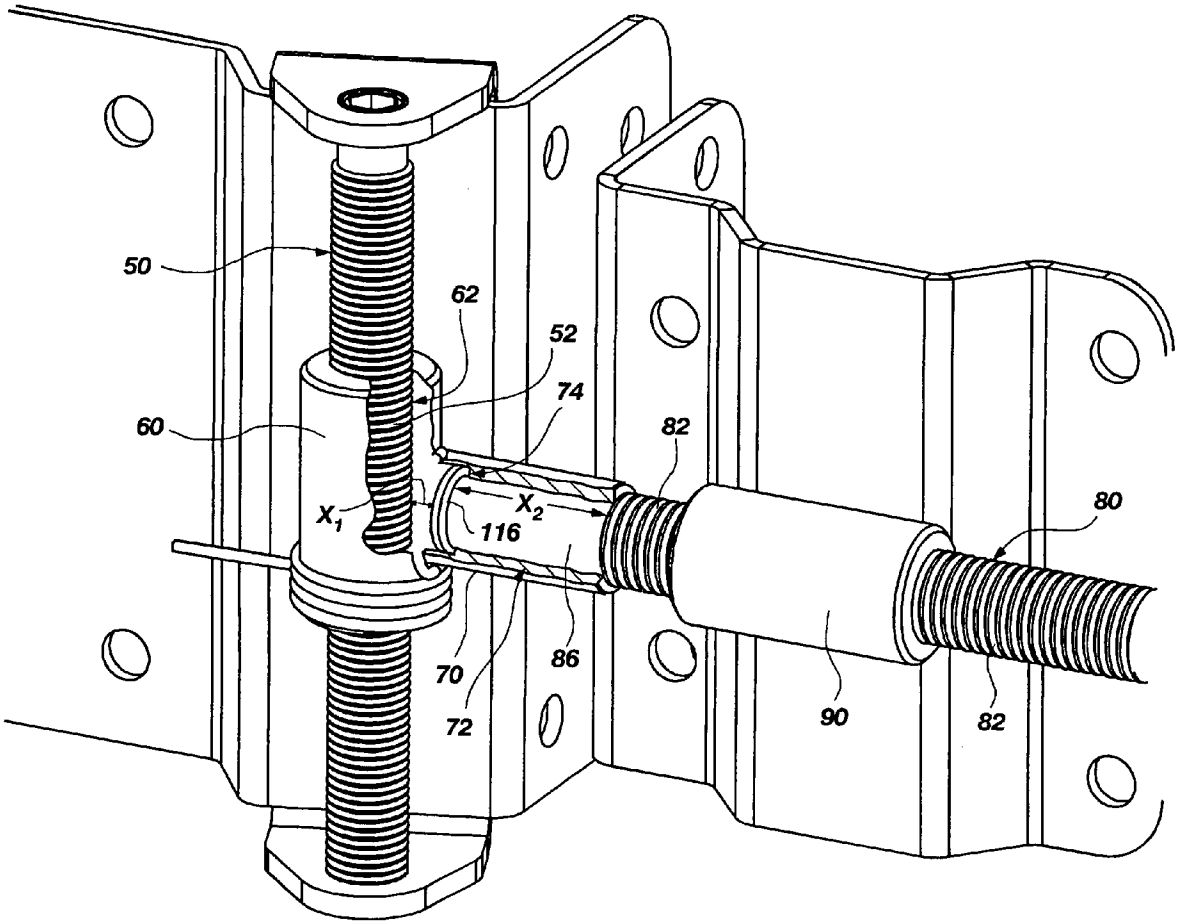
FIG. 5 illustrates a perspective view of the adjustable hinge embodiment illustrated in FIG. 4 having cut-away sections to show the coupling configurations and operating relationships between the various components of the adjustable hinge.

With reference to FIG. 5, illustrated is a perspective view of the adjustable hinge embodiment illustrated in FIG. 4 having cut-away sections to show the coupling configurations and operating relationships between the various components of the adjustable hinge. Specifically, FIG. 5 illustrates adjustable hinge 10 as comprising a vertical adjustment component 50 having outer threads 52 formed therein, such that the vertical adjustment component 50 is rotatably disposed within a bore 62 of a hinge barrel 60, wherein the bore 62 has an inner surface with threads corresponding to threads 52 of the vertical adjustment component 50. This configuration and function of these are as discussed above. The adjustable hinge 10 further comprises a horizontal adjustment component 80 having outer threads 82 formed therein, such that the horizontal adjustment component 80 is rotatably disposed within a bore 92 of a collar 90, wherein the bore 92 has an inner surface with threads corresponding to the threads 82 of the horizontal adjustment component 80, also as discussed above.

From the cut-away portion, it can be seen that the horizontal adjustment component 80 comprises a portion thereof contained or supported within the bore 72 of the swivel joint 70 that is not threaded, but rather comprises a smooth surface. This non-threaded portion functions to facilitate the free rotation of the horizontal adjustment component 80 within the swivel joint 70. The non-threaded portion is formed about end 86, which is rotatably supported within the swivel joint 70 using one of the means for coupling described above. In the embodiment shown in FIG. 5, means for coupling comprises a flange portion 116 formed on the end 86 of the horizontal adjustment component 80. This flange portion 116 engages the ledge 74 formed within the bore 72 of the swivel joint 70 to prevent the horizontal component from sliding out of the swivel joint 70. The flange 116 is also capable of rotating about the ledge 74 as the horizontal adjustment component 80 is bi-rotationally manipulated or adjusted.

Again from the cut-away portion, it can be seen that the end 86 of the horizontal adjustment component 80 is located and supported in place a distance $x_1$ from the vertical adjustment component 50. As such, the vertical and horizontal adjustment components 50 and 80 never come in contact with one another. This distance $x_1$ may vary depending upon the particular configuration of the adjustable hinge 10. The relationship between the ledge 74 and the flange portion 116 prevents the horizontal adjustment component 80 from sliding out of the swivel joint 70 in one direction. To prevent the horizontal adjustment component 80 from sliding toward and contacting the vertical adjustment component 50, a portion of the end 86 of the horizontal adjustment component 80 is configured to comprise a smaller diameter than the diameter of the outer threaded portion 52. This reduced diameter portion may be integrally formed with the horizontal adjustment component 80 (e.g., a turned down portion), or it may comprise a separate and independent member coupled or otherwise fixed to the end of the horizontal adjustment component 80, each of which are well known in the art. As such, the bore 72 of the swivel joint also comprises a smaller diameter than the outer threaded portion 82 of the horizontal adjustment component 80, but slightly larger than the diameter of the end 86. In this configuration, the distance $x_2$ of the reduced diameter portion of the end 86 of the horizontal adjustment component 80 is approximately equivalent to the distance from the ledge 74 to the end of the swivel joint 70. Therefore, the horizontal adjustment component 80 is prevented from bi-directionally displacing or moving within the swivel joint 70, and also from coming in contact with the vertical adjustment component 50 as the outer threaded portion 82 abuts the outer edge of the swivel joint 70. Other means or methods may be employed to prevent such movement as will be recognized by one skilled in the art, each of which are contemplated herein. For example, the adjustable hinge 10 may further comprise some type of locking means, such as a nylon ball lock placed within the swivel joint 70 between the vertical adjustment component 50 and the end 86 of the horizontal adjustment component 80, to further secure the horizontal adjustment component 80, and to keep it from sliding toward and into the vertical adjustment component 50. As such, the horizontal adjustment component 80 may or may not comprise the same diameter along its longitudinal length.

FIGS. 6-A–6-C illustrate several top views of one exemplary adjustable hinge as coupling together two hinged components in the form of a post and a pivoting gate, and the relationship between the various components of the adjustable hinge, as well as the relationship between the post, a fence (not shown), and the gate, at different operating positions. As shown, the horizontal adjustment component 80 is adjusted to its maximum horizontally outward and extended position, thus creating the widest possible gap between the post 2 and the gate 4. Moreover, from these figures, it can be seen that the horizontal adjustment component 80 and the vertical adjustment component 50 are located in the same plane, which plane is offset from the post bracket 20 and the gate bracket 30, as well as the surfaces of the post 2 and gate 4 themselves.

Specifically, FIG. 6-A illustrates a top view of the adjustable hinge 10 (the exemplary embodiment of FIG. 1) as comprising a post bracket 20 mounted to a post 2 and a gate bracket 30 mounted to a gate 4, wherein the post 2 and gate 4 are shown coupling together the post 2 and the gate 4 in a closed gate position. In this position, the post 2 and the gate 4 are aligned in a common vertical plane. Moreover, the horizontal adjustment component 80 is rotated about the vertical adjustment component 50 at an angle $\theta \approx 0°$, which consequently means that gate bracket 30 is not rotated about the post bracket 20, nor the gate 4 about the post 2. As shown, a gap 6 is created between the post 2 and the gate 4. This gap 6 will vary with the adjustment of the horizontal adjustment component 80. As the gap widens, various privacy and security issues arise as these can be significantly impaired. As such, the present invention further features gap fillers, which eliminate such concerns, and which are discussed in detail below.

FIG. 6-B illustrates a top view of the adjustable hinge 10 as coupling together the post 2 and the gate 4 in a fully opened gate position. In the fully opened position, both the fence line and the gate 4 extend to the left of the adjustable hinge 10 and its components. As shown, the gate bracket 30 (and therefore the gate 4) pivots or rotates about the post bracket 20 (and therefore the post 2) within a range of rotation angles substantially between 0° and 180°. In effect, the horizontal adjustment component 80 is rotated about the vertical adjustment component 50 at an angle $\theta \approx 180°$, which consequently facilitates the rotation of the gate bracket 30 about the post bracket 20, as well as the gate 4 about the post 2. More or less rotation may be allowed depending upon the particular configuration of the adjustable hinge 10 and its component parts.

The configuration of the adjustable hinge 10 limits the rotation of the gate 4 and prevents binding within the adjustable hinge 10 as a result of the contact or collision of the gate 4 with the fence (not shown) coupled to and supported by the post 2. The adjustable hinge 10 is preferably configured so that the gate 4 collides with the fence upon rotating approximately 180° from the closed position. In essence, because the fence and the gate 4 both extend outward to the left of the adjustable hinge 10 in the fully opened position, and as a result of the racked out configuration of the post bracket 20, the gate 4 will collide with the fence before any of the components of the adjustable hinge 10 collide and bind with one another, namely the swivel joint 70 or the horizontal adjustment component 80 with the post bracket 20, or the collar 90 with the post bracket 20 or the fence or fence post 2. In other words, no component of the adjustable hinge 10 is allowed to bind with any other component of the adjustable hinge 10 prior to or upon impact of the gate 4 with the fence as a result of the racket out configuration of the extension portion 26 of the post bracket 20, and/or the adjustability of the horizontal adjustment component 80. Moreover, this racked out configuration facilitates the function and operation of the adjustable hinge 10 in each of the fully opened, fully closed, and overswing positions without any of its component parts binding with one another, or even coming in contact with one another, the fence, or the post 2. This is a significant advantage over prior related hinges or hinge assemblies that have a tendency to bind in either or both of the fully opened or the overswing positions, which binding can cause significant damage to or destroy the hinge, or at the very least can mar the paint on the brackets supporting the hinged components. In addition, unlike prior related hinges, the present invention adjustable hinge 10.

FIG. 6-C illustrates a top view of the adjustable hinge 10 as coupling together the post 2 and the gate 4 in an overswing position. In the overswing position, the horizontal adjustment component 80 is allowed to rotate too far about the vertical adjustment component 50, such that the rotation angle $\theta \approx -x°$, which consequently results in the over rotation of the gate bracket 30 about the post bracket 20, as well as the gate 4 about the post 2. In prior related hinge assemblies, an overswing position is far more damaging than a fully opened position. Particularly, overswing can cause significant moment forces (e.g., moment torque) within the hinge that can produce damaging results, such as destruction of the hinge itself, ripping of the post and gate brackets from the post and gates, damage to the fence posts and gate components themselves, etc. As such, the positional relationship between the impact point of the hinge or the hinged components and the pivot point of the hinge is crucial in minimizing the severe moments of torque. The configuration of the present invention adjustable hinge 10 and adjustable nature of its components significantly reduces the potential damage caused by overswing.

In an overswing position in which the present invention adjustable hinge 10 is utilized, the gate 4 is caused to rotate past an initial starting position (e.g., where $\theta \approx 0°$), wherein if the overswing is significant, the gate 4 will make contact or collide with the post 2, as shown. Advantageously, in the event of such overswing, the various component parts of the adjustable hinge 10 are kept from binding with each other as a result of the racked out extension member 26 of the post bracket 20, as well as the selectively adjusted position of the horizontal adjustment component 80. Indeed, because of this advantageous racked out configuration of the post bracket 20, the horizontal adjustment component 80 can be adjusted in a fully outward or maximum outward position, if so desired, which position still facilitates or allows the gate 4 to collide with the post 2 before any part of the adjustable hinge 10 collides or binds with itself. Specifically, the gate 4 is caused to contact the post 2 prior to the swivel joint 70 contacting or binding with the post bracket 20. The collision between the gate 4 and the post 2 obviously eliminates any further rotation or overswing within the adjustable hinge 10 in the same direction.

The degree of potential overswing by the adjustable hinge 10 may be manipulated and varied by making adjustments to the horizontal adjustment component 80. For example, with the horizontal adjustment component 80 adjusted inward from its shown maximum outward position, the degree of rotation within the adjustable hinge 10 is reduced as the gate 4 will be caused to contact the post 2 sooner than if the horizontal adjustable component 80 is in the maximum outward position. However, the further that the impact point between the post 2 and the gate 4 is from the pivot point, the less damage will result to the adjustable hinge 10, the gate 4, the post 2, and the various fence components. Moreover, the further the pivot point is from the impact point and the closer the pivot point is to the center of the gap 6, the less the binding torques will be within the hinged assembly. Still, as mentioned, the further the pivot point is from the side of the post 2, the greater the ease and ability to make adjustments to the adjustment components 50 and 80 with power tools.

Figure 7:
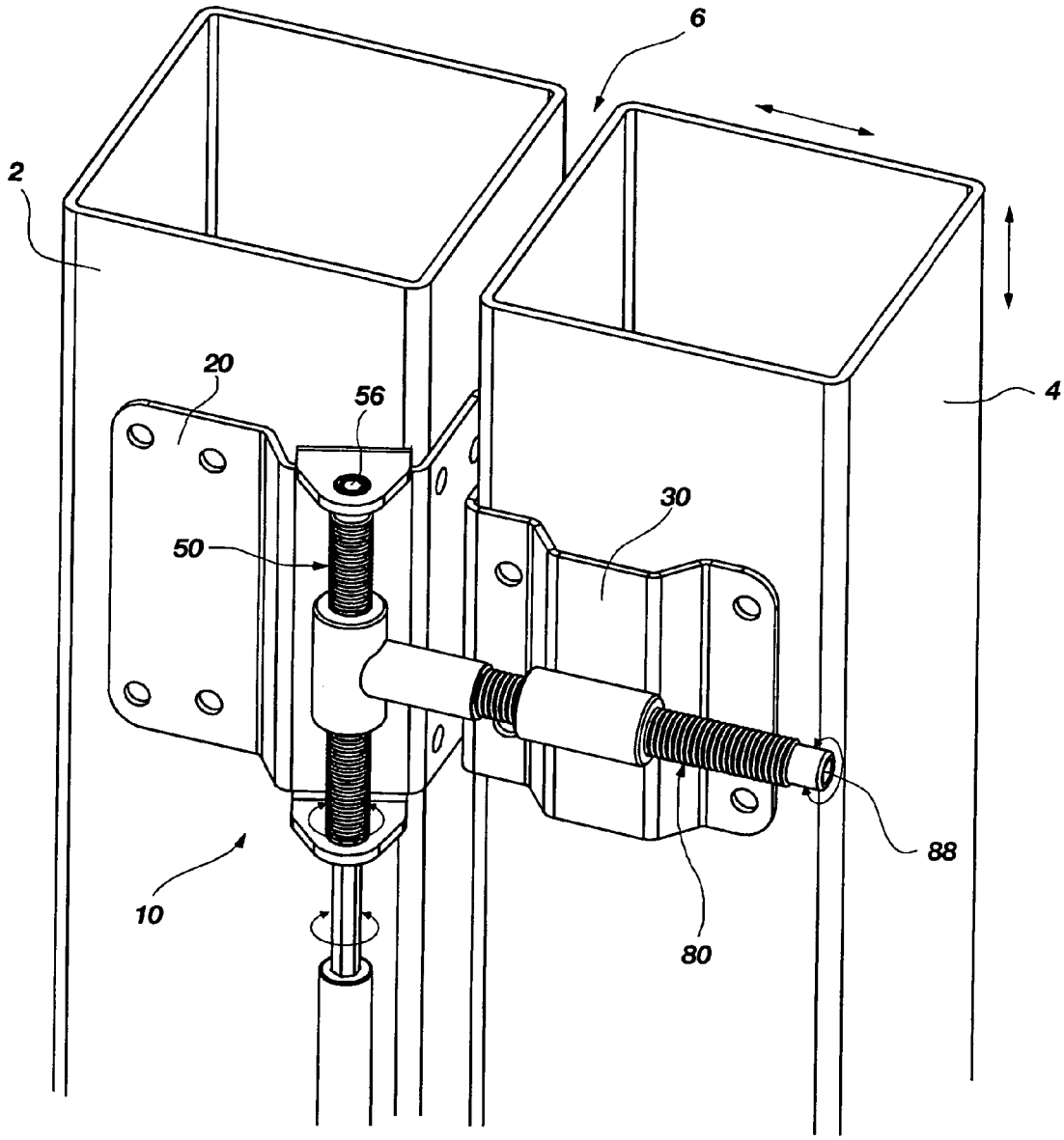
FIG. 7 illustrates a perspective view of the exemplary hinge of FIG. 1 as coupled or mounted to a fence and gate assembly.

With reference to FIG. 7, illustrated is a perspective view of the exemplary hinge of FIG. 1 as coupled or mounted to a fence and gate assembly. As shown, adjustable hinge 10 comprises a post bracket 20 mounted to a post 2 and a gate bracket 30 mounted to a gate 4. A gap 6 is created between the post 2 and the gate 4, which gap may be widened or narrowed, as desired, by adjusting the horizontal adjustment component 80. As described above, the gate 4 may be lowered or raised, as indicated by the arrows, by rotationally adjusting the vertical adjustment component 50. Similarly, as described above, the gate 4 may be extended from the post 2 or drawn in toward the post 2, as indicated by the arrows, by rotationally adjusting the horizontal adjustment component 80.

FIG. 7 further illustrates the rotational manipulation or adjustment of the vertical adjustment component 50 by a hex-type bit 160 supported and secured within a power drill (not shown). In this way, the hex-type bit 160 is received by the corresponding hex-type recess of the driving component 56 located on one or both of the ends of the vertical adjustment component 50, wherein the power drill may be actuated to quickly and effortlessly rotate the vertical adjustment component 50 to raise or lower the gate 4. The same applies to the horizontal adjustment component 80, which comprises a driving component 88 also configured to receive the hex-type bit 160. As so coupled, the power drill can be actuated to quickly and effortlessly rotate the horizontal adjustment component 80 to extend or draw in the gate 4 with respect to the post 2.

Figure 8:
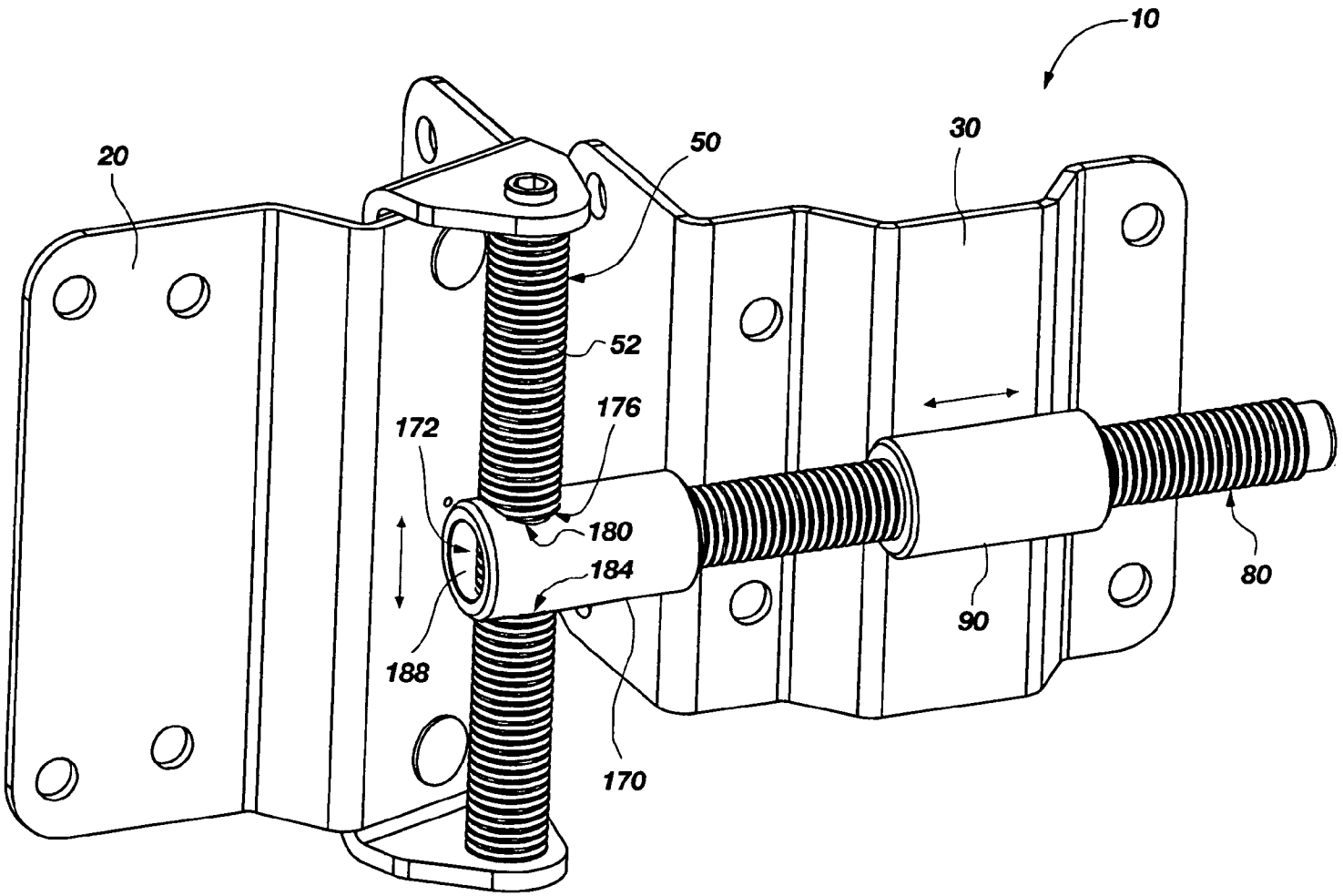
FIG. 8 illustrates a perspective view of an adjustable hinge according to another exemplary embodiment of the present invention.
Figure 9:
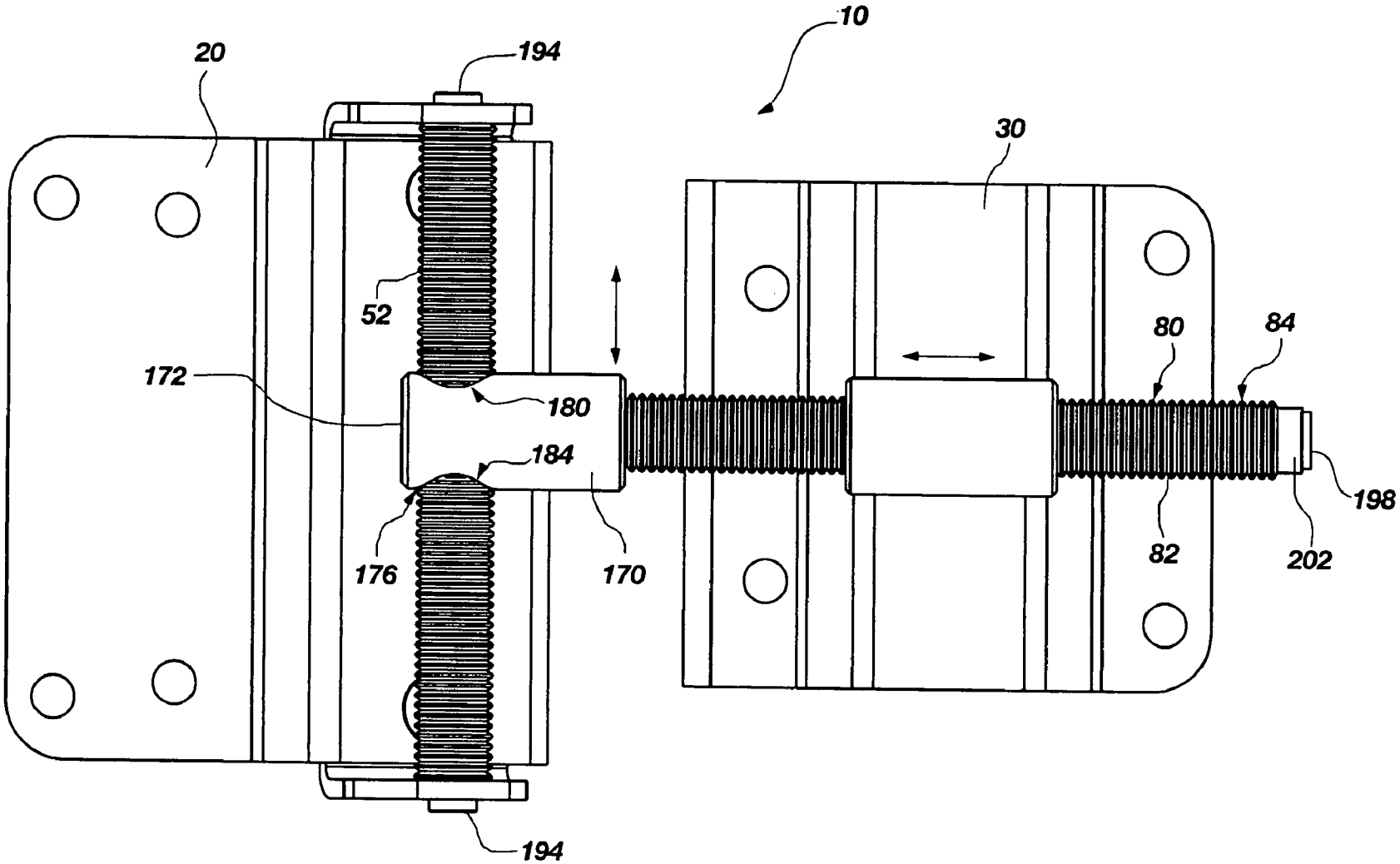
FIG. 9 illustrates a side view of the adjustable hinge of FIG. 8.

Referring now to FIGS. 8 and 9, illustrated are perspective and side views, respectively, of an adjustable hinge according to another exemplary embodiment of the present invention. It is noted that the description of the adjustable hinge embodiment set forth above for FIGS. 1–7 is incorporated herein for this embodiment, where applicable. As shown, adjustable hinge 10 comprises substantially the same configuration as the adjustable hinge of FIG. 1. However, in this embodiment, the adjustable hinge 10 comprises an alternatively configured swivel joint 170, which comprises a linear cylinder or tube-like structure sized and configured to couple the vertical adjustment component 50, as well as the horizontal adjustment component 80. Means for coupling the horizontal adjustment component 80 to the swivel joint 170 are similar to those embodiments described above in relation to FIGS. 3-A–3-H.

Specifically, the swivel joint 170 comprises a longitudinal bore 172 similar to the one described above for receiving and rotatably supporting therein an end of the horizontal adjustment component 80. In addition, transversely oriented with the longitudinal bore 172 is a lateral bore 176 extending all the way through the swivel joint 170, thus lateral bore 176 comprises an opening 180 and an opening 184. The lateral bore 176 is configured to receive and support the vertical adjustment component 50 and to facilitate vertical adjustment within the adjustable hinge 10. The lateral bore 176 is oriented towards an end of the swivel joint 170 in order to offset the vertical adjustment component 50 from the endmost portion of the horizontal adjustment component 80 so that these two components do not interfere with one another. Although optional, the swivel joint 170 further comprises an open-end 188 that facilitates the removal of moisture and debris from the swivel joint 170 during operation and over time. Of course, the end may be closed in other embodiments.

Openings 180 and 188 of the lateral bore 176 are tapped to comprise threads (not shown) that correspond to the threads 52 formed in the vertical adjustment component 50. As so configured, the swivel joint 170 functions to allow the vertical adjustment component 50 to be bi-rotationally adjusted to effectuate vertical bi-directional movement of the swivel hinge 170, and therefore the horizontal adjustment component 80, the gate bracket 30, and finally the gate (not shown). By rotating the vertical adjustment component 50, the swivel joint 170 displaces with respect to the vertical adjustment component 50 to adjust the hinged components relative to one another. Thus, turning the vertical adjustment component 50 one way moves the swivel joint 170 down, while turning it the opposite way moves the swivel joint 170 up. In essence, the swivel joint 170, with its lateral bore 176, is intended to function similar to the swivel joint 70 and hinge barrel 60 combination of FIG. 1.

FIGS. 8 and 9 further illustrate the internal broached driving configurations 194 and 198 of the vertical and horizontal adjustment components 50 and 80, respectively, wherein the driving configurations 194 and 198 are formed into the ends of each of these components rather than being a separate structure coupled thereto. As shown, a portion of the end 84 of the horizontal adjustment component 80 is turned down to comprise a reduced diameter than the diameter of the threaded outer surface 82.

Figure 10:
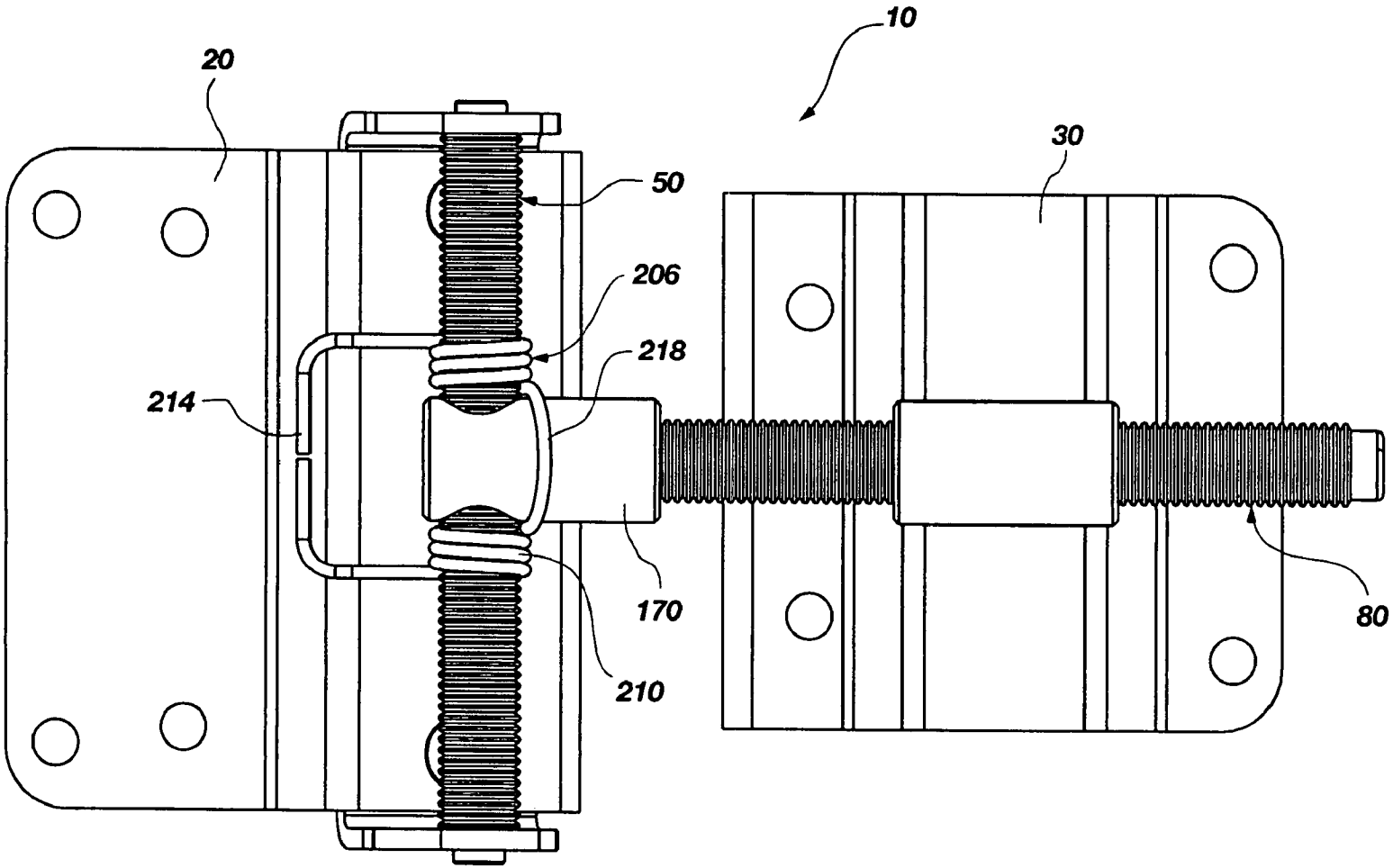
FIG. 10 illustrates a front view of the exemplary adjustable hinge of FIGS. 8 and 9, wherein the hinge comprises optional means for biasing the hinged component assembly.

FIG. 10 illustrates a front view of the exemplary adjustable hinge 10 of FIGS. 8 and 9. As shown, the adjustable hinge 10 comprises optional means for biasing the hinged component assembly, such that as one hinged component pivots about the other, it does so in a biased manner. Means for biasing functions to induce a moment force within the adjustable hinge 10, which moment force creates a tendency within the adjustable hinge 10 to pivot the hinged components to a reduced force position, such as a closed position. Means for biasing may comprise any type known in the art, such as a torsion spring, a coil spring, and others. In addition, means for biasing may be configured in several different ways to bias one hinged component with respect to the other. In the embodiment shown, means for biasing comprises an external torsional spring 206 that comprises first and second coils 210 and 212 that are disposed about the vertical adjustment component 50 on either side of the swivel joint 170. Integrally extending from the first and second coils 210 and 212 is first rest 214 that is configured to engage and rest against the post bracket 20. Also integrally extending from the first and second coils 210 and 212 is second rest 218 that is configured to engage and rest against the swivel joint 170. In this arrangement, the torsional spring 206 biases the pivoting gate bracket 30 with respect to the post bracket 20, particularly as the gate bracket 30 is pivoted away from its closed position. As stated above, other torsional spring configurations and placement positions are contemplated. Use of means for biasing essentially facilitates the automatic closure of the gate from an open or partially open position. Stated differently, means for biasing induces a moment force within the adjustable hinge 10 that tends to cause the gate to swing or pivot from a respectively increased moment force position (e.g., an open position) to a respectively reduced moment force position (e.g., a closed position).

Figure 11:
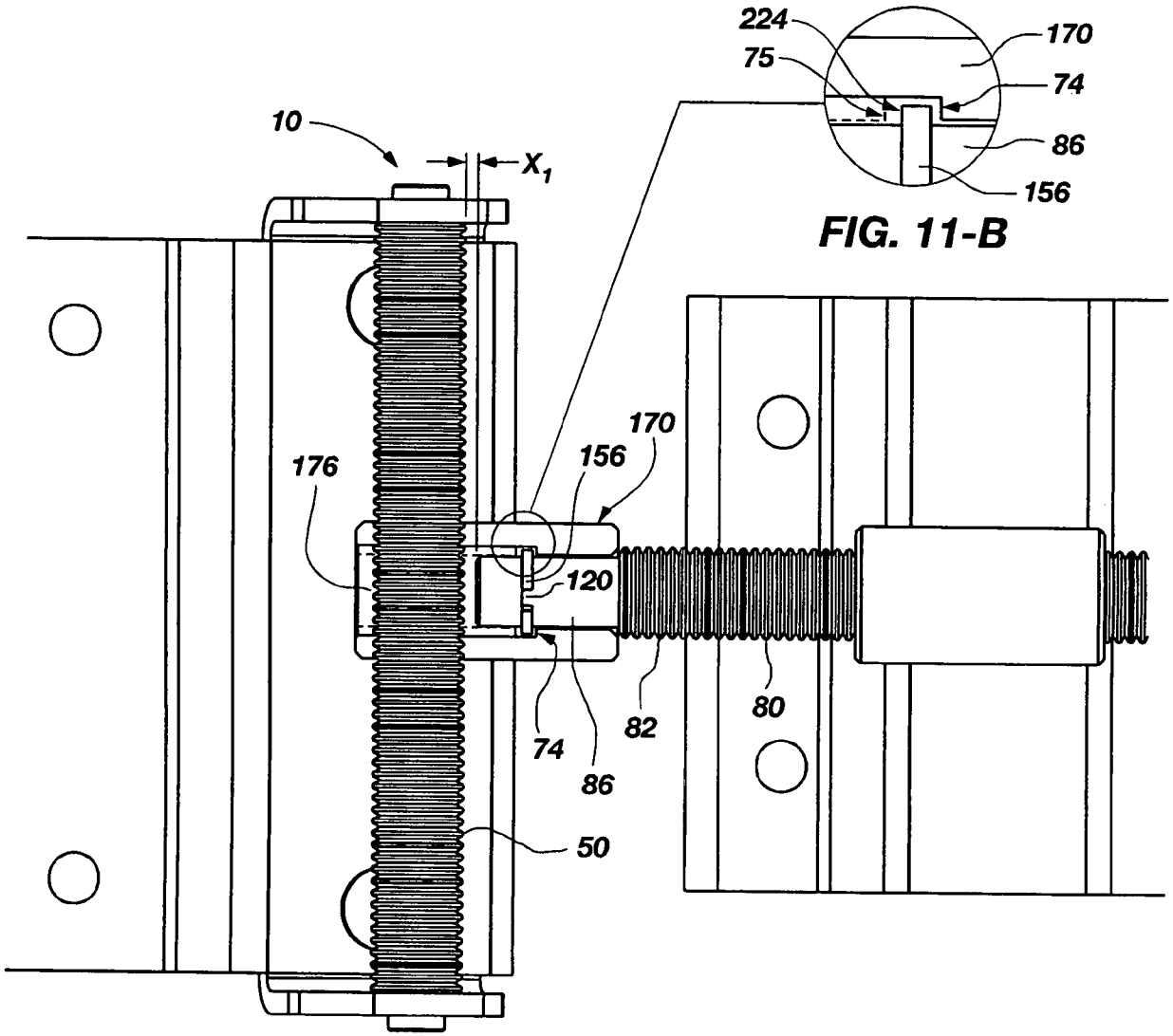
FIG. 11-A illustrates a front view of the exemplary adjustable hinge of FIGS. 8 and 9, with cut-away portions showing the coupling arrangement or configuration between the horizontal adjustment component and the swivel joint.

FIG. 11-A illustrates a front view of the exemplary adjustable hinge 10 of FIGS. 8 and 9, with cut-away portions showing the coupling arrangement or configuration between the horizontal adjustment component 80 and the swivel joint 170. As can be seen, the horizontal adjustment component 80 is coupled to the swivel joint 170 using a snap ring 156. The swivel joint 170 comprises a longitudinal bore 172 formed transverse to the lateral bore 176 configured to receive and support the vertical adjustment component 50. The longitudinal bore 172 comprises two different diameter sections to form a ledge 74 therein, which ledge 74 is configured to engage the snap ring 156. Specifically, the end portion 86 comprises an annular groove 120 sized and configured to receive the snap ring 156 as commonly known in the art. The snap ring 156 is sized and configured to rotatably secure the horizontal adjustment member 80 in place within the swivel joint 170 by abutting with or seating against the ledge 74. The snap ring, being of a larger diameter than the diameter at the ledge 74 when inserted into the annular groove 120, functions to slidably rotate about or against the ledge 74 to secure the horizontal adjustment component 80 in place within the swivel joint 70, as well as to facilitate its rotation for horizontal adjustment of the adjustable hinge. It is recognized herein that the ledge 74 prevents the horizontal adjustment component 80 from sliding in only one direction, namely out of the swivel joint 170. Therefore, at least a portion of the horizontal adjustment component 80, and particularly at least a portion of the end 86, comprises a smaller diameter than the threaded outer surface 82 of the horizontal adjustment component 80. This reduced diameter portion may be integrally formed with the horizontal adjustment component 80 (e.g., a turned down portion), or it may comprise a separate and independent rod coupled or otherwise fixed to the end of the horizontal adjustment component 80, each of which are well known in the art. As so designed, the larger diameter outer thread portion 82 abuts the edge of the swivel joint 170, thus preventing the horizontal adjustment component 80 from sliding toward the vertical adjustment component 50, thus maintaining a distance x1 between the vertical and horizontal adjustment components 50 and 80. Alternatively, the adjustable hinge 10 may further comprise some type of locking means, such as a nylon ball lock placed within the swivel joint 170 between the vertical adjustment component 50 and the end 86 of the horizontal adjustment component 80, to further secure the horizontal adjustment component 80, and to keep it from sliding toward and into the vertical adjustment component 50. As such, the horizontal adjustment component 80 may or may not comprise the same diameter along its longitudinal length.

FIGS. 11-A and 11-B further illustrate an annular groove 76 formed in the longitudinal bore 172 of the swivel joint 170 to receive and support, from opposing sides, the snap ring 156 as contained within the annular groove 120 of the horizontal adjustment component 80. The annular groove 76 is indicated by the dotted lines, particularly detailed in FIG. 11-B, and comprises a ledge 75 formed opposite the ledge 74 to create a gap making up the annular groove 76. In this configuration, the annular groove 76 secures the horizontal adjustment component 80 in place and limits its longitudinal or bi-directional displacement within the swivel joint 170. Particularly, the relationship between the annular groove 76 and the snap ring 156 prevents the horizontal adjustment component 80 from sliding toward and into the vertical adjustment component 50 or away from the vertical adjustment component 50 and out of the swivel joint 170 altogether. The annular groove 76 is sized and configured to receive the snap ring 156 as known in the art and to maintain the distance $x_1$ between the vertical and horizontal adjustment components 50 and 80. The concept of an annular groove formed in the bore of the swivel joint is equally applicable to the exemplary adjustable hinge embodiment of FIGS. 1–7 set forth above.

Figure 12:
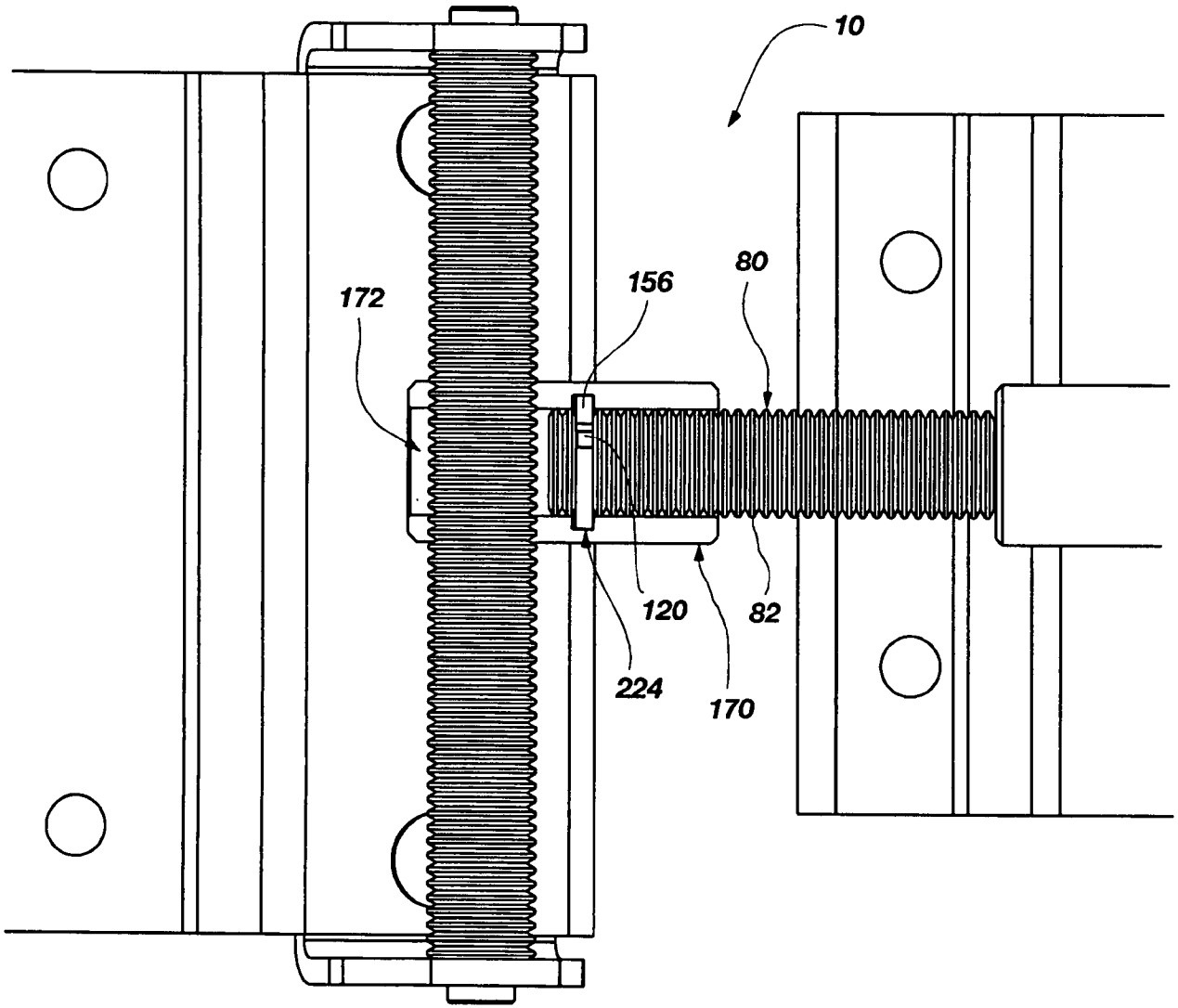
FIG. 12 illustrates a front view of the exemplary adjustable hinge of FIGS. 8 and 9, with cut-away portions showing an alternative means for coupling arrangement or configuration between the horizontal adjustment component and the swivel joint.

FIG. 12 illustrates a front view of the exemplary adjustable hinge 10 of FIGS. 8 and 9, with cut-away portions showing an alternative means for coupling arrangement or configuration between the horizontal adjustment component 80 and the swivel joint 170. In this embodiment, the horizontal adjustment component 80 comprises outer threads 82 formed along its entire longitudinal length. A snap ring 156 is situated within an annular groove 120 formed within the horizontal adjustment component 80, wherein the snap ring 156 is subsequently captured within the annular groove 76 formed within the longitudinal bore 172 of the swivel joint 170. In this configuration, the diameter of the bore 172 is slightly greater than the outside diameter of the horizontal adjustment component 80.

It is noted herein, that other means for coupling the horizontal adjustment component 80 to the swivel joint 170 are contemplated herein, such as those set forth above in FIGS. 1–5, each of which are incorporated for the adjustable hinge embodiment of FIGS. 8 and 9.

Figure 13:
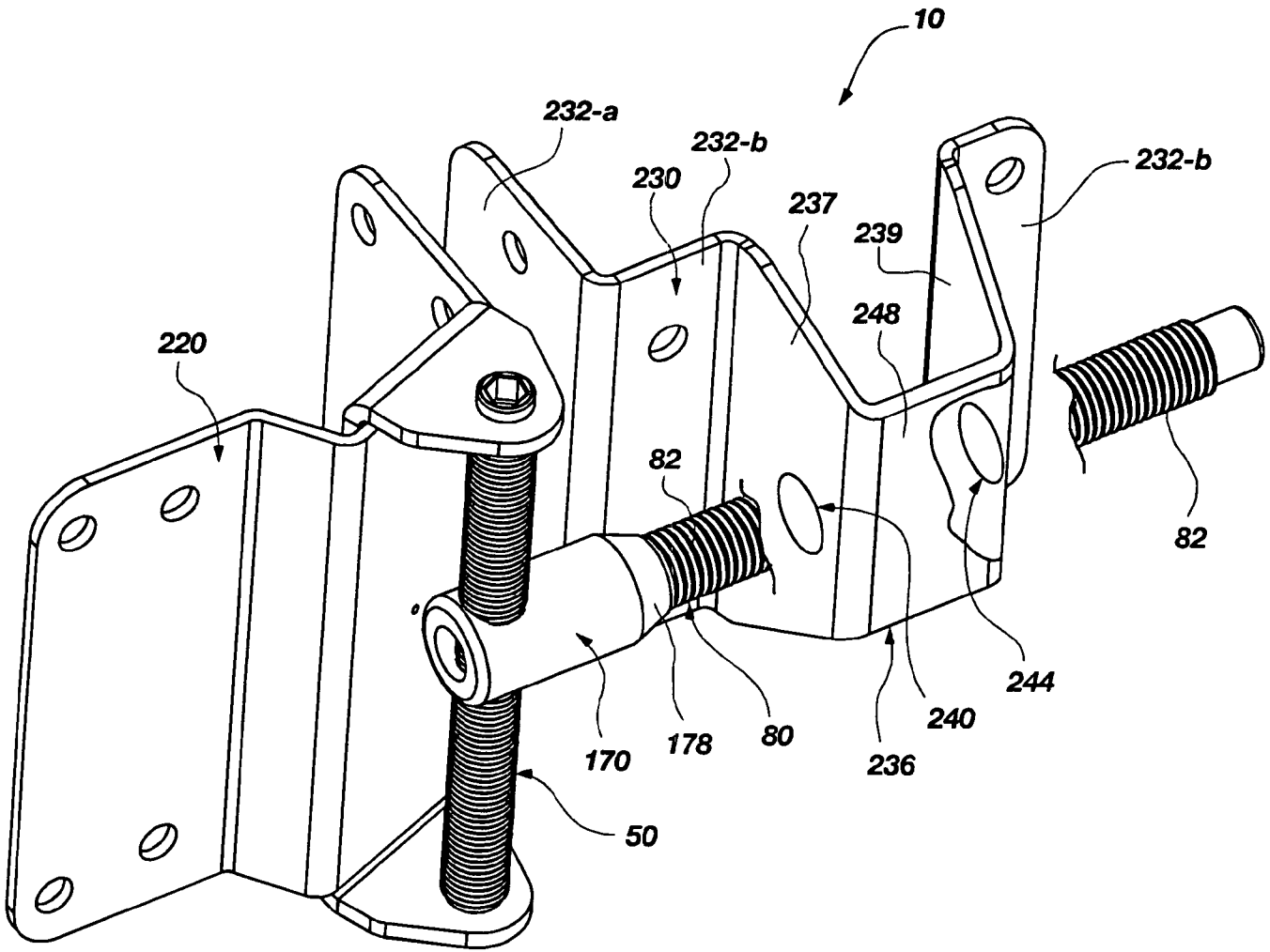
FIG. 13 illustrates a perspective view of an alternative embodiment of the adjustable hinge of FIGS. 8–12.
Figure 14:
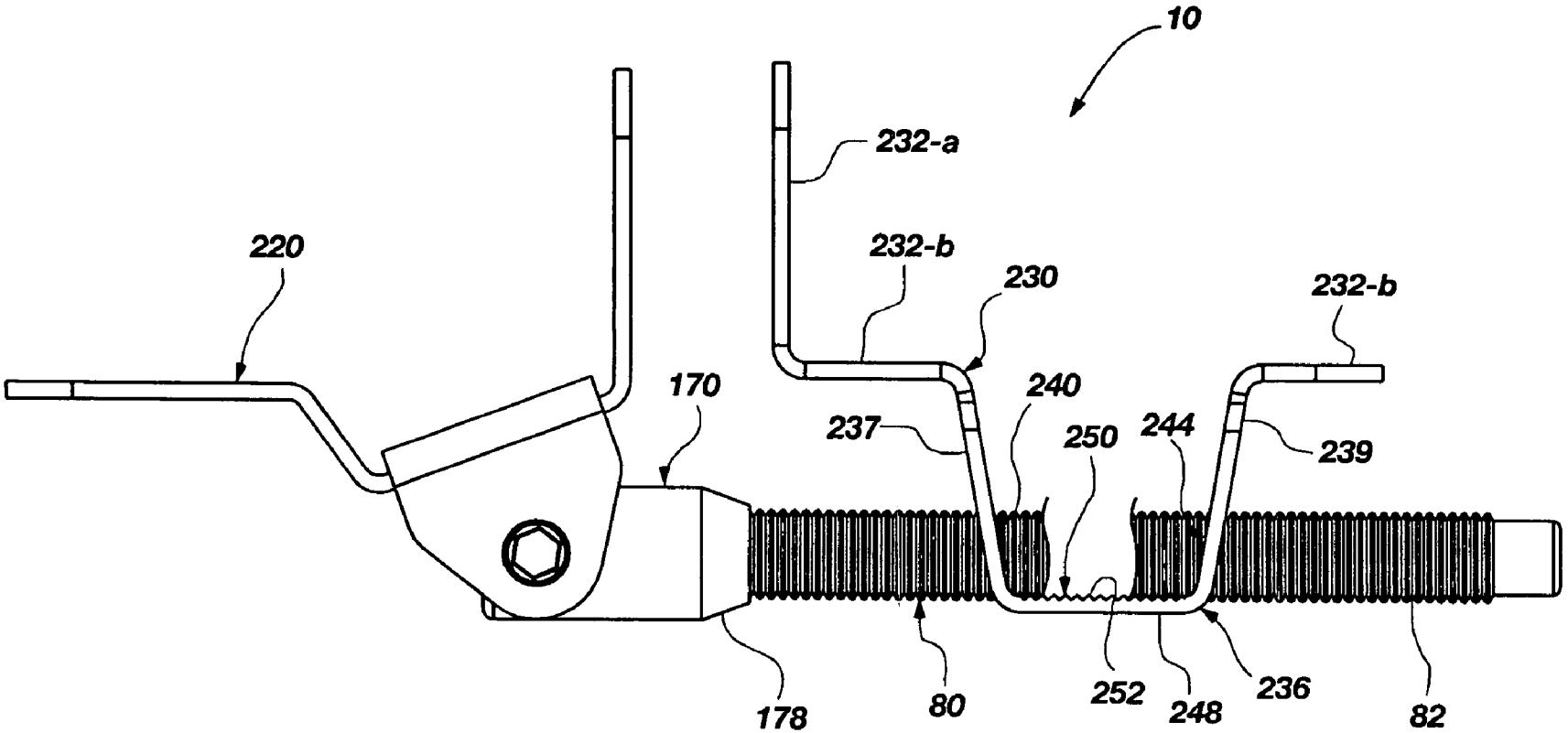
FIG. 14 illustrates a top view of an alternative embodiment of the adjustable hinge of FIGS. 8–12.

Referring now to FIGS. 13 and 14, illustrated is a perspective view and a top view, respectively, of an alternative embodiment of the adjustable hinge of FIGS. 8–12. Specifically, illustrated is an alternative bracket configuration for the adjustable hinge 10. As shown, adjustable hinge 10 comprises a post bracket 220 and a gate bracket 230. The post bracket 220 is similar in its configuration and function as the post bracket 20 set forth above. However, gate bracket 230 comprises an alternative design configuration. In this embodiment, gate bracket 230 comprises gate mounting portions 232-*a* and 232-*b* that are configured to be mounted to corresponding sides of a gate (not shown). Extending and offset from gate mounting portion 232-*b* is an extension portion 236. Extension portion 236 comprises a first sidewall 237 having an aperture 240 formed therein, which aperture 240 is sized and configured to receive and support the horizontal adjustment component 80 therethrough. Extension portion 236 further comprises a second sidewall 239 opposite and complementary to the first sidewall 237. The second sidewall 239 also comprises an aperture 244, which aperture 244 is coaxially oriented with the first aperture 240 and is also sized and configured to receive and support the horizontal adjustment component 80. Apertures 240 and 244 are preferably extruded to obtain as much surface area as possible for the threads of the outer perimeter.

A portion of the extension portion 236 is shown cut-away to illustrate the second aperture 244. Each of the first and second apertures 240 and 244 further comprise a tapped or threaded perimeter, which threads correspond to the outer threads 82 of the horizontal adjustment component 80. In essence, the extension portion 236 with its tapped apertures 240 and 244 functions similar to the collar 90 discussed above in relation to FIGS. 1–12. Namely, the horizontal adjustment component 80 and the gate bracket 230 are capable of selectively and controllably bi-directionally displacing with respect to one another as a result of rotating the horizontal adjustment component 80 in a clockwise or counterclockwise direction, thus effectuating horizontal adjustment of the gate bracket 230 with respect to the post bracket 220, and therefore the gate (not shown) with respect to the post (also not shown) as discussed above. First and second sidewalls 237 and 239 are supported by a bridge 248, although this bridge 248 may be optional if the gate bracket 230 is structurally sound otherwise, particularly as assembled with the horizontal adjustment component 80.

FIGS. 13 and 14 further illustrate the swivel joint 170 used to couple the vertical and horizontal adjustment components 50 and 80 together as comprising a tapered end portion 178. Tapered end portion 178 functions to enhance the swing clearance of the gate bracket 230 about the post bracket 220, and therefore the gate about the post, by providing additional travel before the swivel joint 170 contacts the post bracket 220.

FIG. 14 illustrates a top view of the adjustable hinge 10, wherein the extension portion 236 comprises, alternatively, a bridge 248 with a surface 250 having threads 252 formed therein, which threads 252 correspond to the threads 82 of the horizontal adjustment component 80, as well as the threaded apertures 240 and 244 of the first and second sidewalls 237 and 239, respectively. Threads 252 function to assist the adjustment of the gate bracket 230 by providing greater surface contact of the gate bracket 30 with the horizontal adjustment component 80. This is advantageous when the wall thickness of the extension portion 236 is thin, therefore only accommodating a limited thread count within each of the apertures 240 and 244 of the first and second sidewalls 237 and 239, respectively. The threads 252 further function to ensure that the threads within the apertures 240 and 244 are supported and are not stripped as a result of continuous operation and adjustment of the hinged assembly, namely the gate and the post. FIG. 14 further illustrates the common vertical plane in which lie both the vertical and horizontal adjustment components 50 and 80 as provided by the specific configuration of the post and gate brackets 220 and 230.

Figure 15:
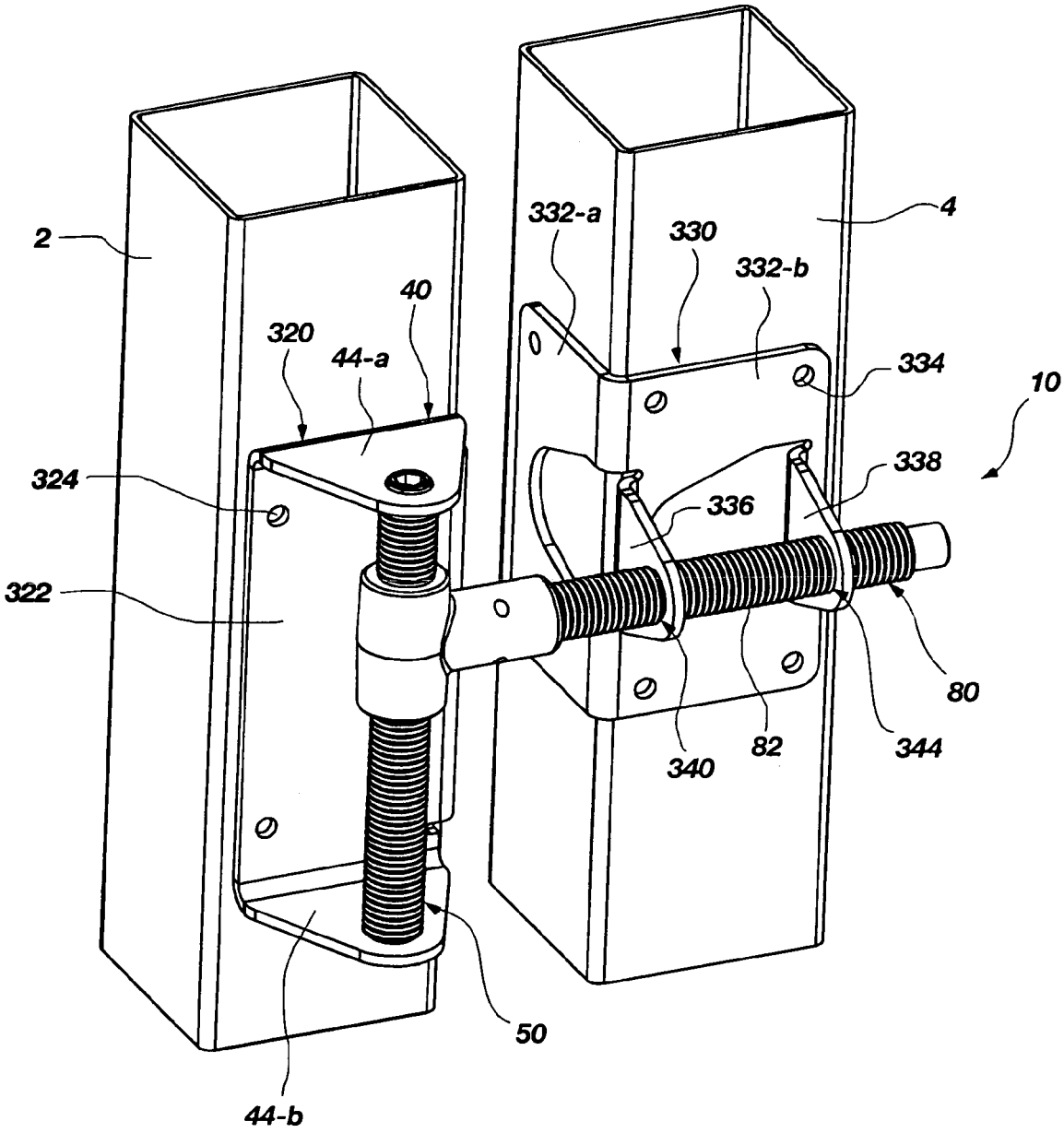
FIG. 15 illustrates a perspective view of another exemplary adjustable hinge having an alternative bracket configuration, wherein the post bracket and the gate bracket each comprise an alternative configuration.

FIG. 15 illustrates a perspective view of another exemplary adjustable hinge 10 having an alternative bracket configuration. In this embodiment, the post bracket 320 and the gate bracket 330 each comprise an alternative configuration. Specifically, post bracket 320 comprises a planar form with post mounting portion 322 configured to be mounted to a post 2 via mounting holes 324. Extending from the planar post mounting portion 322 is pivot bracket 340 having arm members 44-*a* and 44-*b* extending therefrom to support the vertical adjustment component 50, each similar to the pivot bracket 40 described above with respect to FIGS. 1–8. In this embodiment, pivot bracket 40 and post bracket 320 may be one integral piece, or the pivot bracket 40 may comprise a separate component that couples to the planar post mounting bracket 320.

The gate bracket 330 comprises a gate mounting portion 332-*a* formed perpendicular to a gate mounting portion 332-*b*, wherein each are mounted to the gate 4 via mounting holes 334. Extending from the gate mounting portion 332-*b* are first and second tabs 336 and 338 sized and configured to support the horizontal adjustment component 80 in a plane common with the vertical adjustment component 50, as supported by the post bracket 320. First and second tabs 336 and 338 each comprise an aperture formed therein, namely apertures 340 and 344, respectively, that comprise a threaded perimeter with threads that correspond to the threads 82 of the horizontal adjustment component 80. As such, first and second tabs 336 and 338 function in a similar manner as first and second sidewalls 237 and 239 of FIGS. 13 and 14, which description is incorporated herein. As can be seen, first and second tabs 336 and 338 comprise segments formed from each of the gate mounting portions 332-*a* and 332-*b*, respectively. Tab 336 is formed from the gate mounting portion 332-*a* and rotated approximately 180° to extend perpendicularly from the gate mounting portion 332-*b*. Likewise, tab 338 is formed from the gate mounting portion 332-*b*, and is rotated approximately 90° to also extend perpendicularly from the gate mounting portion 332-*b*. In another aspect, rather than being components formed from the gate mounting portions 332-*a* and 332-*b*, tabs 336 and 338 may be separate components that are welded, or otherwise fixed, directly to the gate mounting portion 332-*b*.

Figure 16:
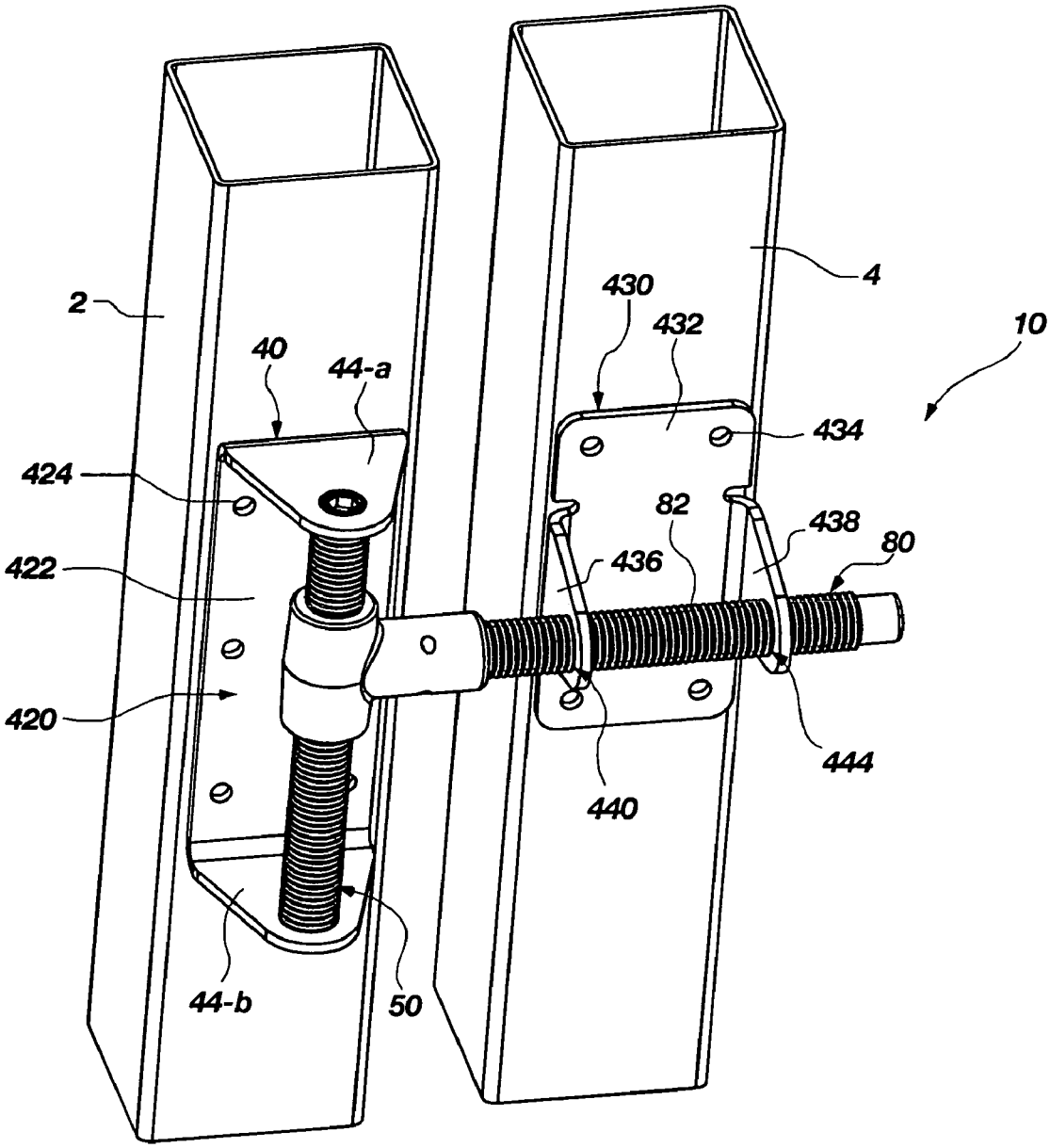
FIG. 16 illustrates a perspective view of yet another exemplary adjustable hinge having an alternative bracket configuration.

FIG. 16 illustrates a perspective view of yet another exemplary adjustable hinge 10 having an alternative bracket configuration. In this embodiment, the post bracket 420 supports the vertical adjustment component 50 via pivot bracket 40 having arms 44-*a* and 44-*b*. In addition, the post bracket 420 comprises post mounting portion 422 and mounting holes 424 that are each similar in form and function to the post bracket 320 of FIG. 15, which description is therefore incorporated herein. However, the gate bracket 430 comprises still another alternative configuration. Specifically, gate bracket 430 comprises a planar form with gate mounting portion 432 configured to be mounted to a gate 4 via mounting holes 434. Extending from the gate mounting portion 432 are first and second tabs 436 and 438 sized and configured to support the horizontal adjustment component 80 in a plane common with the vertical adjustment component 50, as supported by the post bracket 420. First and second tabs 436 and 438 each comprise an aperture formed therein, namely apertures 440 and 444, respectively, that comprise a threaded perimeter with threads that correspond to the threads 82 of the horizontal adjustment component 80. As such, first and second tabs 436 and 438 function in a similar manner as first and second sidewalls 237 and 239 of FIGS. 13 and 14, which description is incorporated herein. As can be seen, first and second tabs 436 and 438 are formed from the gate mounting portion 432. However, first and second tabs 436 and 438 may be separate components that are welded, or otherwise fixed, directly to the gate mounting portion 432.

Figure 17:
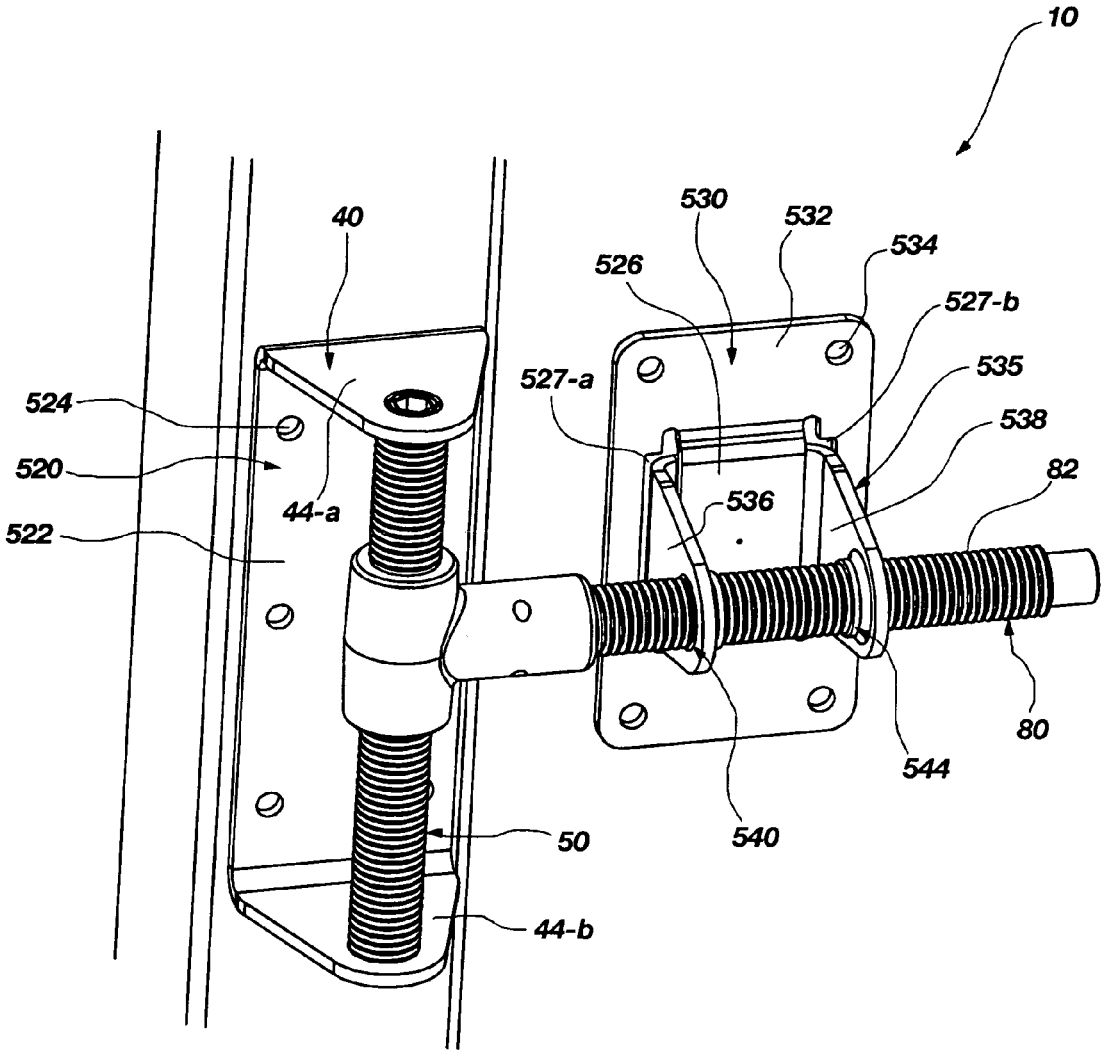
FIG. 17 illustrates a perspective view of still another exemplary adjustable hinge having an alternative bracket configuration.

FIG. 17 illustrates a perspective view of still another exemplary adjustable hinge 10 having an alternative bracket configuration. Similar to the embodiment illustrated in FIG. 16, in this embodiment, the post bracket 520 supports the vertical adjustment component 50 via pivot bracket 40 having arms 44-*a* and 44-*b*. In addition, the post bracket 520 comprises post mounting portion 522 and mounting holes 524 that are each similar in form and function to the post bracket 320 of FIG. 15, which description is therefore incorporated herein. However, the gate bracket 530 comprises still another alternative configuration. Specifically, gate bracket 530 comprises a substantially planar form with gate mounting portion 532 configured to be mounted to a gate 4 via mounting holes 534. Gate mounting portion 532 further comprises an extension portion 526 sized and configured to receive or engage with and support a u-shaped bracket 535 therein. Gate mounting portion 532 further comprises first and second slots 527-*a* and 527-*b* adjacent the extension portion 526 as shown. The u-shaped bracket comprises first and second tabs 536 and 538 extending therefrom, each with threaded apertures 540 and 544, similar to the tabs 336 and 338 of FIG. 15 described above, which description is incorporated herein. The gate bracket 530 is assembled by inserting first and second tabs 536 and 538 through the slots 527-*a* and 527-*b* from the rear of the gate mounting portion 532 so that the u-shaped bracket 535 engages and is supported by the extension portion 526, as shown. The u-shaped bracket 535 may be coupled to the extension portion 526 using any known means in the art, such as welding, bolts, screws, and others.

It is noted herein that the various exemplary bracket configurations just described in relation to FIGS. 13–17 are equally applicable to the exemplary adjustable hinge configuration set forth in FIGS. 1–7 above, and are therefore incorporated therein.

Figure 18:
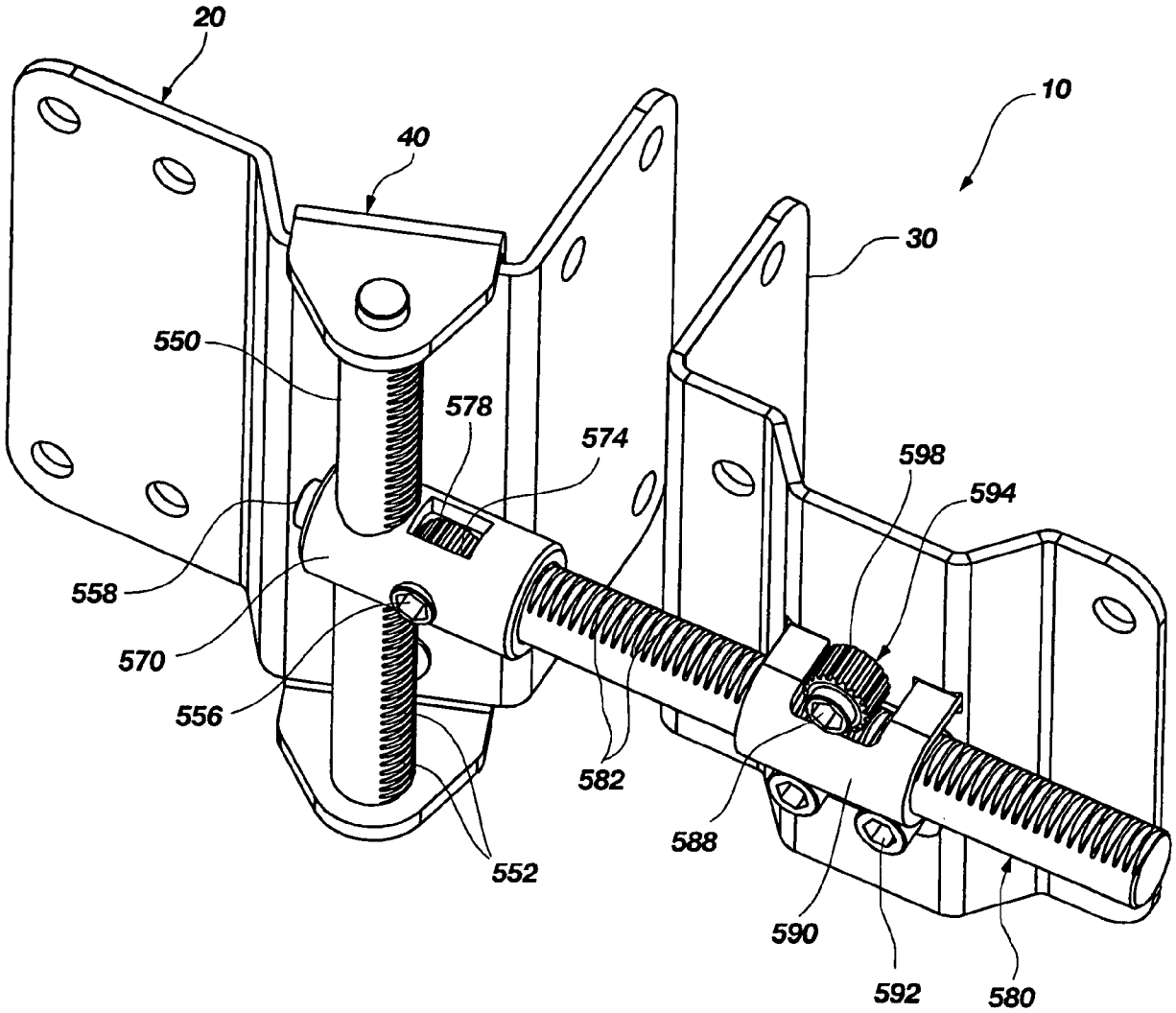
FIG. 18 illustrates a perspective view of an adjustable hinge assembly according to still another exemplary embodiment of the present invention.

Referring now to FIG. 18, illustrated is a perspective view of an adjustable hinge assembly according to still another exemplary embodiment of the present invention. In this embodiment, adjustable hinge 10 comprises a post bracket 20, a gate bracket 30, and a pivot bracket 40 similar to those discussed above, which descriptions are incorporated herein. Operably coupled to the pivot bracket 40 is a vertical adjustment component 550 in the form of a cylindrical rack having a plurality of grooves 552 formed therein. Disposed about the vertical adjustment component 550 is a swivel joint 570 having a pinion gear 574 rotatably supported therein by a driving component 56 configured to facilitate rotation of the pinion gear 574. The pinion gear 574 comprises a plurality of teeth 578 sized and configured to engage the grooves 552 formed on the vertical adjustment component 550. Rotation of the pinion gear 574 causes the swivel joint 570 to move with respect to the vertical adjustment component 550 to effectuate vertical adjustment of the gate bracket 30 with respect to the post bracket 20, and therefore the gate component with respect to the post component. A set screw 558 or other means for securing or locking the swivel joint 570 in a position is also provided. Therefore, once a desirable position or alignment is obtained, the set screw 558 may be caused to press against the shaft of the vertical adjustment component 550.

The adjustable hinge 10 further comprises a similar adjustment configuration for effectuating horizontal adjustment. As shown, the adjustable hinge 10 comprises a horizontal adjustment component 580 in the form of a cylindrical rack having a plurality of grooves 582 formed therein. The horizontal adjustment component 580 is supported on the gate bracket 30 by a rack clamp 590, which is coupled to the gate bracket 30 and functions in a similar manner as the clamping component 870 of FIG. 29. The horizontal adjustment component 580 is also supported in a fixed manner within the swivel joint 570. The rack clamp 590 may be selectively loosened to allow the horizontal adjustment component 580 to displace bi-directionally therein, or the rack clamp 590 may be selectively tightened to lock the horizontal adjustment component 580 in a desired alignment position. Rack clamp 590 is selectively loosed or tightened via clamping bolts 592.

The horizontal adjustment component 580 is adjusted by actuating the pinion gear 594 rotatably supported by the gate bracket 30. The pinion gear 594 is situated adjacent the horizontal adjustment component 580 and comprises a plurality of teeth 598 configured to engage with corresponding grooves 582 formed on the horizontal adjustment component 580. Rotation of the pinion gear 594 via the driving component 588 formed therein, functions to bi-directionally displace the horizontal adjustment component 580 and the gate bracket 30 with respect to one another, thus effectuating horizontal adjustment of the gate bracket 30 with respect to the post bracket 30, and therefore the gate (not shown) with the post (not shown), respectively. The horizontal adjustment component 580 may be fixed or otherwise coupled to the swivel joint 570 using any known technique or configuration described or suggested herein.

Figure 19:
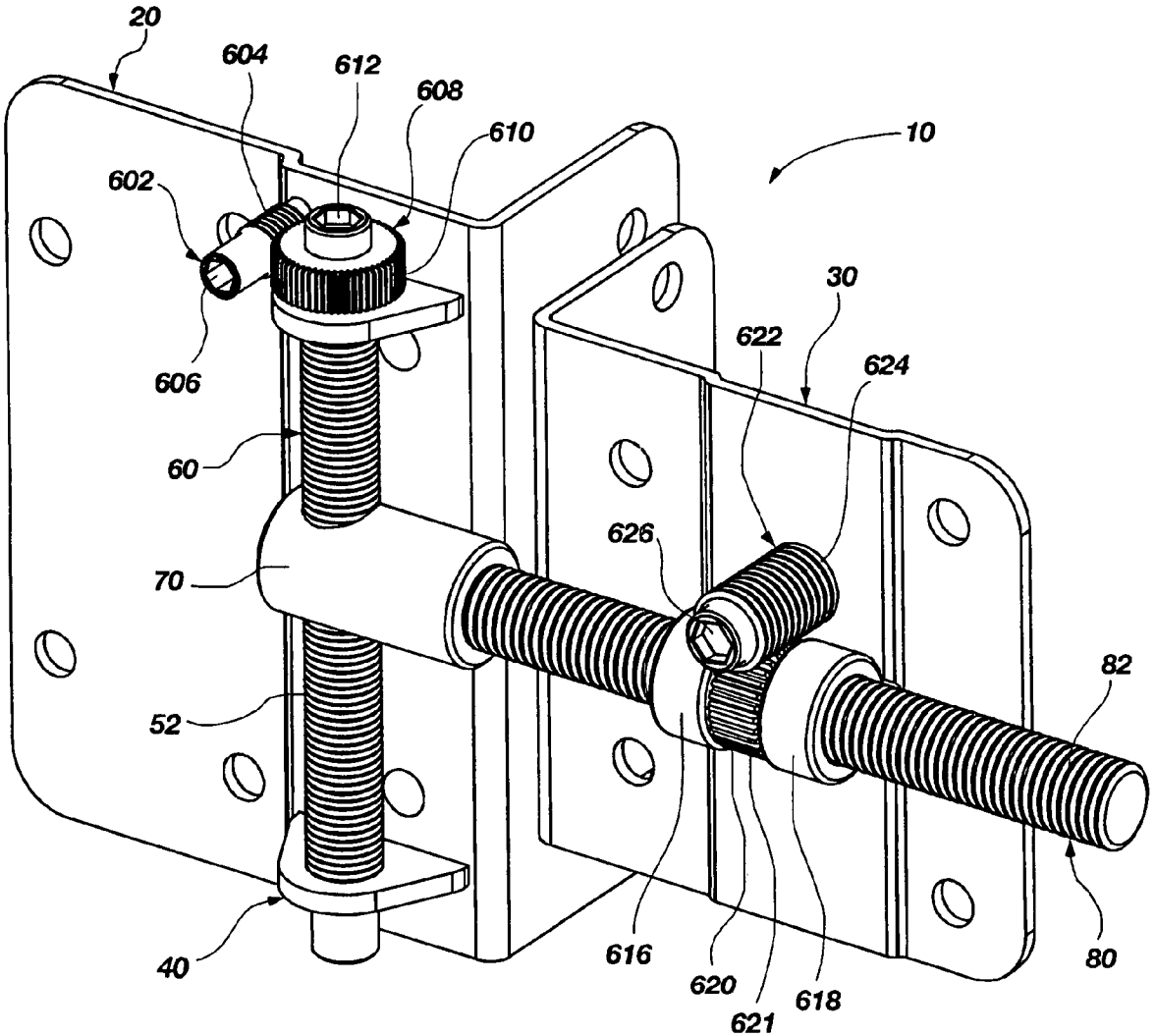
FIG. 19 illustrates a perspective view of an adjustable hinge assembly according to still another exemplary embodiment of the present invention.

Referring now to FIG. 19, illustrated is a perspective view of an adjustable hinge assembly according to still another exemplary embodiment of the present invention. In this embodiment, adjustable hinge 10 comprises a post bracket 20, a gate bracket 30, a pivot bracket 40, a swivel joint 70, and horizontal and vertical adjustment components 50 and 80, each similar to those discussed above, which descriptions are incorporated herein. However, in this embodiment, operably coupled to the pivot bracket 40 is a rotating or helical gear 608 having a plurality of teeth 610 formed therein that correspond to and mate with threads 604 of the worm 602. The worm 602 functions as a driving component having a hex recess 606 formed therein configured to receive a hex bit from a hand or power tool.

The helical gear 608 is further coupled to the vertical adjustment component 50. By rotating the worm 602, the corresponding helical gear 608 is rotated, which consequently causes the vertical adjustment component 50 to rotate, thus effectuating vertical adjustment within the adjustable hinge assembly 10.

Similarly, the gate bracket comprises a worm gear configuration. As shown, the horizontal adjustment component 80 has disposed about its threaded portion 82 first and second stationary collars 616 and 618, which are fixed to the gate bracket 30 so that they are not allowed to rotate. Disposed about the horizontal adjustment component 80 and situated between the stationary collars 616 and 618 is a helical gear 620. The helical gear 620 comprises threads 621 that correspond to and mate with the threads 624 of the worm gear 622 situated adjacent the helical gear 620. The helical gear 620 is rotatable about the horizontal adjustment component 80 and therefore comprises a threaded inner portion that corresponds to and mates with the threaded outer portion 82 of the horizontal adjustment component 80. The worm gear 622 further comprises a driving component 626 in the form of a hex-type recess configured to receive a driving tool. By driving and rotating the worm gear 622, the helical gear 620 is caused to rotate about the horizontal adjustment component 80, which causes the horizontal component to displace with respect to the gate bracket 30. Obviously, in this configuration, the horizontal adjustment component 80 is not configured to rotate, and does not rotate within the helical gear 620, nor the swivel joint 70.

It is noted that the worm gears 602 and 622 are oriented orthogonally to the post and gate brackets 20 and 30, respectively. As such, these brackets do not require a significant offset or extension member 26 and 36 as in some of the other embodiments described herein. The orthogonally oriented worm gears 602 and 622 allow easy access to the driving components contained thereon without interference from the post or gate brackets 20 or 30 or any of the hinged components coupled thereto.

Figure 20:
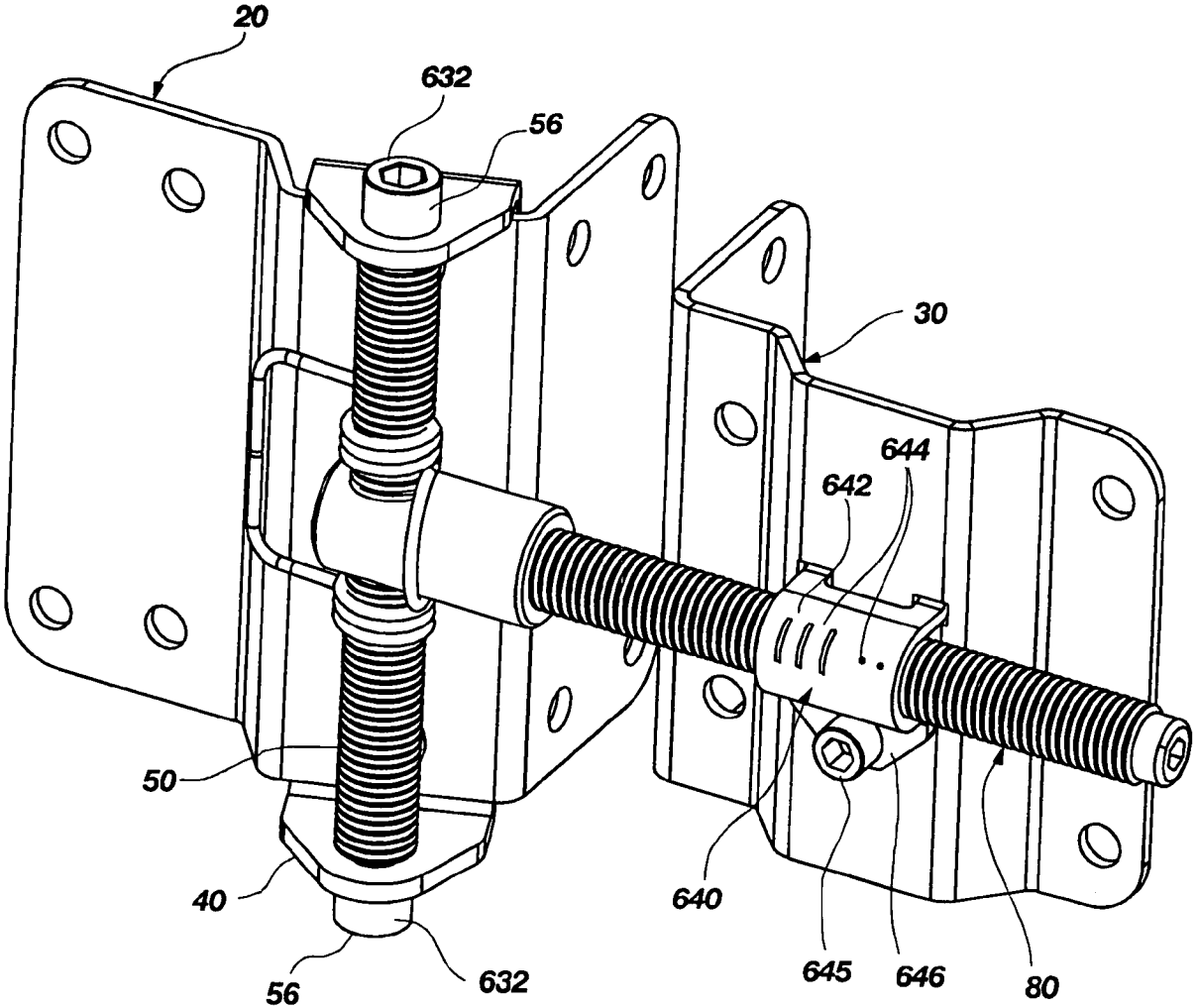
FIG. 20 illustrates a perspective view of an adjustable hinge assembly according to still another exemplary embodiment of the present invention.

Referring now to FIG. 20, illustrated is a perspective view of an adjustable hinge assembly according to still another exemplary embodiment of the present invention. In this embodiment, the post bracket assembly is similar to those discussed in relation to FIGS. 8–10, which description is incorporate herein. However, the vertical adjustment component 50 is shown comprising driving components 56 in each of its ends. Driving components 56 are shown as hex-type cap members 632, which are essentially shoulder or head-type members that are either screwed or pressed (e.g. as an interference fit) into a corresponding recess formed in the ends of the vertical adjustment component 50. These types of driving components 56 function to couple the vertical adjustment component 50 to the pivot bracket 40 as shown.

The gate bracket assembly comprises a gate bracket 30 having a clamping member 640 supporting the horizontal adjustment component 80. In this embodiment, the clamping component 640 comprises a barrel portion 642 having one or more guides 644 formed therein. Guides 644 are sized and configured to protrude from the interior surface of the clamping component 640 to engage the threads 82 of the horizontal adjusting component 80. As so engaged, the clamping component 640 and the horizontal adjusting component 80 displace with respect to one another upon driving or otherwise rotating the horizontal adjustment component 80. The clamping component 640 is fixed to the gate bracket 30 using any known means in the art. In addition, the clamping component 640 comprises a flange portion 646 configured to be selectively tightened or loosened to actuate the clamping component 640 to lock and unlock the horizontal adjusting component 80. Upon tightening the fastener 645, the clamping component 640 clamps down upon the horizontal adjusting component 80, thus locking it in a desired position. Likewise, to again adjust the horizontal adjustment component 80, the fastener 645 is loosed, whereupon the horizontal adjustment component 80 may again be rotated to effectuate horizontal adjustment within the hinge assembly 10.

Alternative Adjustable Hinge Assembly

The present invention further features other adjustable hinge assembly embodiments having a somewhat different general configuration than the hinge assembly embodiments set forth above and illustrated in FIGS. 1–20. However, it is noted herein, that some of the features and functions of the hinge assemblies discussed above may be applicable to some or all of the embodiments discussed herein, and therefore, such features and/or functions may be incorporated herein, where applicable.

Figure 21:
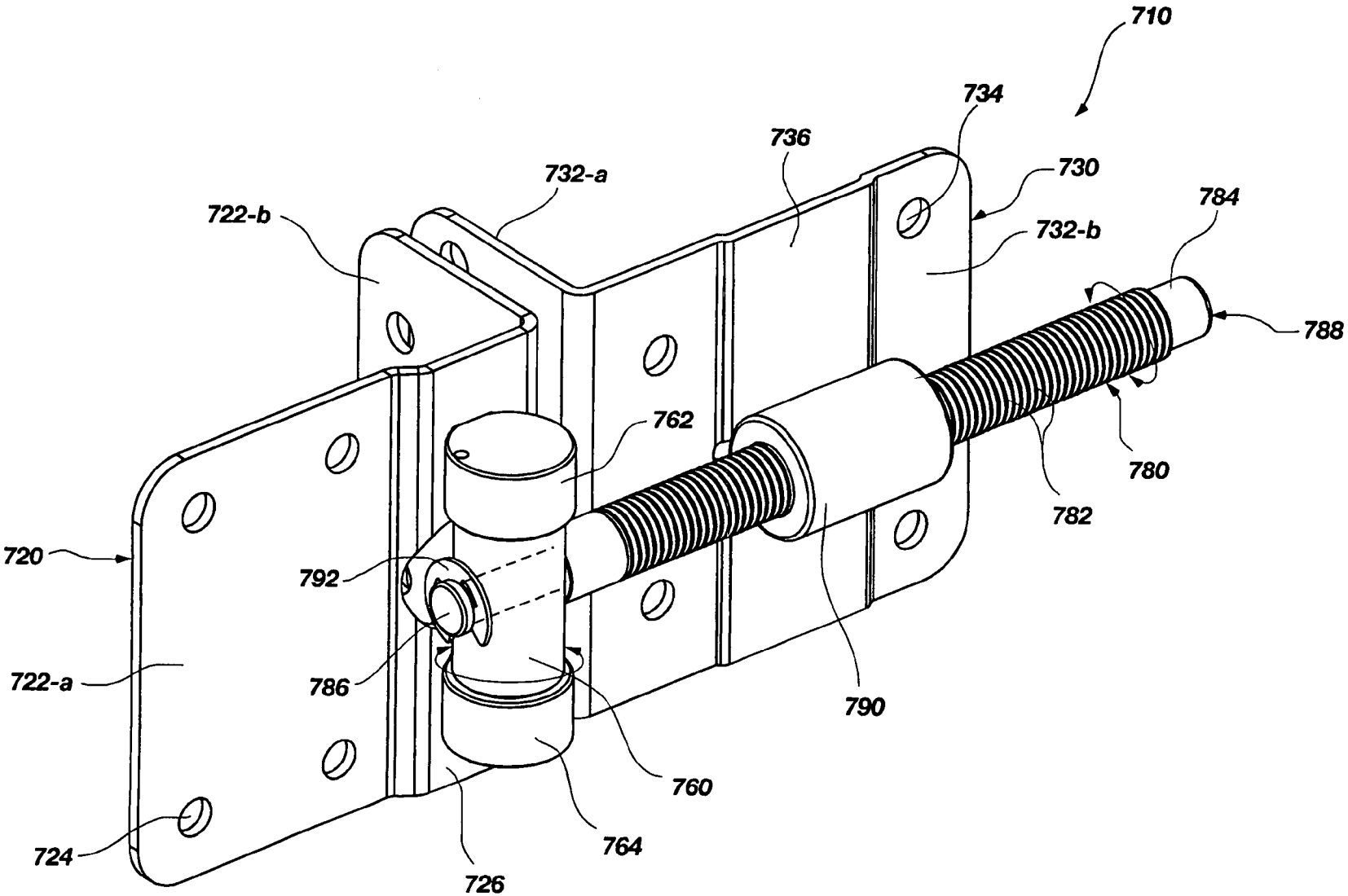
FIG. 21 illustrates is a perspective view of an adjustable hinge according to another exemplary embodiment of the present invention.

Referring now to FIG. 21, illustrated is a perspective view of an adjustable hinge 710 according to one exemplary embodiment of the present invention. Specifically, FIG. 21 illustrates adjustable hinge 710 as comprising a post bracket 720 made up of post mounting portions 722-*a* and 722-*b* that are orthogonal to one another and configured to engage respective orthogonal sides of a post (not shown) to secure the post bracket 720 to the post. The adjustable hinge 710 further comprises a gate bracket 730 made up of gate mounting portions 732-*a* and 732-*b* that are also orthogonal to one another and configured to engage respective orthogonal sides of a gate (not shown) to secure the gate bracket 730 to the gate. The post bracket 720 is configured to support thereon a vertical hinge barrel 760 configured to pivot within hinge pins 762 and 764 and to facilitate the pivoting of the gate bracket 730 (and therefore the hinged gate component) about the post bracket 720 (and therefore the hinged post component). The hinge pins 762 and 764 are secured to the post mounting portion 722-*b* as shown, which may further comprise an extension portion 726 for offsetting the hinge barrel 760 from the post mounting portion 722-*a* and the post (not shown) a greater distance, for adding stiffness and strength to the post bracket 720, and for providing clearance for the horizontal adjustment component 780 and any means for coupling. The gate bracket 730 is configured to support thereon a horizontal adjustment component 80 configured to provide horizontal adjustment of the post bracket 720 with respect to the gate bracket 730, and therefore the coupled post and gate hinged components, respectively. The horizontal adjustment component 780 is supported within a collar 790 fixed to the gate bracket 730, and particularly to an extension portion 736 formed in the gate bracket 730. The collar 790 comprises a threaded bore that corresponds to the threads 782 of the horizontal adjustment component 780. Therefore, any bi-rotational adjustment or manipulation of the horizontal adjustment component 780 will cause the collar 790 and the horizontal adjustment component 780 to displace with respect to one another. In effect, rotation of the horizontal adjustment component 780 in any direction will accordingly displace the gate coupled to the gate bracket 730 with respect to the post coupled to the post bracket 720.

The hinge barrel 760 further comprises a lateral bore formed therein for receiving and facilitating the coupling and operation of the horizontal adjustment component 780. The horizontal adjustment component 780 comprises a first end 784 and a second end 786. The first end 784 comprises a driving component 788 configured to facilitate the bi-rotation of the horizontal adjustment component 780 for adjustment purposes. The driving component 788 may be integrally formed within the end 784 of the horizontal adjustment component 780, or it may be a separate member attached thereto. The first end 784 may also comprise a reduced diameter segment to allow the horizontal adjustment component 780 to pass all the way through the collar 790.

The second end 786 is sized and configured to operably couple to the hinge barrel 760. As shown, the second end 786 is passed all the way through the lateral bore of the hinge barrel 760, and secured in place by means for coupling in the form of a snap ring 792 seated in an annular groove (not shown) formed within the end 786 of the horizontal adjustment component 780. Means for coupling allows the horizontal adjustment component 780 to rotate within the lateral bore of the hinge barrel 760. Other means for coupling the horizontal adjustment component 780 to the hinge barrel 760 are contemplated herein, many of which are discussed above.

Figure 22:
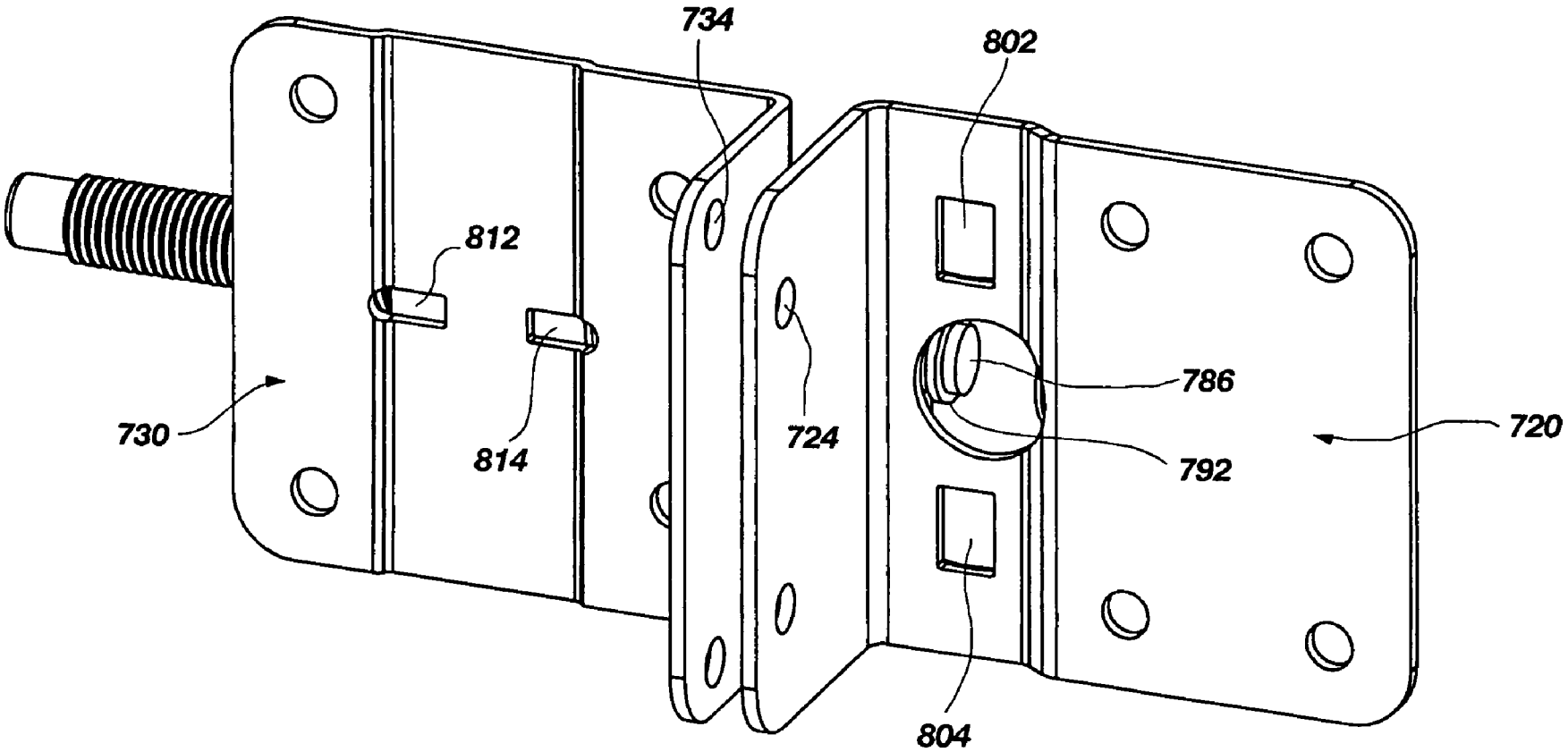
FIG. 22 illustrates a rear perspective view of the exemplary adjustable hinge assembly of FIG. 21.

FIG. 22 illustrates a rear perspective view of the exemplary adjustable hinge assembly 710 of FIG. 21. As shown, the post bracket 720 comprises open apertures 802 and 804 sized and configured to receive and secure at least a portion of the hinge pins 762 and 764 of the hinge barrel 760 shown in FIG. 21. Similarly, the gate bracket 730 comprises open apertures sized and configured to receive and secure the collar 790 shown in FIG. 22. These open apertures may function to locate the respective hinge barrel and collar components, and may comprise various sizes, or may comprise different counts, as will be recognized by one skilled in the art. Moreover, these apertures may be optional, as the hinge barrel and collar components may be secured to the outer surfaces of their respective brackets. The post bracket 720 may further comprise a clearance hole 820 sized and configured to receive therein the end portion 786 of the horizontal adjustment component 780, as well as any means for coupling, such as the snap ring 792, coupled thereto during pivoting of the gate bracket 730 about the post bracket 720 under normal operating conditions of the hinged post and gate components.

FIG. 22 further illustrates mounting holes 724 and 734 formed in the post bracket 720, which mounting holes 724 and 734 are offset from one another so as to not interfere or come in contact with one another once the post and gate brackets 720 and 730 are installed. The particular position of the mounting holes 724 and 734 may vary with particular bracket configuration or otherwise, as needed.

Figure 23:
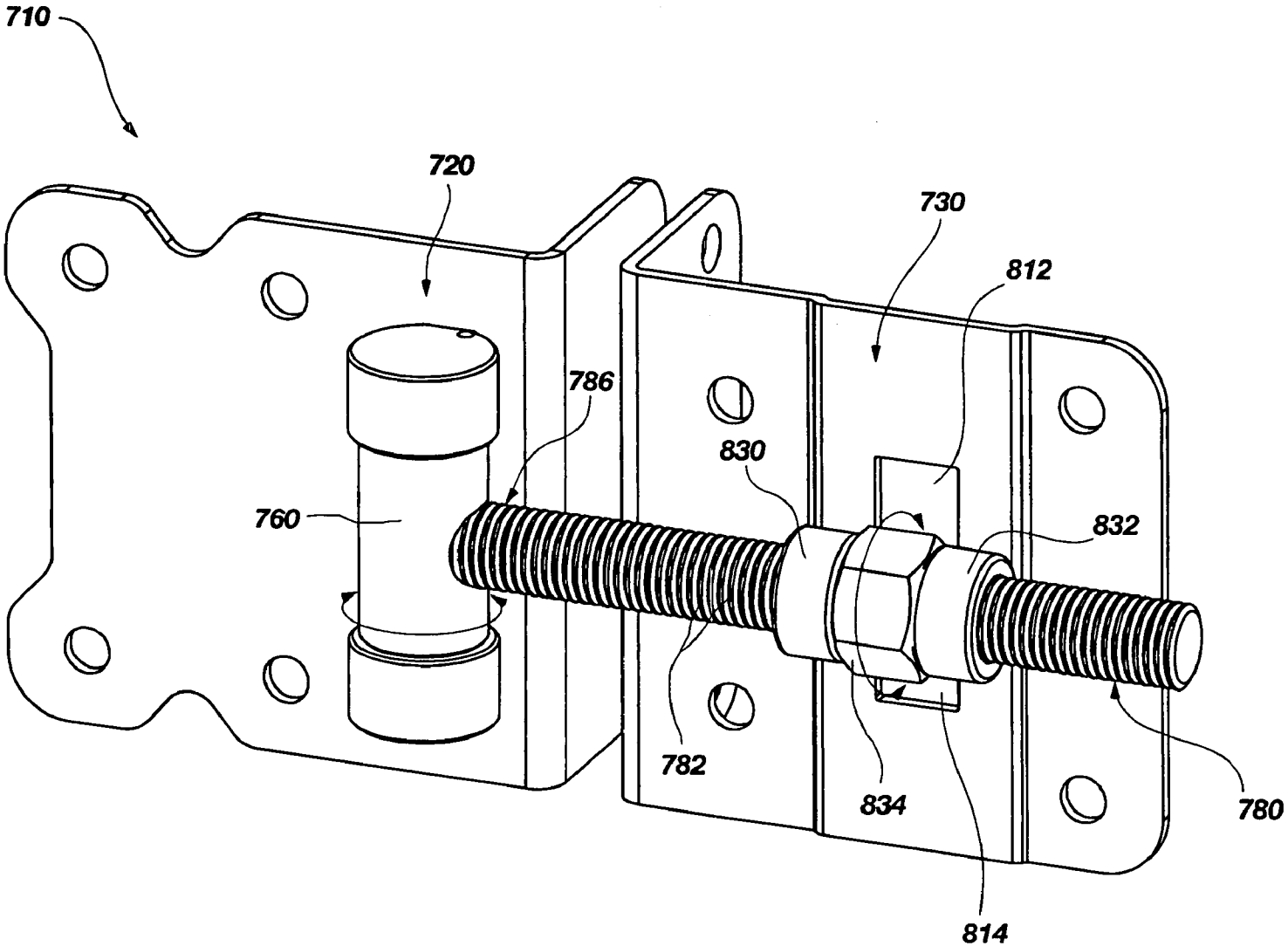
FIG. 23 illustrates a perspective view of an adjustable hinge assembly according to still another exemplary embodiment of the present invention.

FIG. 23 illustrates a perspective view of an adjustable hinge assembly according to still another exemplary embodiment of the present invention. Specifically, FIG. 23 illustrates adjustable hinge 710 as comprising a similar configuration as set forth above in FIGS. 21 and 22, which description is incorporated herein. However, rather than utilizing a single fixed or stationary collar and a horizontal adjustment component 780 that rotates therein to effectuate adjustment of the adjustable hinge, the adjustable hinge 710 in this embodiment comprises dual stationary collars 830 and 832 mounted or otherwise fixed to the gate bracket 730 a distance apart from one another so as to provide a space therebetween. Stationary collars 830 and 832 comprise bores formed therethrough for receiving the horizontal adjustment component 780 therein. These bores preferably comprise smooth surfaces as the collars 830 and 832 are not intended to rotate. Disposed within the space provided between the stationary collars 830 and 832 is a spinning or rotating collar 834 comprising an inner bore configured to receive the horizontal adjustment component 780 therein. The inner bore comprises threads (not shown) that correspond to the threads 782 of the horizontal adjustment component 780. The spinning collar 834 may comprise any configuration, but is preferably a hex-type structure to accommodate a wrench for easy and assisted rotation.

Furthermore, the horizontal adjustment component 780 comprises an end 786 that is fixed to the hinge barrel 760 so as to prevent the horizontal adjustment component 780 from rotating. As such, horizontal adjustment is effectuated by rotating the spinning collar 834 in either direction to move the gate bracket 730, and therefore the gate (not shown) with respect to the post bracket, and therefore the post (not shown). The function of the stationary collars 830 and 832 is to retain the spinning collar 834 and to displace the horizontal adjustment component 780 as is known in the art. The gate bracket 730 may further comprise open apertures 812 and 814 formed therein at a location proximate the spinning collar 834, which open apertures 812 and 814 function to provide clearance for a tool suitable for manipulating or rotating the spinning collar 834, such as an open-end wrench.

The end 786 of the horizontal adjustment component 780 may be fixed to the hinge barrel 760 using any means known in the art, such as welding, a press or interference fit, soldering, bolts, etc. The stationary collars 830 and 832 may be mounted or otherwise fixed to the gate bracket using similar means.

Figure 24:
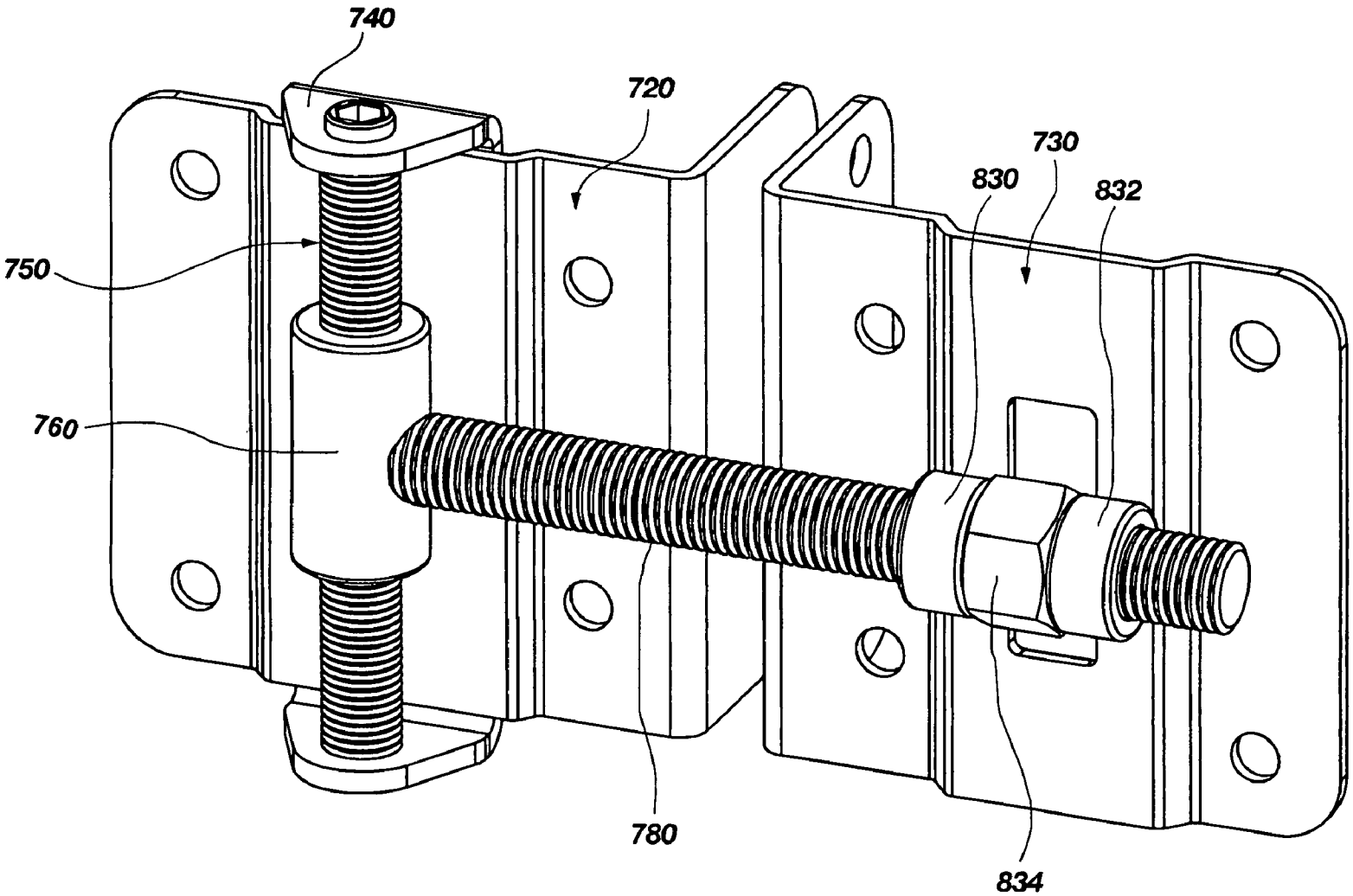
FIG. 24 illustrates a perspective view of an adjustable hinge assembly according to still another exemplary embodiment of the present invention.

FIG. 24 illustrates a perspective view of an adjustable hinge assembly according to still another exemplary embodiment of the present invention. Specifically, FIG. 24 illustrates adjustable hinge 710 as comprising a similar configuration as set forth above in FIG. 23, which description is incorporated herein. However, in this embodiment the adjustable hinge 710 further comprises a vertical adjustment component 50 that operates to provide vertical adjustment of the gate bracket 730, and therefore the gate (not shown) with respect to the post bracket 720, and therefore the post (not shown). The vertical adjustment component is supported by a pivot bracket 740, and is operably retained within a hinge barrel 760 as discussed in detail above. Similar to the embodiment illustrated in FIG. 23, the horizontal adjustment component 780 is fixed so that it cannot rotate. The horizontal adjustment component 780 is fixed or otherwise mounted to the hinge barrel 760 using any known coupling means, such as welding. Therefore, horizontal adjustment is achieved by rotating the spinning collar 834 disposed and retained between stationary collars 830 and 832 as discussed above.

Figure 25:
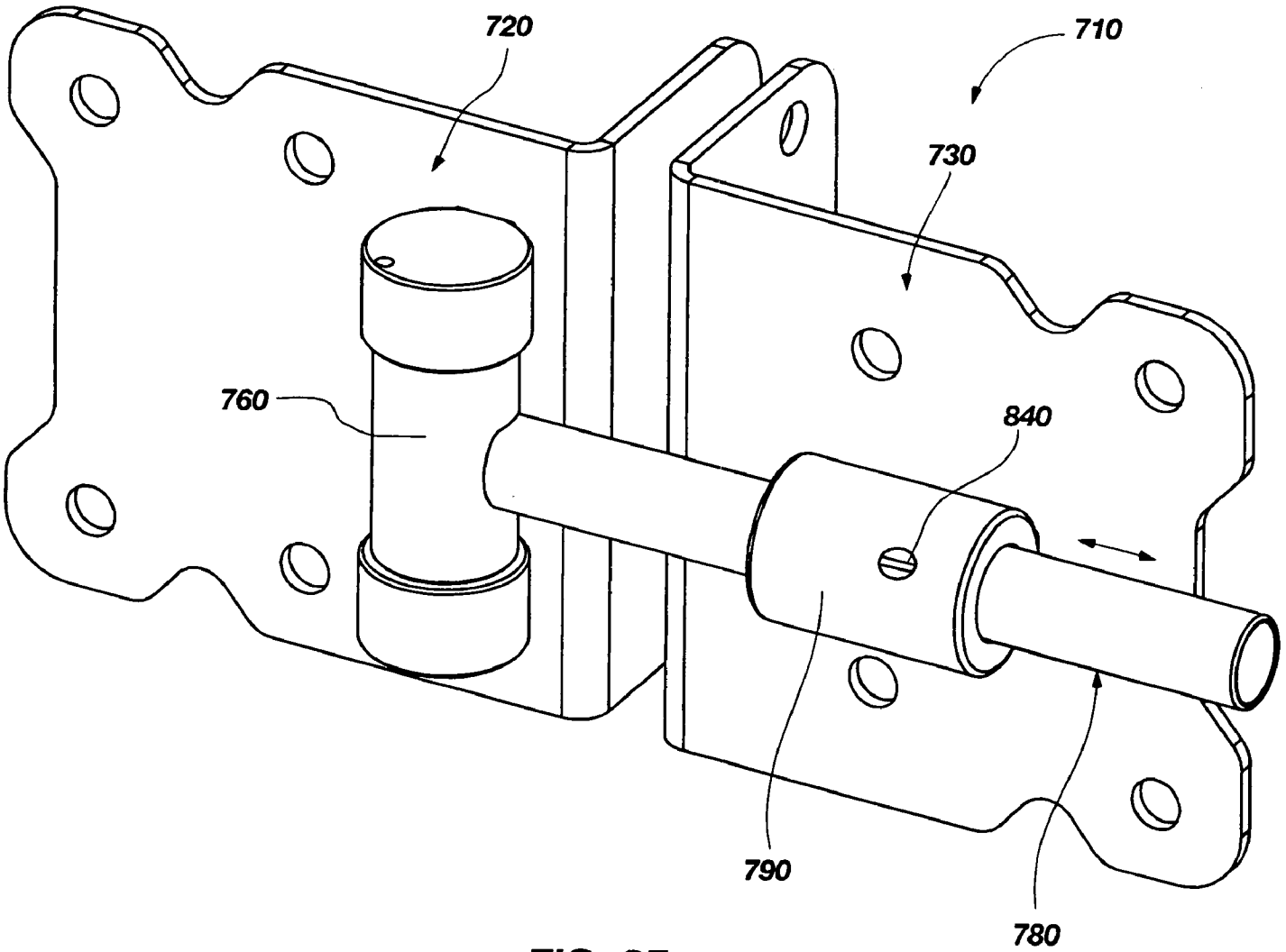
FIG. 25 illustrates a perspective view of an adjustable hinge assembly according to still another exemplary embodiment of the present invention.

FIG. 25 illustrates a perspective view of an adjustable hinge assembly according to still another exemplary embodiment of the present invention. Specifically, FIG. 25 illustrates adjustable hinge 710 as comprising a sliding solid or tube-like horizontal adjustment component 780 having a smooth surface and that is supported within a collar 790 having an inner bore also with a smooth surface, wherein the collar is fixed or otherwise mounted to the gate bracket 730 and configured to receive the horizontal adjustment component 780. The horizontal adjustment component 780 comprises a second end 786 that is fixed or otherwise mounted to a hinge barrel 760 supported on a post bracket 720, as shown, such that the horizontal adjustment component 780 is not prevented from rotating. In this embodiment, the horizontal adjustment component 780 is configured to bi-directionally slide within the collar 790 to effectuate horizontal adjustment within the adjustable hinge assembly 710.

The collar 790 further comprises means for locking or securing the horizontal adjustment component 780 in place therein. Means for securing may comprise any type known in the art. In one exemplary embodiment, means for securing comprises a set screw configuration, wherein one or more set screws 840 is disposed within the collar 790 and configured to press against the surface of the horizontal adjustment component 780 when the proper position has been achieved. The set screws may be oriented orthogonally with the horizontal adjustment component 780, or they may be oriented tangential thereto, with a slight interference fit to achieve a wedging effect. The form and function of a set screw is well established and therefore, not detailed herein.

Figure 26:
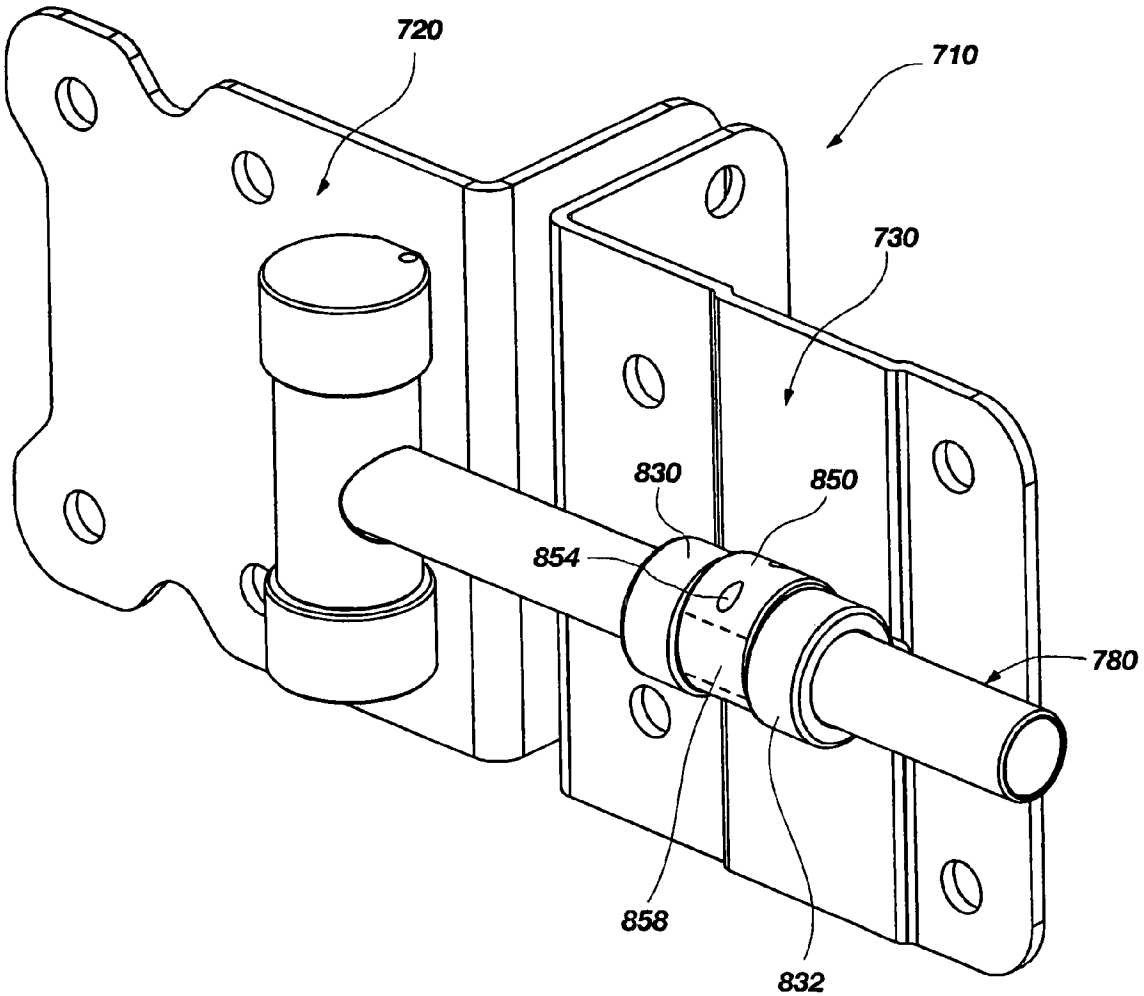
FIG. 26 illustrates a perspective view of an adjustable hinge assembly according to still another exemplary embodiment of the present invention.

FIG. 26 illustrates a perspective view of an adjustable hinge assembly according to still another exemplary embodiment of the present invention. Specifically, FIG. 26 illustrates adjustable hinge 710 as comprising a sliding solid or tube-like horizontal adjustment component 780 having a smooth or threaded surface and that functions similar to the one embodied in FIG. 25 and described above. However, in this embodiment, the adjustable hinge 710 further comprises a cam component 850 disposed between stationary collars 830 and 832 fixed or otherwise mounted to the gate bracket 730. The cam component 850 is configured to lock or secure the horizontal adjustment component 780 in a desired position. Upon sliding the horizontal adjustment component 780 through the stationary collars 830 and 832, as well as the cam 850, and attaining a desired horizontally adjusted position, the cam can be rotated a pre-determined distance, which causes the cam 850 to push against the gate bracket 730, thus forcing the horizontal adjustment component 780 against the inside walls of the stationary collars 830 and 832, and thus locking or securing the horizontal adjustment component 780 in place. The cam 850 is rotated in the opposite direction to once again free the horizontal adjustment component 780 where it may be slide to another position. As indicated, the horizontal adjustment component 780 may comprise a smooth or threaded surface.

To actuate the cam, the cam 850 may comprise adjustment holes 854 configured to receive one or more tools specifically designed to adjust and operate the cam 850. Alternatively, the cam may comprise one or more flattened portions 858 configured to receive an open-end wrench, wherein one of the flattened portions 858 is indicated by the dotted lines.

Figure 27:
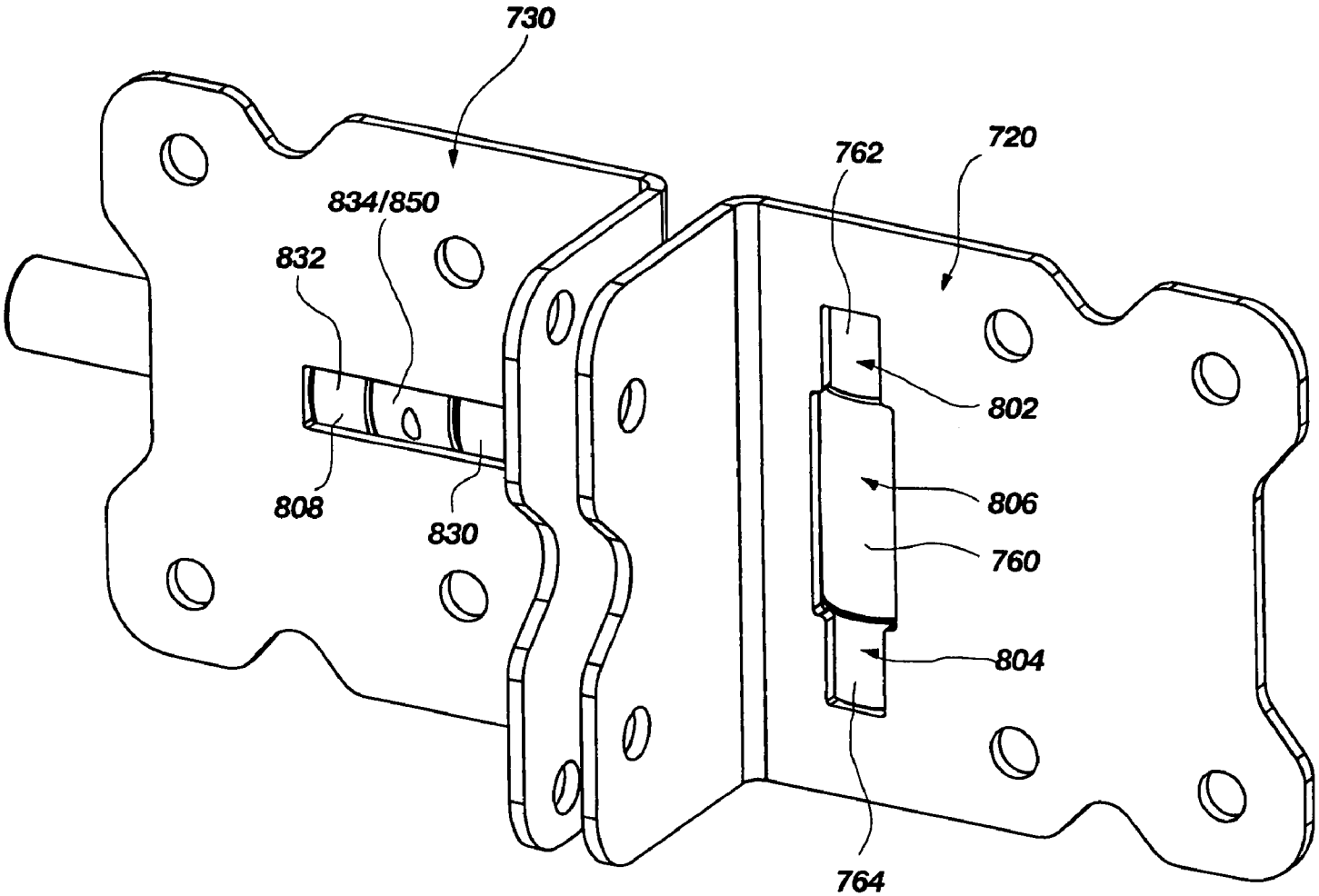
FIG. 27 illustrates a rear perspective view of the exemplary adjustable hinge assembly of FIG. 26.

FIG. 27 illustrates a rear perspective view of an exemplary adjustable hinge assembly 710, wherein the post and gate brackets 720 and 730, respectively, comprise open apertures for accommodating the operating components of the adjustable hinge 710. Specifically, post bracket 720 comprises open apertures 802 and 804 configured to receive hinge pins 762 and 764 therein. Post bracket 720 further comprises open aperture 806 for receiving hinge barrel 760 therein. Each of these open apertures 802, 804, and 806 function to allow the same diameter hinge barrel and hinge pins to be used, if applicable, while also providing clearance for the pivoting hinge barrel 760.

Similarly, the gate bracket 730 comprises an open aperture 808 configured to receive the stationary collars 830 and 832, as well as the spinning collar 834 or cam 850. The hinge pins, stationary collars, and any other non-rotating hinge components may be secured within their respective open apertures by any known means, such as welding, etc.

Figure 28:
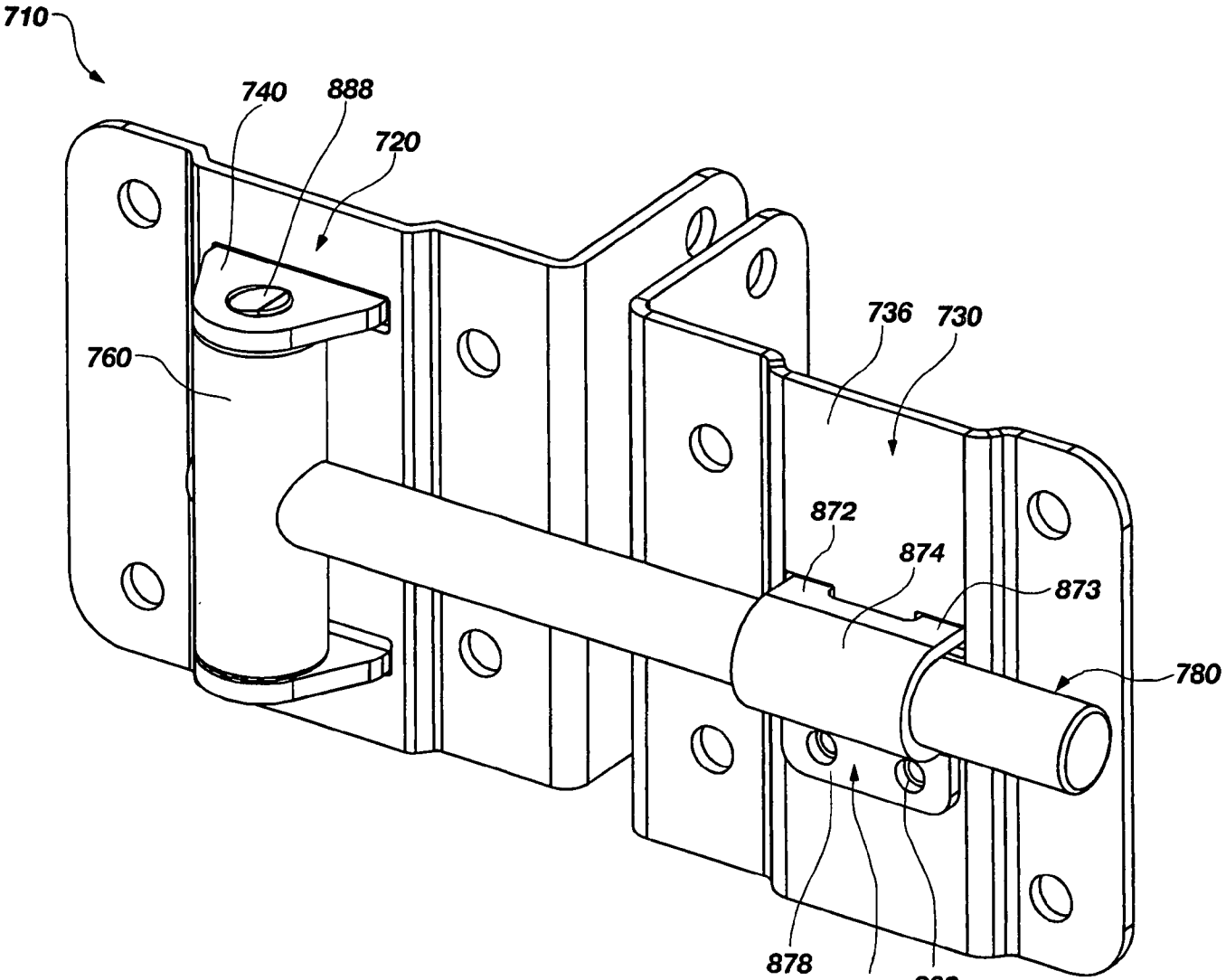
FIG. 28 illustrates a perspective view of an adjustable hinge assembly according to still another exemplary embodiment of the present invention.

FIG. 28 illustrates a perspective view of an adjustable hinge assembly according to still another exemplary embodiment of the present invention. Specifically, FIG. 28 illustrates adjustable hinge 710 as comprising an alternative means for locking or securing a slidable horizontal adjustment component 780 in place in the form of a clamping component 870. The clamping component is secured to the gate bracket 730 using any known means, such as by one or more tabs 872 and 873 that are inserted through receiving apertures formed in the gate bracket 730, as shown, and are supported above the surface of the gate (not shown) to which the gate bracket 730 is mounted by an extension portion 736. The clamping component comprises a barrel 874 sized and configured to slidably receive therein the horizontal adjustment component 780. Extension member 878, preferably integrally formed with barrel 874, provides the ability to force the barrel 874 against the surface of the horizontal adjustment component 780, thereby securing or locking the horizontal adjustment component 780 in a desired position. Extension member 878 comprises apertures 882 configured to receive a fastener therein that may be selectively tightened and loosened to effectuate the clamping of the horizontal adjustment component 780, and therefore the horizontal adjustment thereof.

FIG. 28 further illustrates the use of a pivot bracket 740 separate from but supported by the post bracket 720. Use of a separate pivot bracket provides improved geometries within the adjustable hinge 710, use of dissimilar materials, if desirable, and the ability to select from different aesthetic options. The separate pivot bracket 740 may be formed of one continuous part, or it may be comprised of separate components (namely separate arm components) that operate together to secure the hinge barrel 760 in place. The particular hinge barrel 760 illustrated and featured herein comprises a solid hinge barrel that includes a sloped section 888 for easy snap-in and snap-out interchangeability with the pivot bracket 740.

Figure 29:
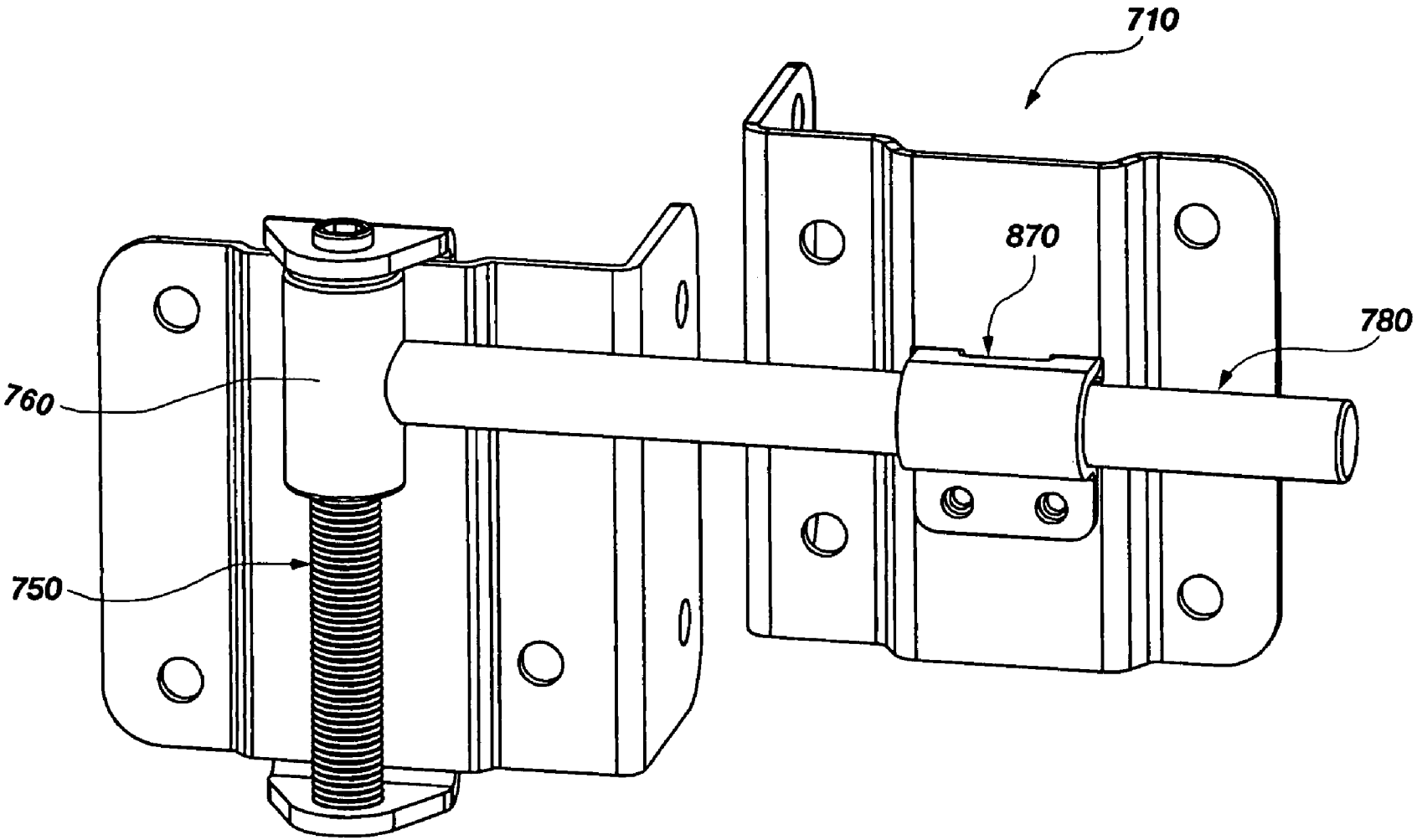
FIG. 29 illustrates a perspective view of an adjustable hinge assembly according to still another exemplary embodiment of the present invention.

FIG. 29 illustrates a perspective view of an adjustable hinge assembly according to still another exemplary embodiment of the present invention. Specifically, FIG. 29 illustrates adjustable hinge 710 as comprising the clamping component 870 of FIG. 28 as used in combination with the vertical adjustment component 750 and hinge barrel 760 of FIG. 24, each of which corresponding descriptions is incorporated herein. As so configured, the adjustable hinge 710 provides for both selective vertical and horizontal adjustment by adjusting any one or both of the vertical and horizontal adjustment components 750 and 780.

Figure 30:
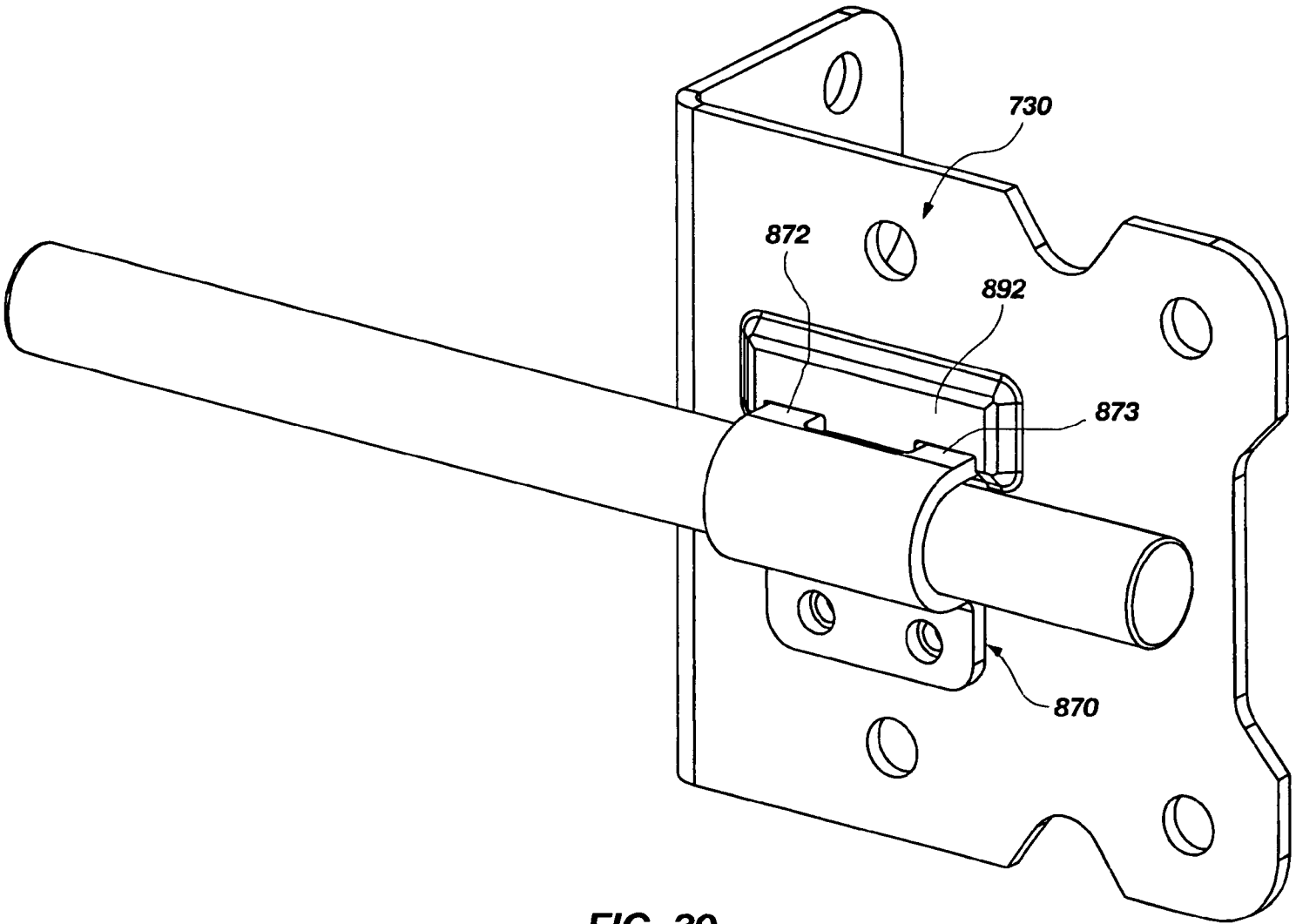
FIG. 30 illustrates a partial perspective view of an adjustable hinge assembly according to still another exemplary embodiment of the present invention.

FIG. 30 illustrates a partial perspective view of an adjustable hinge assembly according to still another exemplary embodiment of the present invention. Specifically, FIG. 30 illustrates adjustable hinge 710 as comprising an alternative embodiment to the clamping component 870 of FIG. 28. In this embodiment, the gate bracket 730 comprises an small extension portion 892 having apertures therein for receiving the tabs 872 and 873 of the clamping component 870. Providing the small extension portion 892 functions to eliminate the need to raise an entire section of the gate bracket 730 so that the tabs 872 and 873 clear the surface of the gate onto which the gate bracket 730 is mounted. The clamping component 870 functions as otherwise indicated in FIG. 29, which description is incorporated herein.

Figure 31:
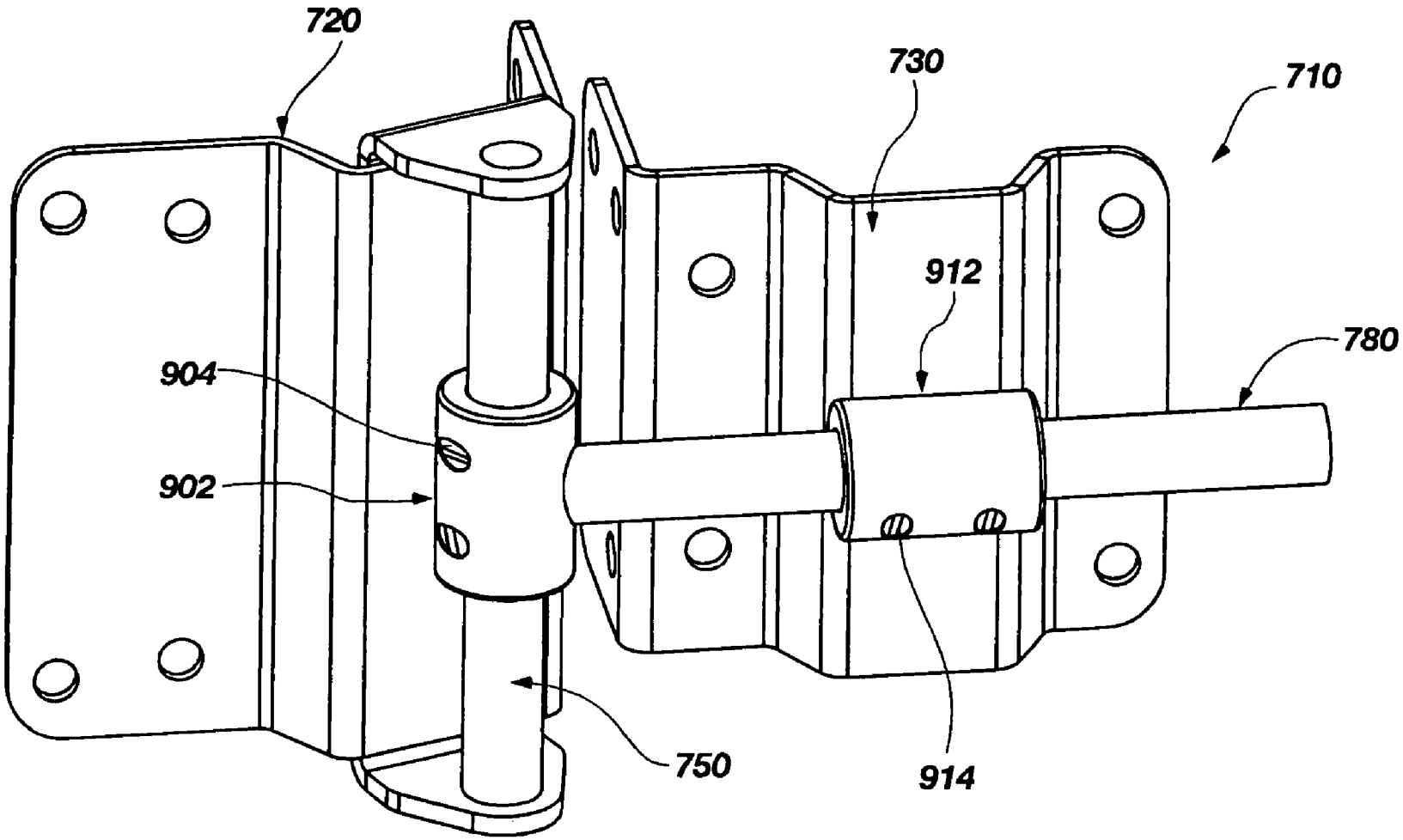
FIG. 31 illustrates a perspective view of an adjustable hinge assembly according to still another exemplary embodiment of the present invention.

FIG. 31 illustrates a perspective view of an adjustable hinge assembly according to still another exemplary embodiment of the present invention. Specifically, FIG. 31 illustrates adjustable hinge 710 as comprising a dual sliding configuration as applied to both the vertical and horizontal adjustment components 750 and 780. As shown, vertical adjustment component 750 comprises a slidable collar 902 disposed about its outer surface, wherein the slidable collar 902 is configured and functions to facilitate vertical adjustment to the adjustable hinge 710. Likewise, the horizontal adjustment component 780 comprises a slidable collar 912 disposed about its outer surface, wherein the slidable collar 912 is configured and functions to facilitate horizontal adjustment of the adjustable hinge 710. Each of the slidable collars 902 and 912 further comprise means for locking or securing the collars 902 and 912 in a desired position about the respective horizontal and vertical components 750 and 780. Means for locking or securing comprises any known in the art, such as a set screw configuration 904 and 914 similar to the one described above. The horizontal adjustment component 780 is coupled to the collar 902 using any known coupling means described or suggested herein, and/or known in the art. In operation, to vertically adjust the adjustable hinge 710, the set screw configuration 904 is loosened and the collar 902 adjusted directionally up or down along the vertical adjustment component 750. Directional adjustment of the collar 902 causes vertical adjustment of the horizontal adjustment component 780 and the gate bracket 730 coupled thereto about the post bracket 720, and therefore the gate (not shown) coupled to the gate bracket 730 about the post (also not shown). Likewise, vertical adjustment is achieved by loosening the set screw configuration 914 of the collar 912 and directionally adjusting the collar 912 horizontally back and forth along the horizontal adjustment component 780. This causes the gate bracket 730 to also directionally displace in a horizontal manner, and therefore the gate attached thereto with respect to the post.

Figure 32:
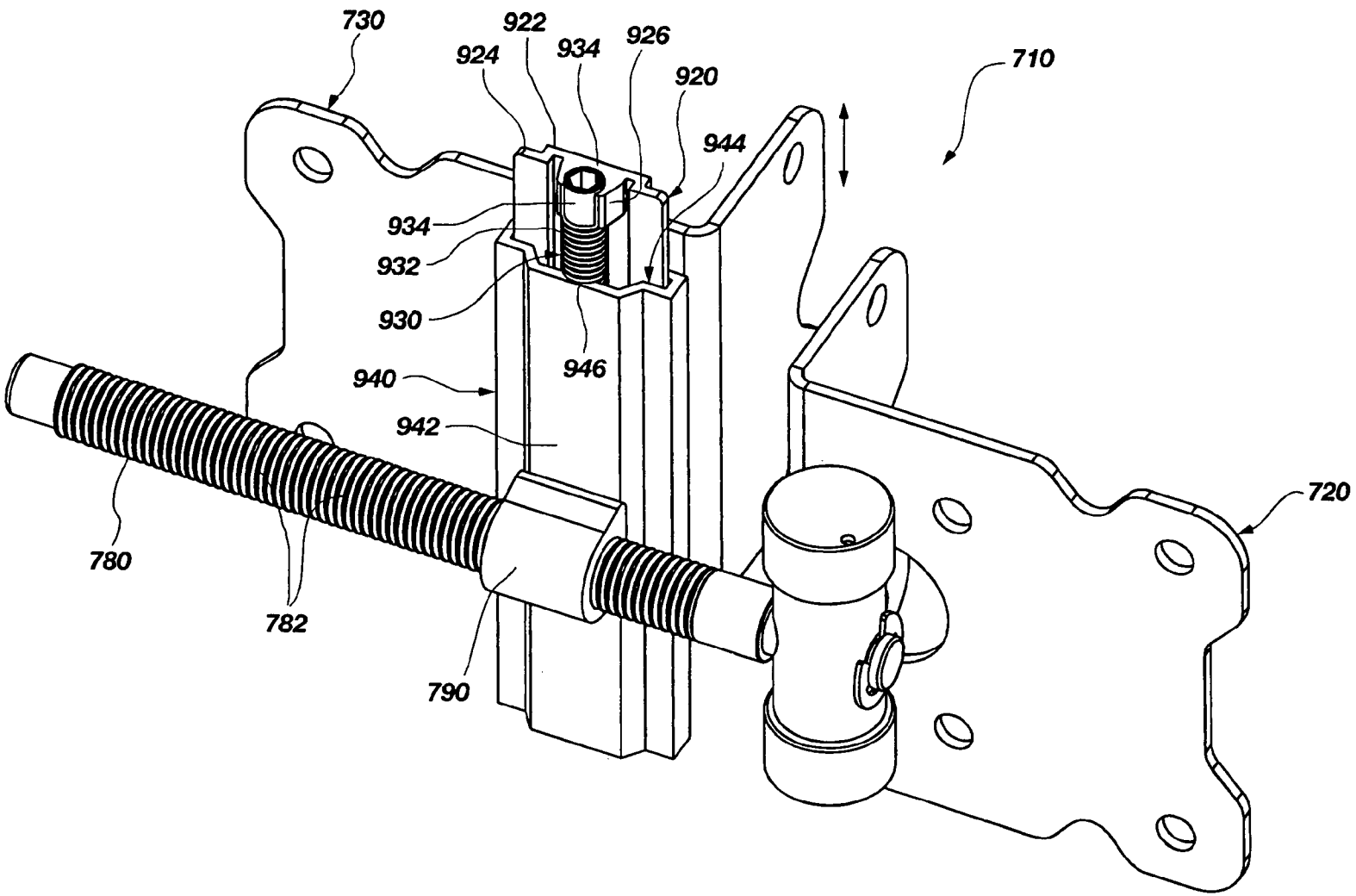
FIG. 32 illustrates a perspective view of an adjustable hinge assembly according to still another exemplary embodiment of the present invention.

FIG. 32 illustrates a perspective view of still another adjustable hinge assembly according to still another exemplary embodiment of the present invention. Specifically, FIG. 32 illustrates adjustable hinge 710 as comprising an alternative gate bracket assembly, wherein the gate bracket displaces both in the vertical and horizontal directions. The post bracket assembly is similar in function and form as that set forth above in relation to FIGS. 21–23, which description is incorporated herein.

As shown, the gate bracket assembly comprises a gate bracket 730 having a vertical adjustment bracket 920 coupled thereto. The vertical adjustment bracket 920 is fixed to the gate bracket 730, but is slidably retained within a track 940 having a collar 790 mounted thereto for rotatably securing the horizontal adjustment component 80. The collar 790 comprises an inner threaded bore that corresponds to the threads 82 formed on the horizontal adjustment component to effectuate horizontal adjustment of the gate bracket 730 with respect to the post bracket 720, as discussed above.

The vertical adjustment bracket 920 comprises a back portion 922, as well as extension members 924 sized and configured to be inserted into the corresponding channels 944 formed within the track 940. The relationship between the extension members 924 and the channel 944 allow the vertical adjustment bracket 920 to be slidably coupled to the track 940. The vertical adjustment bracket 920 further comprises a vertical adjustment component 930 retained by retention tabs 926, which extend from the back portion 922. The vertical adjustment component 930 comprises threads 932 formed thereon, which threads correspond to threads 946 cut or pressed into the inner surface of the track 940. As such, rotation of the vertical adjustment component 930 via the driving component 934 functions to displace the vertical adjustment bracket 920, and therefore the gate bracket 730 and the attached gate (not shown), with respect to the track 940, and therefore the post bracket 720 and attached post (not shown). Indeed, the vertical adjustment component 930 may be rotated in any direction to effectuate the vertical adjustment of the gate bracket 730 with respect to the post bracket 720.

Horizontal adjustment of the adjustable hinge assembly 710 is achieved by rotating the horizontal adjustment component 780, as coupled to the collar 790.

Gap Fillers and Hinge Covers

The present invention further features a variety of gap fillers to conceal the gap formed between the hinged components upon installing the adjustable hinge of the present invention. These gap fillers are designed to comprise a limited amount of flexibility in order to accommodate the different vertical and horizontal adjustments that are possible by the present invention adjustable hinge, as well as the pivoting operation of the adjustable hinge and the hinged components between an open and closed position. As such, the gap fillers may be made out of any suitable material, such as plastic, aluminum, etc.

The purpose of the gap filler is to conceal the gap between the hinged components, which can often be quite large. Gap fillers provide many significant advantages. First, they function to increase privacy by eliminating possible visual sight lines into the fenced area. Second, they eliminate unsightly gaps in the fence, thus improving the overall aesthetic appeal of the fence. Other advantages will be apparent to those skilled in the art.

With reference to FIG. 33-A, illustrated is a perspective view of a gap filler according to one exemplary embodiment of the present invention. As shown, adjustable hinge assembly 10 is operably mounted or attached to post and gate hinged components 2 and 4. Formed between the post 2 and the gate 4 is a gap 6. To conceal the gap 6, a gap filler 1002 is positioned between the post 2 and the gate 4 to span the gap 6. The gap filler 1002 comprises a u-shaped structure that mounts directly to the surface of the post 2 and the gate 4. The gap filler 1002 may be mounted under the post and gate brackets 20 and 30, as shown. Alternatively, the gap filler 1002 may be mounted over these brackets. Even still, in the event the post and gate are made of a plastic material, the gap filler 1002 may be adhered to their surfaces using some type of adhesive. In FIG. 33-A, gap filler 1002 is positioned to extend away from the adjustable hinge 10. There are several possible ways of attaching or securing the gap fillers in place to conceal the gap 6, as will be recognized by one skilled in the art.

FIG. 33-B illustrates the same gap filler embodiment of FIG. 33-A, only the gap filler 1002 is positioned in a reverse configuration to be proximate the adjustable hinge 10. As can be seen, the particular orientation of the gap filler 1002 may vary from assembly to assembly.

FIGS. 34-A–34-F illustrate several different embodiments of a gap filler 1002 that may be used to conceal or fill the gap between hinged components. Specifically, FIG. 34-A illustrates gap filler 1002 as comprising a standard depth triple corrugated configuration. FIG. 34-B illustrates gap filler 1002 as comprising an extended depth double corrugated configuration. FIG. 34-C illustrates gap filler 1002 as comprising a u-shaped configuration similar to the u-shaped configuration described above. FIG. 34-D illustrates gap filler 1002 as comprising a standard depth quadruple corrugated configuration. FIG. 34-E illustrates gap filler 1002 as comprising a shallow depth and triple corrugated configuration. FIG. 34-F illustrates gap filler 1002 as comprising a shallow depth corrugated configuration having several tight segments.

The present invention further features various hinge cover configurations designed and configured to cover and/or conceal the various components of the adjustable hinge assembly, and particularly the individual post and hinge bracket assemblies, as well as to facilitate operation and adjustment of the hinge while attached. The covers are designed to cover the hinge assembly for various purposes, such as for improved aesthetics, as well as to protect the hinge components from adverse weather conditions. The covers are preferably configured to provide free movement of the hinge assembly, meaning that, as attached, they do not interfere with the normal operation of the adjustable hinge. As such, sufficient clearance must be provided within the covers themselves. In addition, the covers are configured to facilitate easy and quick access to the hinge components to effectuate adjustment of both the vertical and horizontal adjustment components without requiring removal of the covers. Several designs are contemplated herein, some of which are discussed below.

Figure 35:
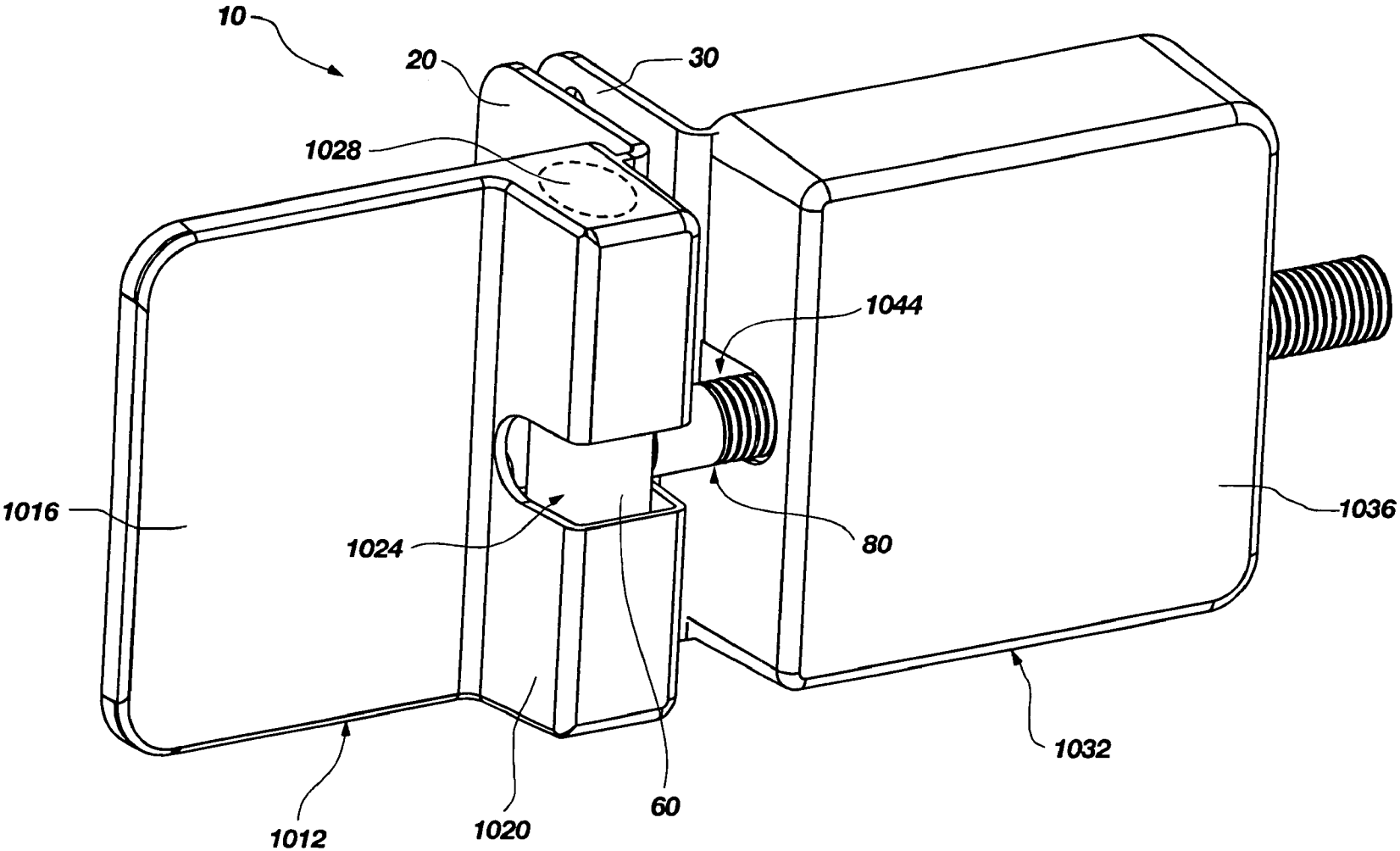
FIG. 35 illustrates a perspective view of an adjustable hinge assembly having hinge covers attached thereto according to one exemplary embodiment of the present invention.

With reference to FIG. 35, illustrated is a perspective view of an adjustable hinge assembly having hinge covers attached thereto according to one exemplary embodiment of the present invention. Specifically, FIG. 35 illustrates the post bracket assembly as comprising a cover 1012 that comprises a flat section 1016 that couples to and covers the post mounting portion, as well as a raised section 1020 sized and configured to cover the pivoting hinge component. The raised section 1020 is shown comprising a slot 1024 formed therein configured to allow the horizontal adjustment component 80 to pivot about the vertical hinge component, namely the hinge barrel 60, without the cover 1012 interfering with the horizontal adjustment component 80. The cover 1002 may further comprise an aperture 1028 formed in the top of the raised section 1020, or other slots, apertures, etc., to facilitate adjustment of the vertical adjustment component 50.

The gate bracket assembly also comprises a cover 1032 comprising a box-like structure that couples to the gate bracket and that covers the components of the gate bracket assembly, namely at least a portion of the horizontal adjustment component 80 and the structure supporting the horizontal adjustment component 80 on the gate bracket. As shown, the cover 1032 comprises a first aperture 1044 and a second aperture 1048 for receiving the horizontal adjustment component 80 therethrough, which allows the cover 1032 to facilitate adjustment of the horizontal adjustment component 80 without having to remove the cover 1032.

Covers 1012 and 1032 are preferably snap-on covers that snap onto the respective post and gate brackets. However, other means for coupling the covers to the respective post and gate bracket assemblies is contemplated herein, such as by a tongue and groove configuration that allows the covers to be slid over the post and gate bracket assemblies, a quick-connect fitting, by fasteners of various kinds, and others. In addition, the covers 1012 and 1032 may be formed of any suitable material, such as plastic, aluminum, etc., although plastic is preferred.

Horizontal and Vertical Adjustment Tools

The present invention further features one or more tools to assist the installer and/or owner of the hinge assembly in both installing and adjusting the adjustable hinge assembly at periodic times after installation.

Figure 36:
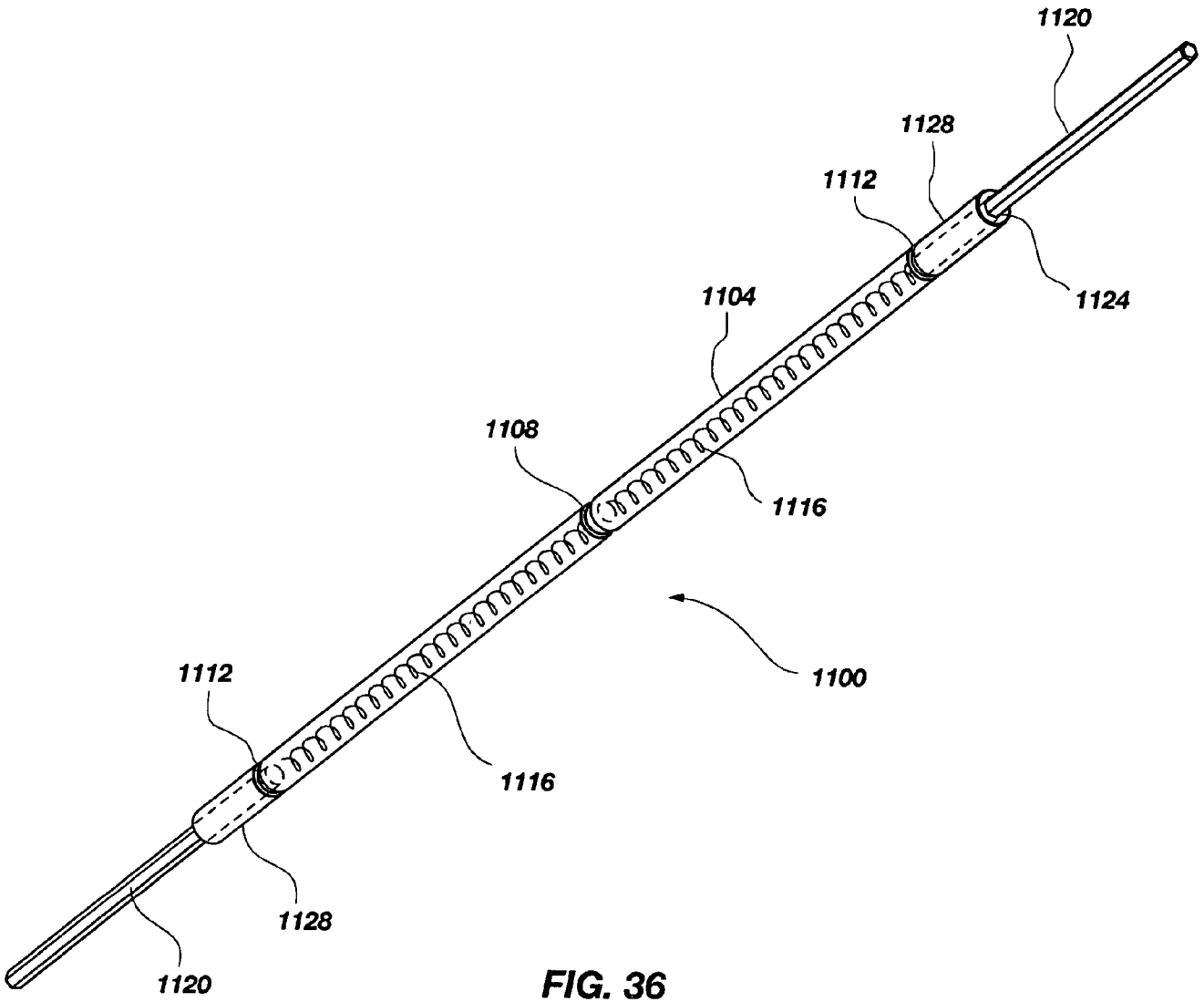
FIG. 36 illustrates a perspective view of a vertical adjustment tool according to one exemplary embodiment.
Figure 37:
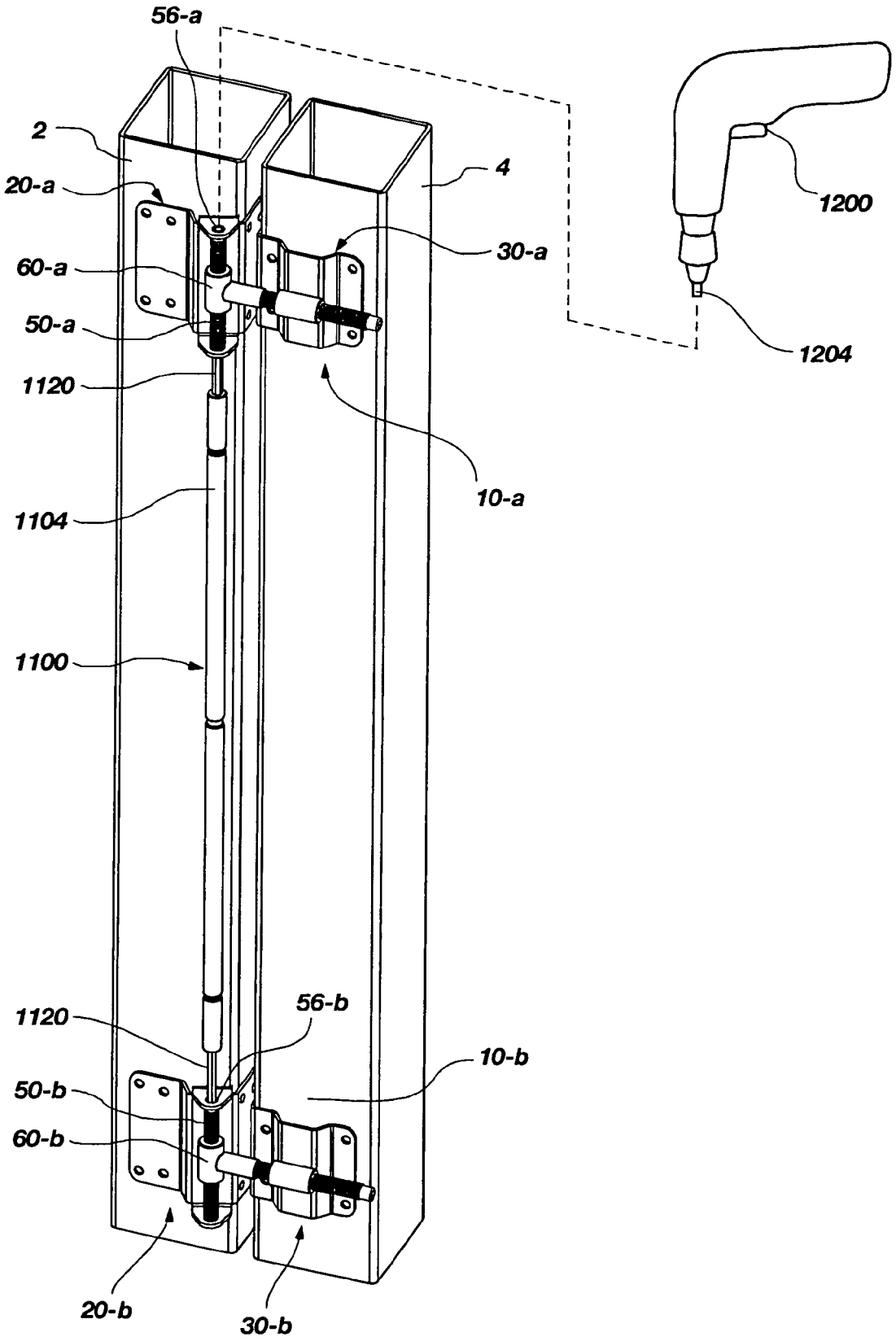
FIG. 37 illustrates a perspective view of the vertical adjustment tool of FIG. 36 as utilized to adjust a gate and post assembly.

Referring now to FIGS. 36 and 37, there is illustrated a perspective view of a vertical adjustment tool according to one exemplary embodiment of the present invention. Specifically, FIGS. 36 and 37 illustrate vertical adjustment tool 1100 configured to be removably coupled between a top vertical adjustment component 50-*a* and a bottom vertical adjustment component 50-*b* of a respective top adjustable hinge 10-*a* and bottom adjustable hinge 10-*b*, which are accordingly spaced vertically apart and each mounted to a hinged post 2 and gate 4 component assembly. Such a vertical adjustment tool 1100 is configured to facilitate simultaneous vertical adjustment of the top and bottom vertical adjustment components 50-*a* and 50-*b* to effectuate simultaneous displacement of the top and bottom gate brackets 30-*a* and 30-*b* with respect to the top post bracket 20-*a* and bottom post bracket 20-*b*, and therefore the gate 4 with respect to the post 2, respectively.

The vertical adjustment tool 1100 comprises a tube member 1104 with a center crimp portion 1108 and outer crimp portions 1112 spaced from the center crimp portion 1108. The center crimp portion 1108 and outer crimp portions 1112 can extend annularly around the tube member 1104. The tube member 1104 comprises independent spring members 1116 disposed therein. Each spring member 1116 can be positioned in the tube member 1104 between the center crimp portion 1108 and each outer crimp portion 1112. The center crimp portion 1108 and the outer crimp portions 1112 form stopper portions defined about the inner surface of the tube member 1104. Such stopper portions retain the spring members 1116 in position between the center crimp portion 1108 and the outer crimp portions 1112, respectively.

The vertical adjustment tool 1100 further comprises drive shafts 1120, one disposed or located on each end portion 1128 of the tube member 1104. The drive shafts 1120 can include an external configuration so as to match the driving components 56-*a* and 56-*b* of the vertical adjustment components 50-*a* and 50-*b*, respectively, previously set forth above with respect to FIGS. 1–20. The drive shafts 1120 can include a stopper member at end portions thereof to bias against the spring member 1116, wherein the stopper portion is situated or disposed between the spring member 1116 and the outer crimp portion 1112 defined in the tube member 1104. Such drive shafts 1120 are linearly displaceable within the tube member 1104 with the spring member 1116 biasing against the drive shaft 1120 in a spring-loaded arrangement. At the end portions 1128 of the tube member 1104, a shaft bushing 1124 can be fixedly disposed therein with a bore having an internal configuration to correspond with the external configuration of the drive shaft 1120. In another embodiment, instead of shaft bushing 1124 inserts, the end portions 1128 of the tube member 1104 can be formed to include an inner surface to match and correspond with the external configuration of the drive shaft 1120. In either case, the drive shaft 1120 can slide linearly against the spring member 1116 within the spring-loaded arrangement. Further, any rotation placed on one drive shaft 1120, translates rotation to the tube member 1104 which also translates rotation to the other drive shaft 1120 disposed in the opposite end portion 1128 of the tube member 1104.

As previously indicated, the vertical adjustment tool 1100 can be positioned between the top and bottom vertical adjustment components 50-*a* and 50-*b* spaced vertically about a common axis on post 2. Each drive shaft 1120 disposed in the end portions 1128 of the tube member 1104 can be displaced linearly a distance corresponding with the spacing between the top and bottom vertical adjustment components 50-*a* and 50-*b*, in which the drive shafts 1120 are spring-loaded to linearly bias outward and to fit within the driving components 56-*a* and 56-*b*, respectively, as shown in FIG. 37, between the top and bottom vertical adjustment components 50-*a* and 50-*b*. With the vertical adjustment tool 1100 positioned between the top and bottom vertical adjustment components 50-*a* and 50-*b*, a user can rotatably drive one of the top or bottom vertical adjustment components 50-*a* and 50-*b* by inserting, for example, a hex drive bit 1204 coupled to a power drill 1200, into an opposing end of either of the driving components 56-*a* or 56-*b* of the top or bottom vertical adjustment components 50-*a* and 50-*b*, as shown. The hex drive bit 1204 includes a configuration so as to mate with the driving component 56-*a* or 56-*b* of the top or bottom vertical adjustment component 50-*a* or 59-*b*. In the illustration of FIG. 37, the hex drive bit 1204 is shown being inserted into the driving component 56-*a* of the top vertical adjustment component 50-*a*. In this manner, rotatably driving or adjusting the top vertical adjustment component 50-*a* simultaneously rotates and adjusts the bottom vertical adjustment component 50-*b* with the vertical adjustment tool 1100 disposed therebetween. As such, each of the top and bottom hinge barrels 60-*a* and 60-*b* that are rotatably coupled to the respective top and bottom vertical adjustment components 50-*a* and 50-*b* vertically displace in a simultaneous manner, thereby, also simultaneously vertically moving the top and bottom gate brackets 30-*a* and 30-*b* with respect to the top and bottom post brackets 20-*a* and 20-*b*, and therefore the gate 4 with respect to the post 2. With this arrangement, the gate 4 can be raised and lowered, depending on the rotation placed on either of the top and bottom vertical adjustment components 50-*a* and 50-*b*, without binding the mounting portions of the top and bottom adjustable hinges 10-*a* and 10-*b* with the post 2 and gate 4 hinged component assembly. The vertical adjustment tool 1100 can be advantageously implemented at the time of installation. In addition, due to various degrees of misalignment that can occur over time as a result of extended use, settling, or sagging of the gate 4 under its own weight, the vertical adjustment tool 1100 may be used periodically and repeatedly to again vertically align the gate 4 with the post 2.

Figure 38:
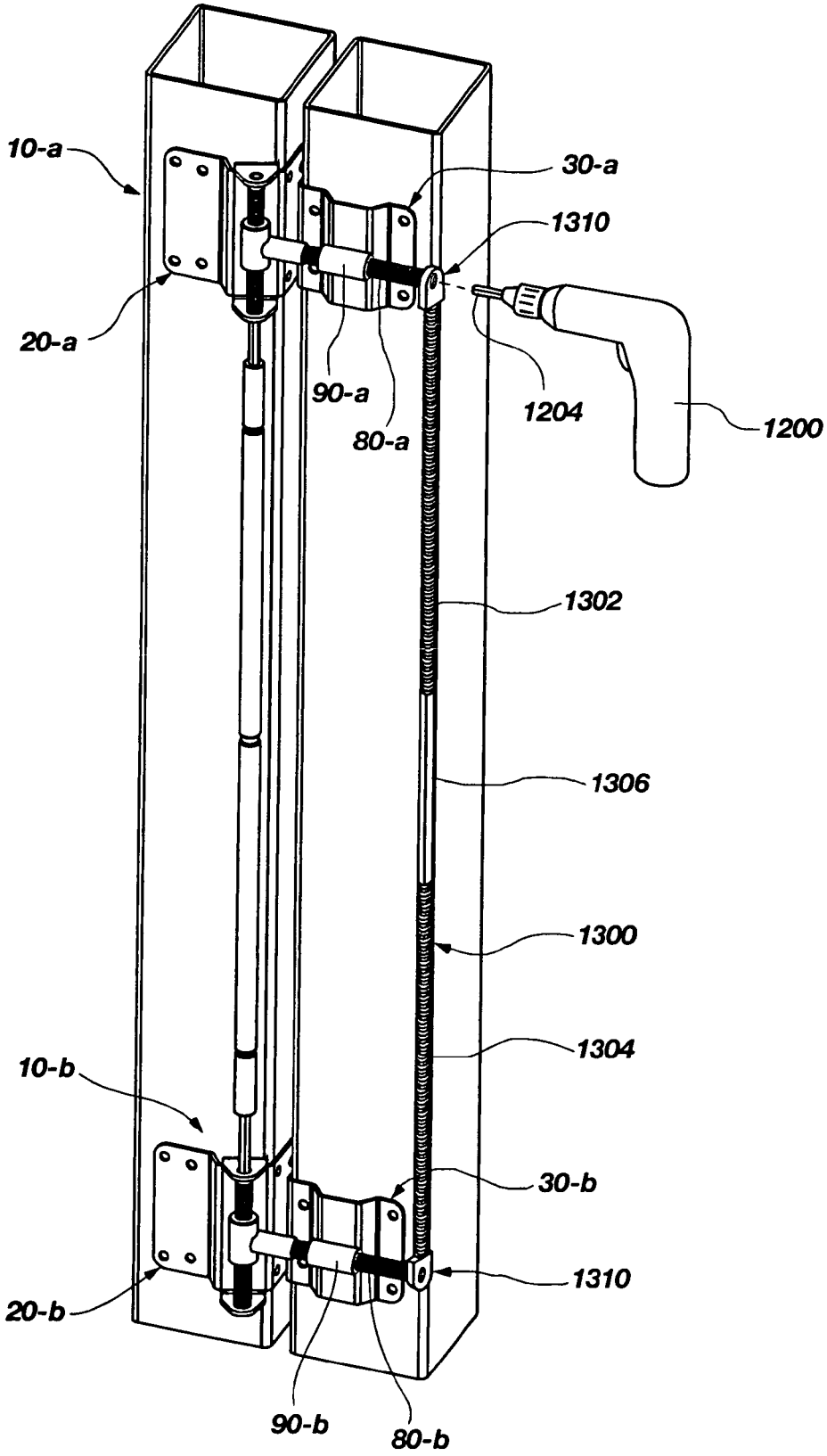
FIG. 38 illustrates an exemplary horizontal adjusting tool according to one exemplary embodiment of the present invention.

FIG. 38 illustrates an exemplary horizontal adjusting tool 1300 configured to removably couple with a top and bottom horizontal adjustment component 80-*a* and 80-*b* coupled to respective top and bottom adjustable hinges 10-*a* and 10-*b*, each being spaced vertically apart and mounted to a post 2 and gate 4 hinged component assembly. The horizontal adjusting tool 1300 can include first and second tube members 1302 and 1304 with a drive shaft 1306 coupled therebetween. The first and second tube members 1302 and 1304 each include an end having a gear member 1310 coupled thereto. With this arrangement, each end of the horizontal adjusting tool 1300 includes one gear member 1310 configured to couple with the first end portion of the top horizontal adjustment component 80-*a* and the other gear member 1310 configured to couple with the bottom horizontal adjustment component 80-*b*. The first and second tube members 1302 and 1304 and/or the shaft can include a telescoping configuration to be positionable between the top and bottom adjustable hinges 10-*a* and 10-*b*.

Similar to the vertical adjusting tool previously described, a hex drive bit 1204 coupled to a power tool 1200 can rotatably drive, for example, the top horizontal adjustment component 80-*a*. With the horizontal adjustment tool 1300 in position, the rotation of the top horizontal adjustment component 80-*a* translates rotation through the upper gear member 1310 to the first and second tube members 1302 and 1304 and drive shaft 1306, which simultaneously translates rotation through the lower gear member 1310 and to the bottom horizontal adjustment component 80-*b*. In this manner, a user can simultaneously horizontally adjust, with common linear displacement, the top gate bracket 30-*a* and bottom gate bracket 30-*b* with respect to the top post bracket 20-*a* and bottom post bracket 20-*b*, respectively, and therefore the gate 4 with respect to the post 2. Such is accomplished due to the simultaneous rotation of the top and bottom horizontal adjustment components 80-*a* and 80-*b*, which simultaneously horizontally move the respective top and bottom collars 90-*a* and 90-*b* coupled to the respective top and bottom gate brackets 30-*a* and 30-*b*.

Figure 39:
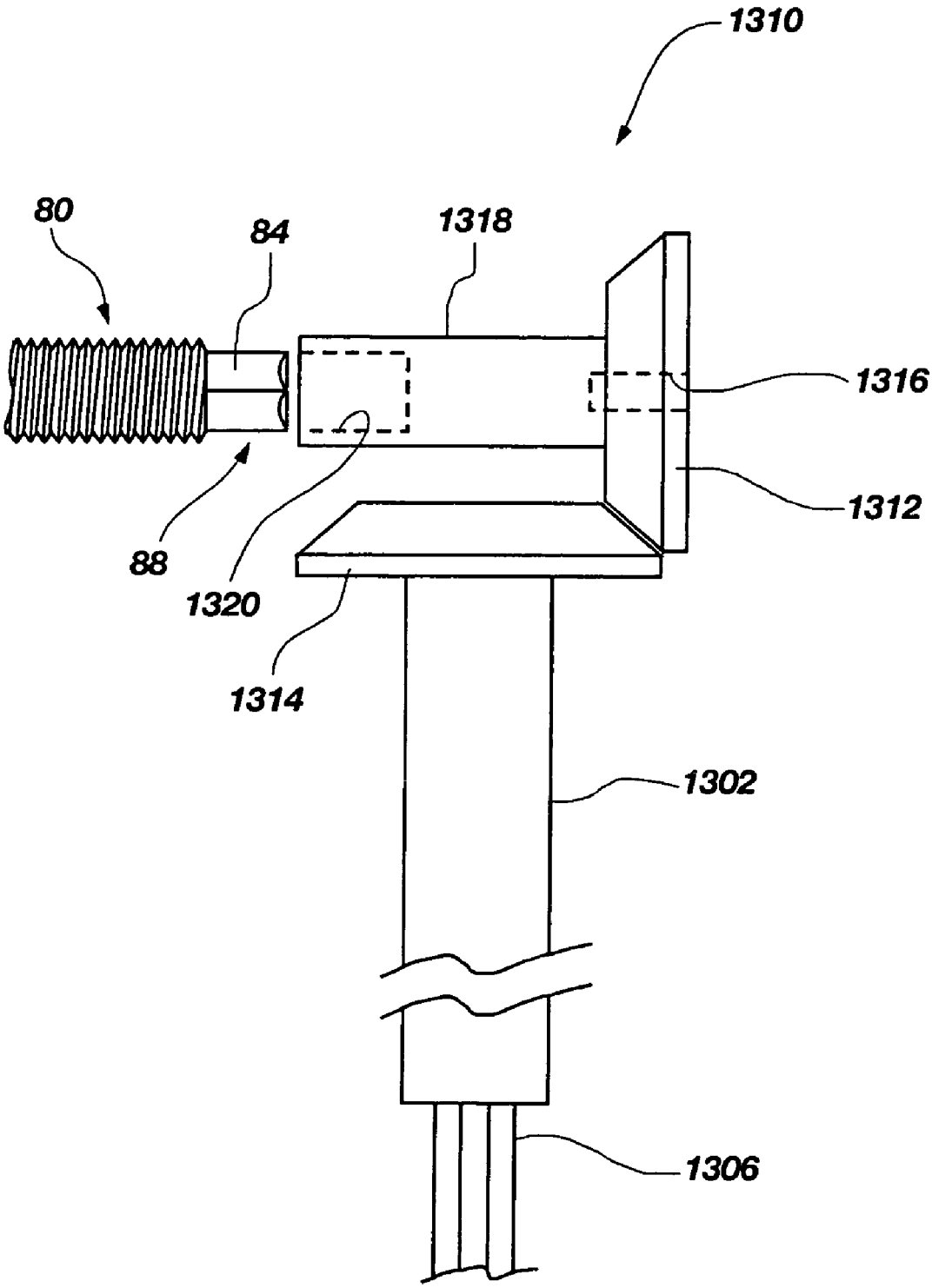
FIG. 39 illustrates the horizontal adjusting tool of FIG. 38, and particularly the gear member as coupled to the tube member and drive shaft.
Figure 40:
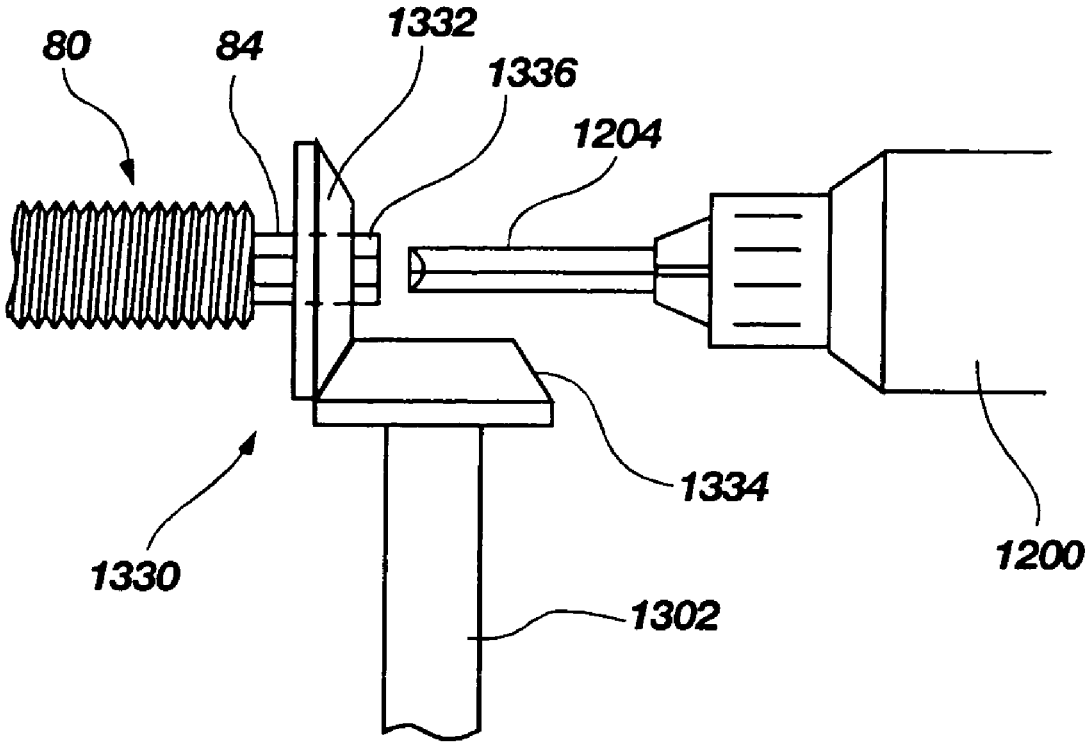
FIG. 40 illustrates another embodiment of a gear member of the horizontal adjustment tool of FIG. 38, wherein the gear member comprises a vertical gear and a horizontal gear.
Figure 41:
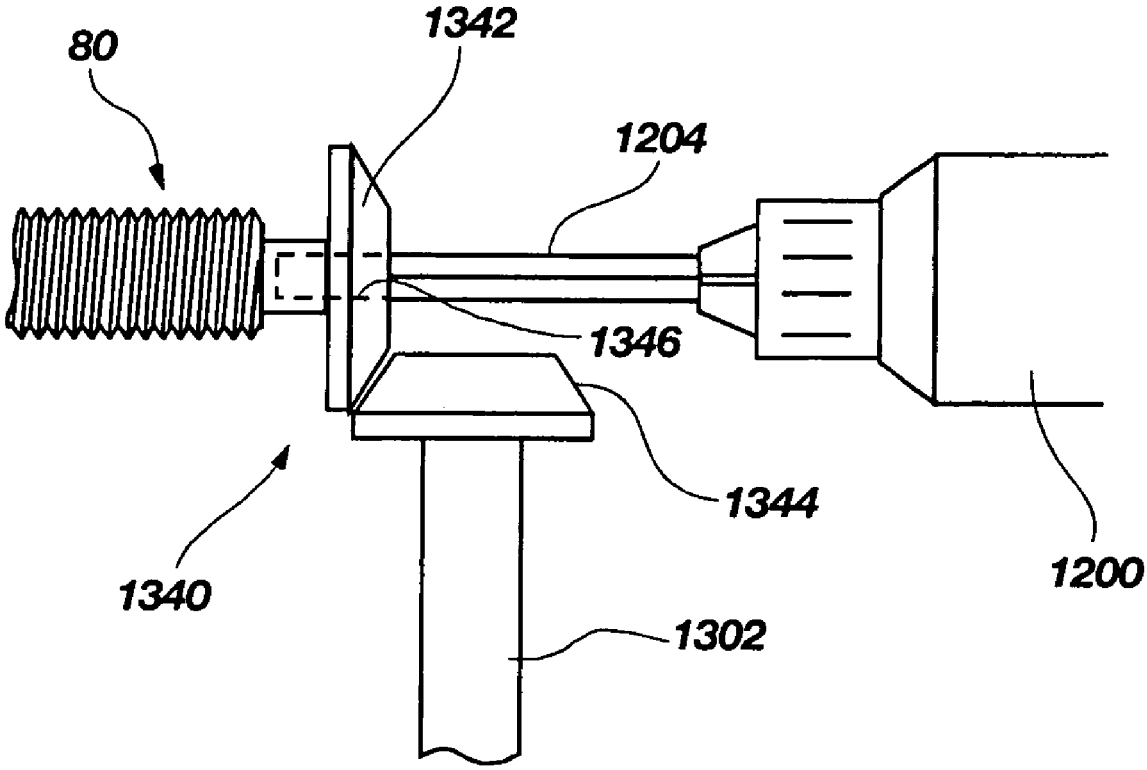
FIG. 41 illustrates still another exemplary embodiment of a gear member of the horizontal adjustment tool, wherein the gear member is configured to translate simultaneous rotation of one horizontal adjustment component to the other horizontal adjustment component spaced vertically apart from each other.

FIGS. 39 through 41 depict various embodiments of the gear member 1310, shown without the gear housing, coupleable to the first end portion 84 of the horizontal adjustment component 80. Turning first to FIG. 39, the gear member 1310 is coupled to the tube member 1302 and drive shaft 1306. The gear member 1310 can include a vertical gear 1312 and a horizontal gear 1314. The vertical gear 1312 can include an extension portion 1318 configured to mate with the driving component 88 at the first end portion 84 of the horizontal adjustment component 80. The vertical gear 1312 also includes a bit receptacle 1316 configured to receive a hex drive bit (not shown) sized for such bit receptacle 1316. The vertical and horizontal gears 1312 and 1314 are positioned and configured such that rotation of, for example, the vertical gear 1312 will simultaneously rotate the horizontal gear 1314. Further, rotation of the vertical gear 1312 can simultaneously rotate the horizontal adjustment component 80 via the extension portion 1318 mateable with the horizontal adjustment component 80. The horizontal gear 1314 is coupled to the tubing 1302 so that as the horizontal gear 1314 rotates the tube member 1302 and drive shaft 1306 also rotate.

FIG. 40 depicts another embodiment of the gear member 1330 having the vertical gear 1332 and the horizontal gear 1334. In this embodiment, the vertical gear member 1332 includes an opening 1336 extending therethrough which can mate with an external surface of the first end portion 84 of the horizontal adjustment component 80. The driving component (not shown) of the horizontal adjustment component 80 can then receive the hex drive bit 1204 coupled to a power tool 1200 to directly rotate the horizontal adjustment component 80. Such rotation of the horizontal adjustment component 80 rotates the vertical gear 1332, which simultaneously translates rotation to the horizontal gear 1334, thereby, rotating the tube member 1302 and so forth to the other horizontal adjustment component (not shown) spaced vertically therefrom, as previously set forth.

FIG. 41 depicts still another embodiment of the gear member 1340 configured to translate simultaneous rotation of one horizontal adjustment component to the other horizontal adjustment component spaced vertically apart from each other. In this embodiment, the gear member 1340 includes a vertical gear 1342 and a horizontal gear 1344. The vertical gear 1342 includes an opening 1346 extending therethrough, which is sized and configured to match the driving component (not shown) of the horizontal adjustment component 80. With this arrangement, the vertical gear 1342 is positioned adjacent the horizontal adjustment component 80 so that a hex drive bit 1204 coupled to a power tool 1200 can slide through the opening 1346 in the vertical gear 1342 and directly into the driving component of the horizontal adjustment component 80. In this manner, as the drill 1200 simultaneously rotates both, for example, the top horizontal adjustment component 80 and the vertical gear 1342, the vertical gear 1342 translates such rotation to the horizontal gear 1344, which simultaneously rotates the tube member 1302 to the other gear member (not shown) coupled to the bottom horizontal adjustment component (not shown) spaced vertically therefrom.

Figure 42:
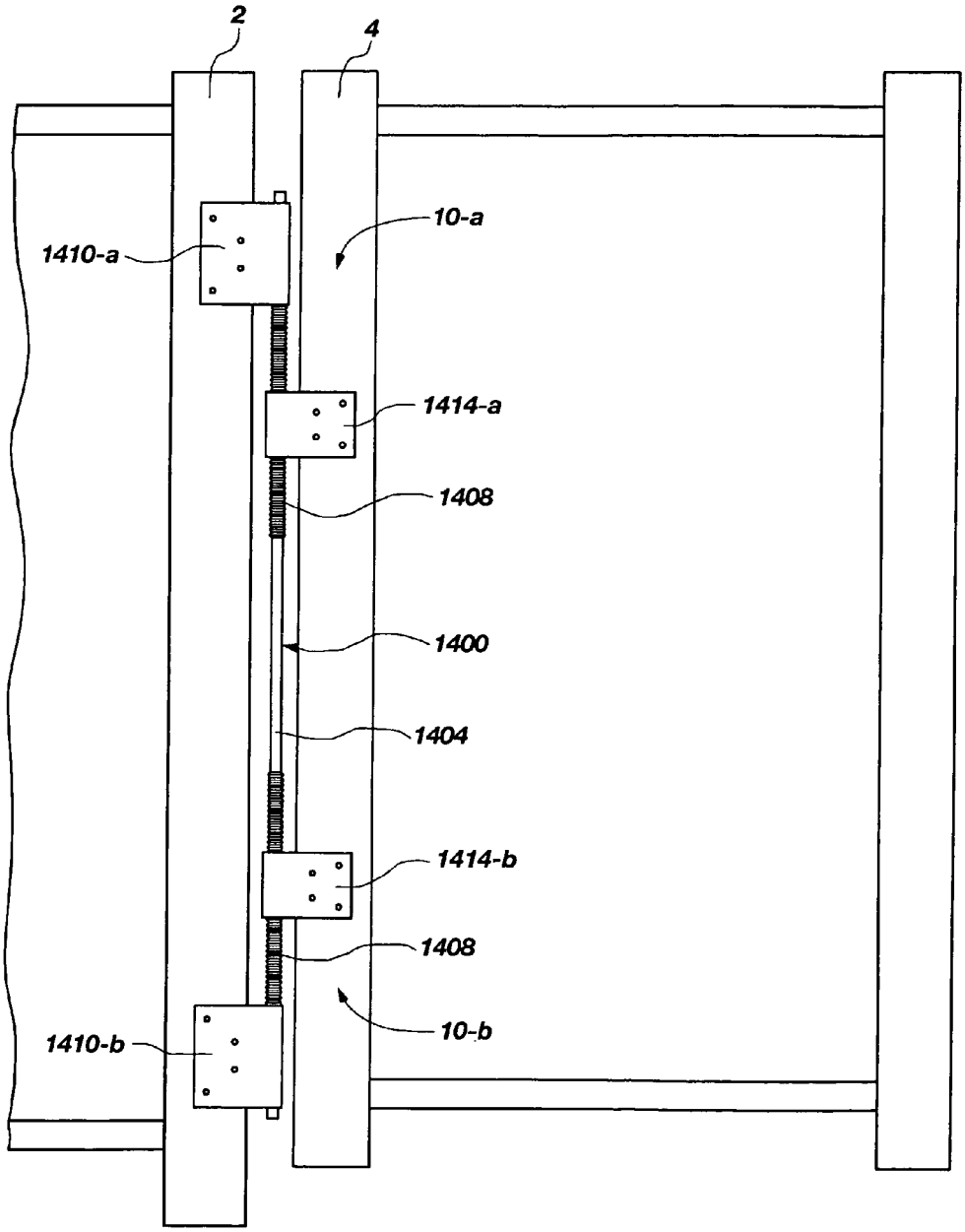
FIG. 42 illustrates another exemplary hinged component assembly utilizing an exemplary continuous vertical adjustment rod extending between top and bottom free spinning post brackets, as well as top and bottom gate brackets.

Referring now to FIG. 42, shown is another exemplary hinged component assembly utilizing a continuous vertical adjustment rod 1400 extending between top and bottom free spinning post brackets 1410-*a* and 1410-*b*, as well as top and bottom gate brackets 1414-*a* and 1414-*b* having internal threads formed therein. The free spinning post brackets 1410-*a* and 1410-*b* and the gate brackets 1414-*a* and 1414-*b* comprise the top and bottom adjustable hinge assemblies 10-*a* and 10-*b*, respectively. The vertical adjustment rod 1400 comprises a rigid rod 1404 having threaded portions 1408 formed therein. The free spinning post brackets 1410-*a* and 1410-*b* function to hold the vertical adjustment rod 1400 in a suspended state, while the threaded portions 1408 engage the threaded gate brackets 1414-*a* and 1414-*b* to provide and facilitate vertical adjustment of the hinged assemblies 10-*a* and 10-*b*, and therefore the gate 4 with respect to the post 2. Essentially, rotation of the vertical adjustment rod in either direction causes the gate brackets 1414-*a* and 1414-*b* to displace with respect to the free spinning post brackets 1410-*a* and 1410-*b*, thus raising or lowering the gate 4 with respect to the post 2. The particular configuration of the post and gate brackets 1410 and 1414 may be any described herein, or others known in the art.

Figure 43:
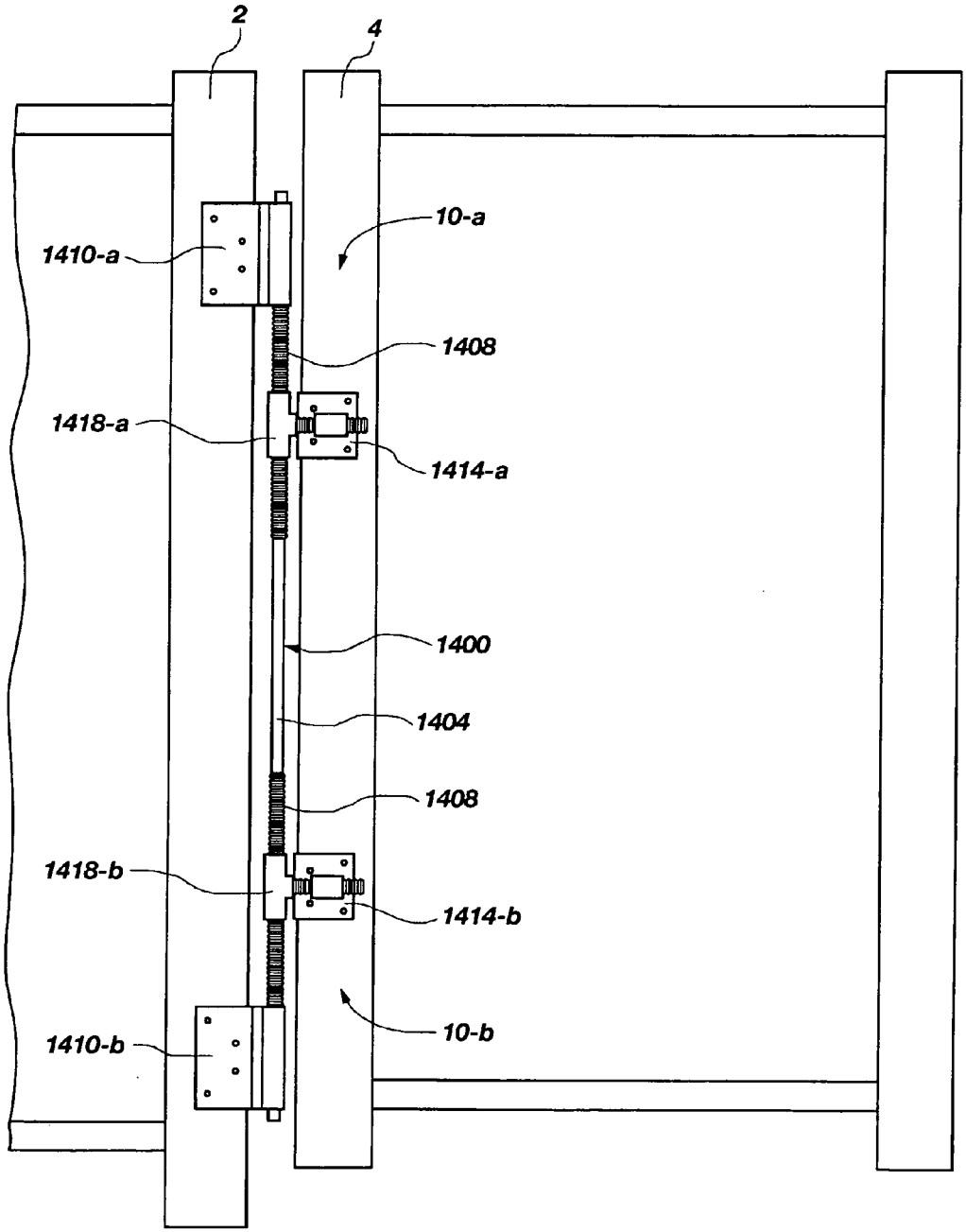
FIG. 43 illustrates the vertical adjustment rod of FIG. 42 as used on another exemplary type of adjustable hinge assembly.

FIG. 43 illustrates the vertical adjustment rod 1400 of FIG. 42 as used on another exemplary type of adjustable hinge assembly, shown as adjustable hinge assemblies 10-*a* and 10-*b*. In this embodiment, the vertical adjustment tool is situated between top and bottom free spinning post brackets 1410-*a* and 1410-*b*, as well as top and bottom gate brackets 1414-*a* and 1414-*b* having internal threads formed within the top and bottom hinge barrels 1418-*a* and 1418-*b* supported thereon, respectively. Vertical adjustment rod 1400 functions similar as that described above in relation to FIG. 42, only the gate brackets 1414-*a* and 1414-*b* comprise hinge barrels, which are similar in form and function as those described above with respect to FIGS. 21–32, and which description is incorporated herein.

It is noted herein that the post and gate brackets, as well as the vertical adjustment rod 1400, may be mounted in other positions in order to close the gap between the post and gate portions 2 and 4.

Installation Tool

Figure 45:
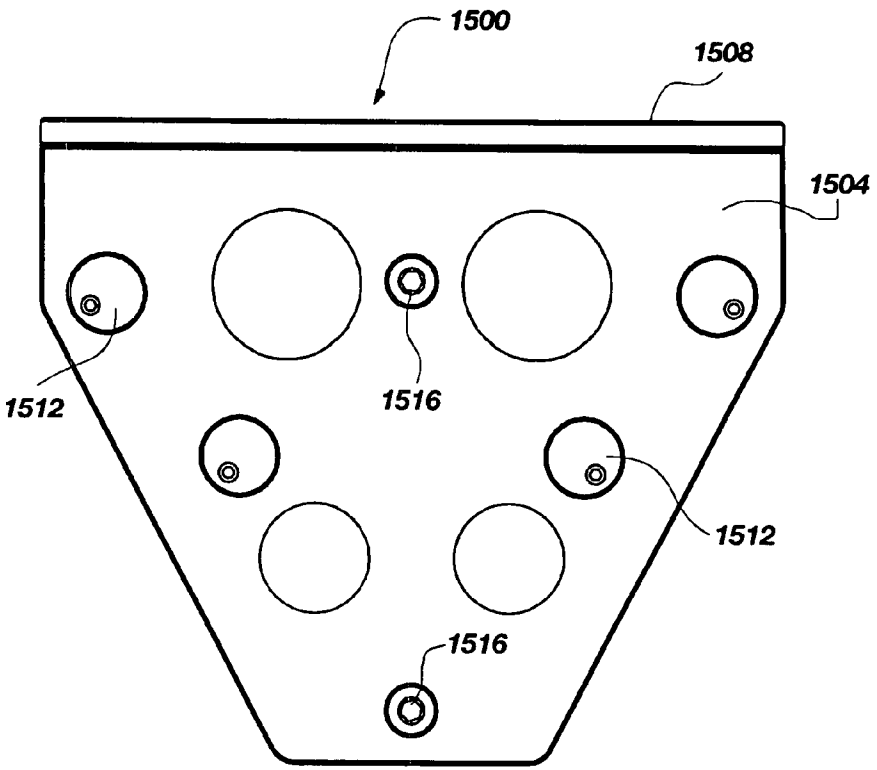
FIGS. 44 and 45 illustrate respective perspective and front views of an installation tool according to one exemplary embodiment.
Figure 44:
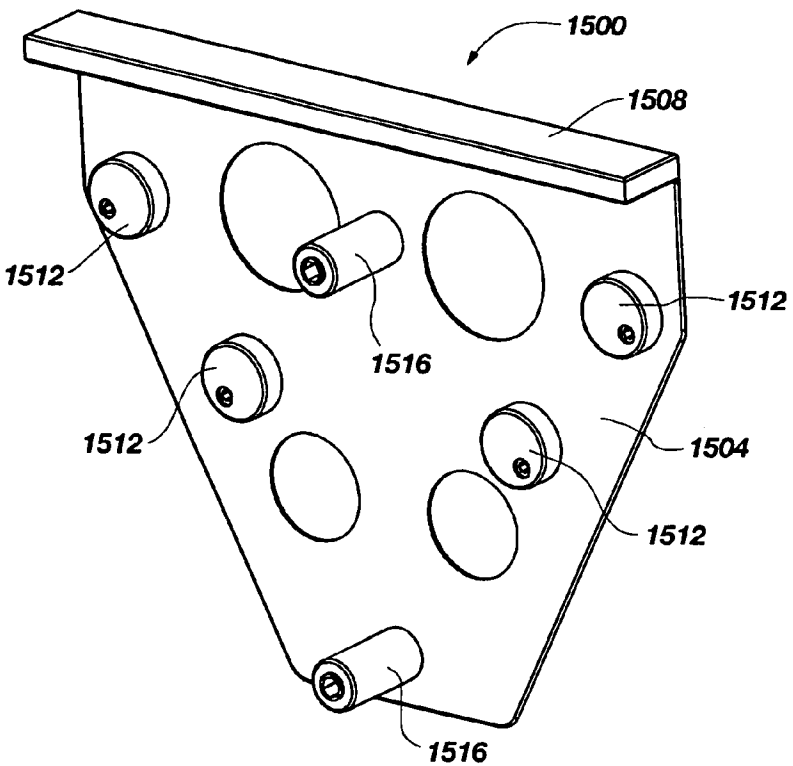

The present invention further comprises an installation tool to assist the installer in installing the gate and post hinged component assembly. Referring now to FIGS. 44 and 45, shown are respective perspective and front views of an installation tool according to one exemplary embodiment. The installation tool 1500 is shown as comprising a base frame component 1504 and a top rail 1508 disposed about and extending perpendicularly from the top of the base frame component 1504. The base frame component further comprises a plurality of eccentric components 1512, such as cam components, as well as spacers 1516, situated about the base frame component 1504. The base frame 1504 is configured to receive a post and gate hinged component assembly between the eccentric components 1512, as these are appropriately situated about the installation tool 1500. With the installation tool 1500 in place about the post and gate, the eccentric components 1512 are actuated to secure the post and gate components in place with respect to one another. At this time, the particular adjustable hinge assemblies to be utilized to couple together the post and the gate may be installed.

The top rail 1508 functions to align the tops of the gate and post components prior to mounting of the hinged assembly, and also the mating edges of a double gate. The eccentric components provide the ability to clamp materials of varying size and are capable of being actuated and adjusted very rapidly for easy and efficient gate installations. The spacers 1516 provide a backstop for the clamping of the ends of the gate. These may be adjustable or interchangeable to provide varying gap settings between the gate and the post. The initial gap setting is not critical and may change when the installation tool is removed and the full weight of the gate is allowed to be placed on the post through the installed hinge assembly. At this time, the gate may be further adjusted as described herein to achieve proper alignment of the gate with respect to the post.

Figure 47:
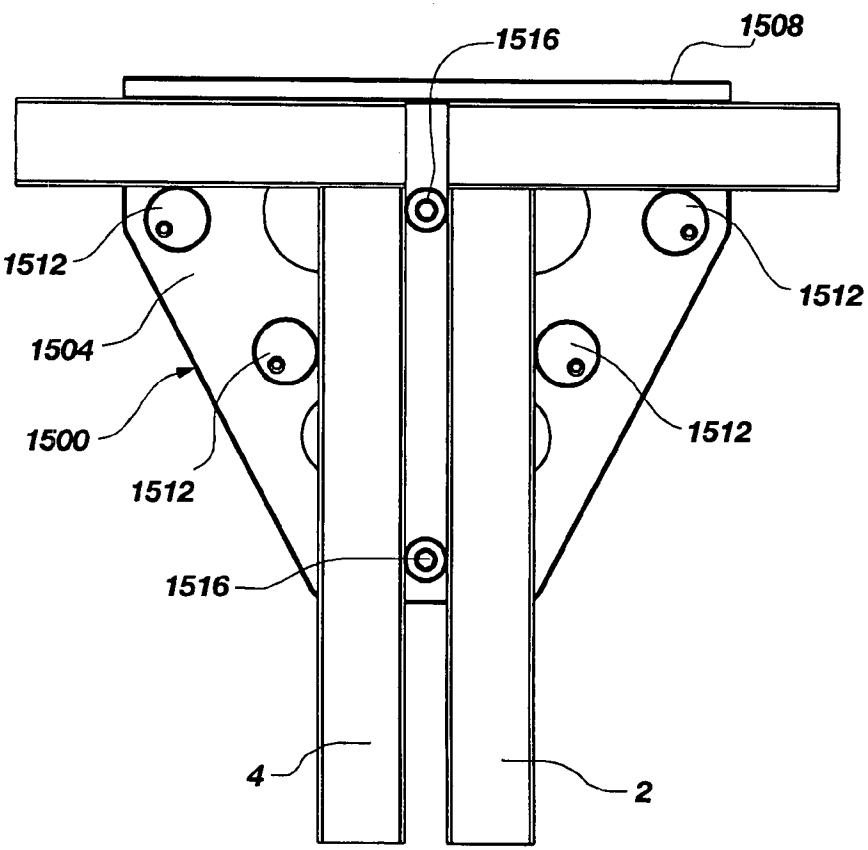
FIGS. 46 and 47 illustrate respective perspective and front views of the installation tool of FIGS. 44 and 45.
Figure 46:
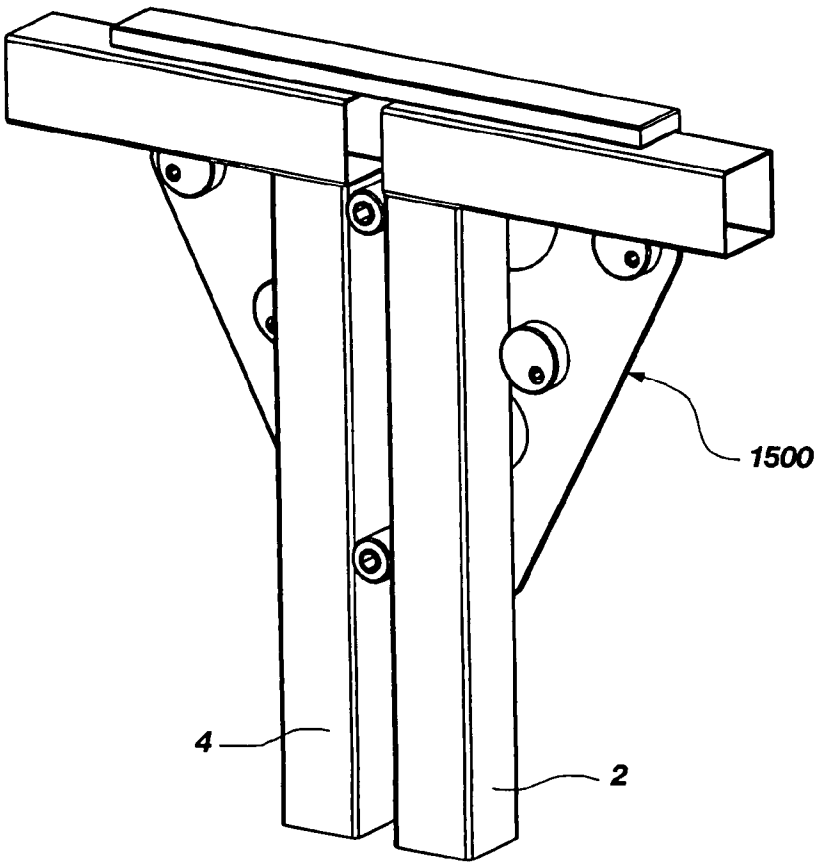

FIGS. 46 and 47 illustrate perspective and front views, respectively, of the installation tool of FIGS. 44 and 45 as coupled with the post and gate hinged components 2 and 4, respectively. As can be seen, the eccentric components 1512 are actuated to push against the sides of the post 2 and gate 4 from one side, while opposing sides of the post 2 and gate 4 are pushed against spacers 1516, thereby defining the initial gap between the post 2 and gate 4. Top rail 1508 maintains the horizontal alignment of the post 2 with respect to the gate 4, while the base frame 1504 maintains the vertical alignment of the post 2 with the gate 4. As so situated, the installation tool 1500 functions to provide an accurate and efficient first alignment of the post 2 with the gate 4 prior to mounting the adjustable hinge assemblies thereto. As such, only minimal "fine tuning" of the gate 4 with respect to the post 2 should be needed after installation of the adjustable hinge assemblies.

Adjustable Concealed Hinge Assembly

The present invention further comprises an adjustable concealed hinge assembly configured so that it is substantially concealed between the gate and the post to improve the aesthetic appeal of the hinged component assembly. The concealed hinge assembly further functions to reduce binding, which occurs when the gate rotates more than 180° about the post.

Figure 48:
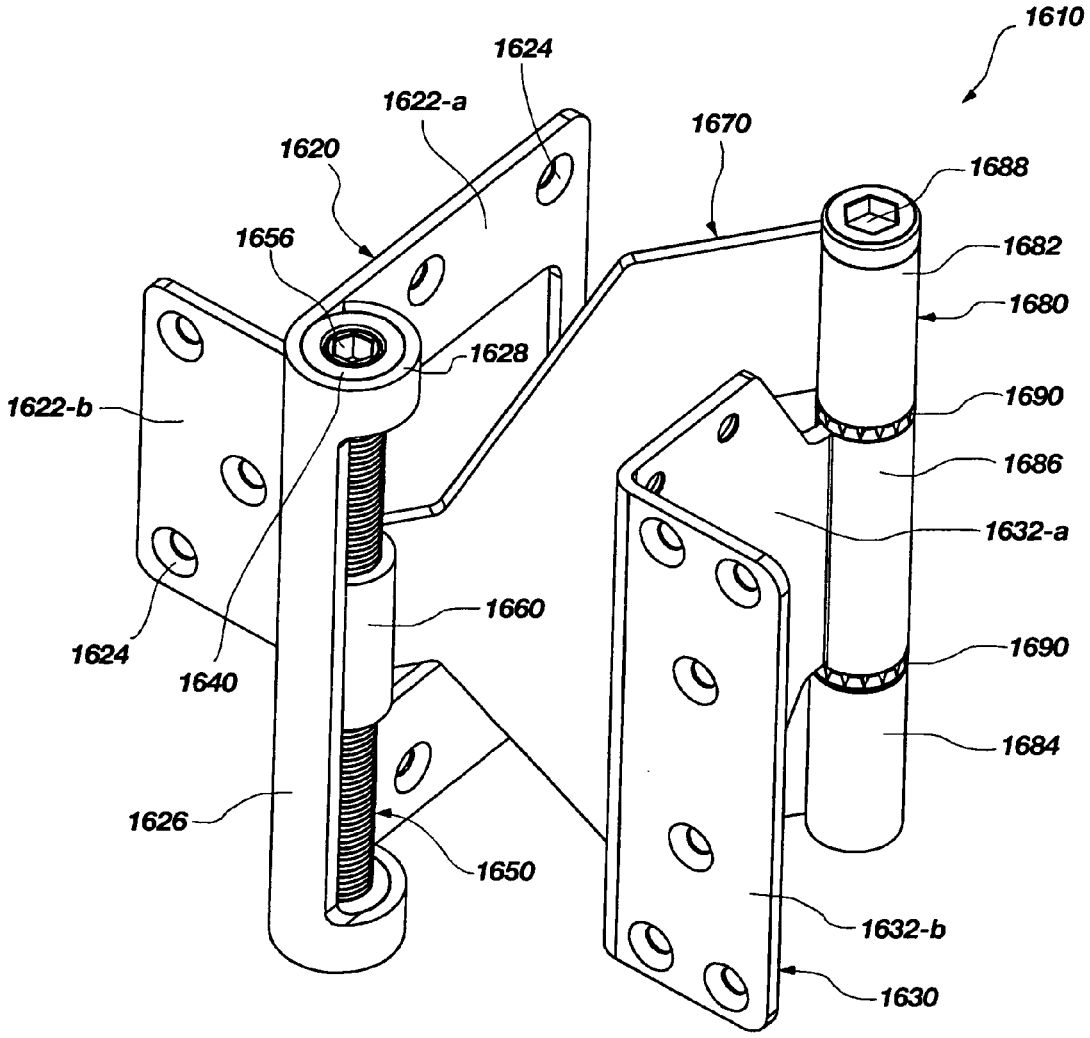
FIG. 48 illustrates a perspective view of an adjustable concealed hinge assembly according to one exemplary embodiment of the present invention.
Figure 49:
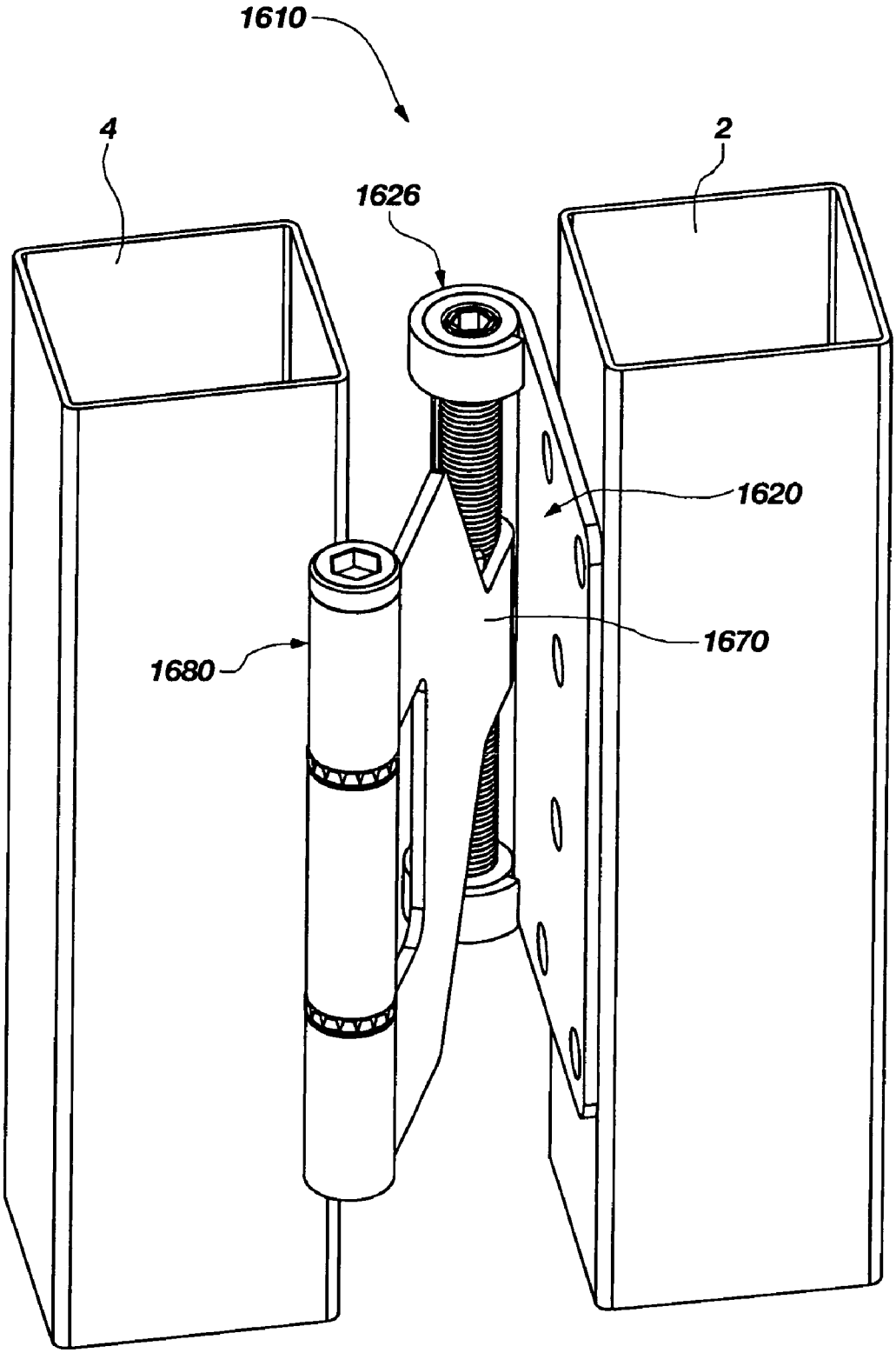
FIG. 49 illustrates an alternative bracket configuration of the concealed hinge assembly of FIG. 48.

Referring now to FIGS. 48 and 49, illustrated is a perspective view of an adjustable concealed hinge assembly according to one exemplary embodiment of the present invention. As shown, the adjustable concealable hinge assembly 1610 comprises a post bracket 1620 and a complementary gate bracket 1630. The post bracket 1620 is configured to be mounted to a post 2 via mounting holes 1624 formed within post mounting portions 1622-*a* and 1622-*b* oriented orthogonally to one another. Post mounting portions 1622-*a* and 1622-*b* are configured to engage corresponding orthogonal surfaces of a post.

The post bracket 1620 further comprises a post bracket component 1626 configured to support a bushing 1640 and vertical adjustment component 1650 therein. The post bracket component 1626 may be a separate structural component coupled to the post bracket 1620, but is preferably integrally formed from the post bracket 1620 itself, as shown. In such an embodiment, the post bracket 1620 may extend to form the post bracket component 1626 by providing a curled segment 1628 sized and configured to receive the bushing 1640 and vertical adjustment component 1650 therein. Preferably, the post bracket component 1626 has formed therein a cut-out segment, which is discussed in greater detail below.

The concealed hinge assembly 1610 further comprises a center bracket 1670 supported between a collar 1660 fixed to the post bracket 1620 and a horizontal adjustment barrel 1680. The center bracket 1670 may be extended to form a portion of the horizontal adjustment barrel 1680, or the horizontal adjustment barrel 1680 may comprise a separate piece coupled thereto. As shown, the center bracket 1670 forms upper and lower portions 1682 and 1684 of the horizontal adjustment barrel 1680, with the gate bracket 1630 extending to form the mid portion 1686. The horizontal adjustment barrel 1680 further comprises locking interfaces 1690 configured to lock the center bracket 1670 with respect to the gate bracket 1630.

The vertical adjustment component 1650 functions in a similar manner as those discussed above, which descriptions are incorporated herein, where applicable. In essence, the vertical adjustment component 1650 is supported within the fixed collar 1660, which comprises an inner threaded surface that corresponds to the threads of the vertical adjustment component 1650. Thus, by driving or otherwise rotating the vertical adjustment component 1650 within the post bracket component 1626 via the driving component 1656, the collar 1660, and therefore the center bracket 1670 displace with respect to one another, thereby raising or lowering the gate bracket 1630 and the gate 4 attached thereto.

The horizontal adjustment barrel 1680 is configured to provide horizontal adjustment within the concealed hinge assembly 1610, and particularly between the gate 4 and the post 2. As such, the horizontal adjustment barrel 1680 further comprises means for locking the center bracket 1670 with respect to the gate bracket 1630 at locking interfaces 1690. Means for locking functions to prevent horizontal displacement of the hinge or the hinged components by preventing the rotation of the center bracket 1670 about the horizontal adjustment barrel 1680. In the embodiment shown, means for locking comprises one or more interlocking interfaces 1690, which are actuated by a fastener, such as a bolt, that extends from the top to the bottom of the horizontal adjustment barrel 1680 through the interlocking interfaces 1690. The locking interface 1690 may comprise a radial pattern of teeth or serrations, or it may comprise any other known types of locking interfaces.

As can be seen in FIG. 49, the adjustable concealed hinge assembly 1610 may be utilized to couple a gate 4 to a post 2, and to substantially eliminate the gap distance between these two components. As configured, the horizontal adjustment barrel 1680 and the vertical post bracket component 1626 are contained outside of the vertical plane in which the post 2 and the gate 4 lie. As such, with the right horizontal adjustment, the adjustable concealed hinge 1610 may be substantially hid between the post 2 and the gate 4 when mounted thereto. FIG. 49 illustrates an alternative bracket configuration for the post and gate brackets 1620 and 1630, in that they are comprised of a single planar flange that couples to the side surface of the post 2 and gate 4, respectively, as shown. The horizontal adjustment capabilities of the concealable hinge 1610 allow the gap between the post 2 and the gate 4 to be varied, as needed or desired.

Figure 50:
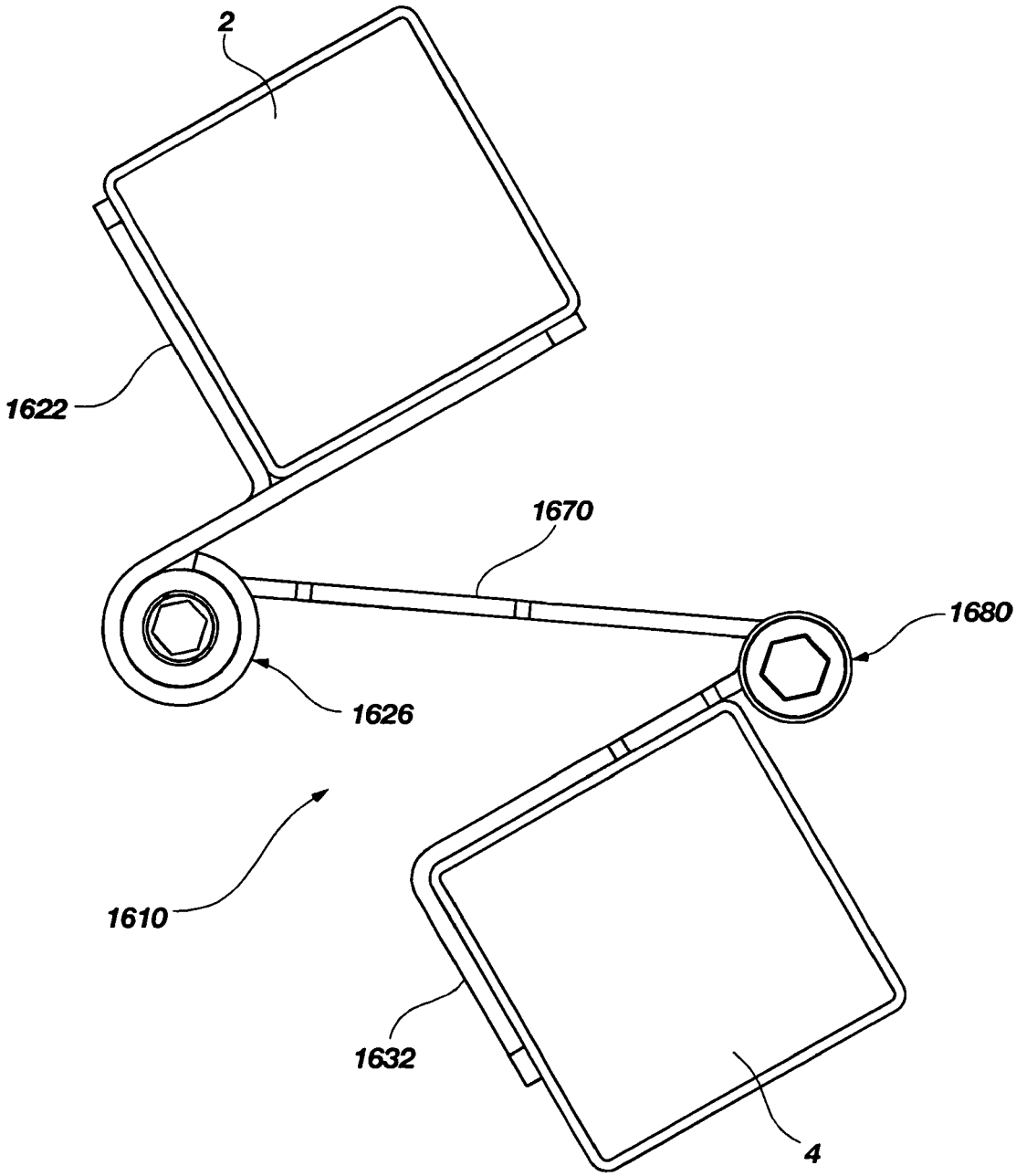
FIG. 50 illustrates the position of the concealed hinge assembly of FIG. 48 when the gate is in a partially opened position.
Figure 51:
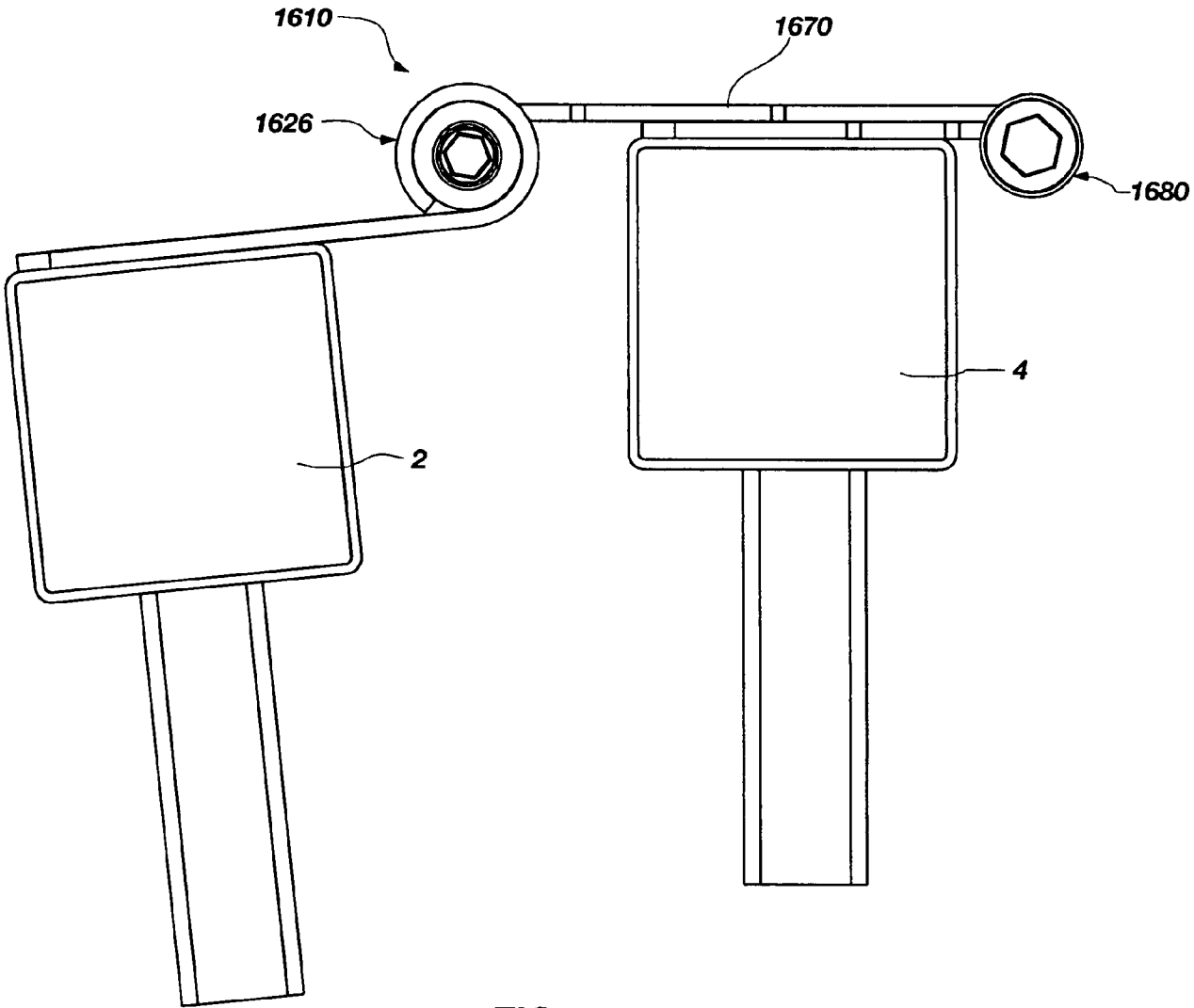
FIG. 51 illustrates the position of the concealed hinge assembly of FIG. 48 when the gate is in a fully opened position.

FIGS. 50 and 51 illustrate top views of the exemplary concealed hinge assembly 1610 of FIGS. 48 and 49. FIG. 50 illustrates the gate 4 in a partially opened position, while FIG. 51 illustrates the gate 4 in a fully opened position. In this particular embodiment, as the gap widens between the gate 4 and the post 2 with the adjustment of the horizontal adjustment barrel 1680, the post and gate mounting portions 1622 and 1632 move further and further out of plane. This is referred to herein as the horizontal adjusting offset. The greater the distance between the horizontal adjustment barrel 1680 and the post bracket component 1626, the less the horizontal adjusting offset.

Figure 52:
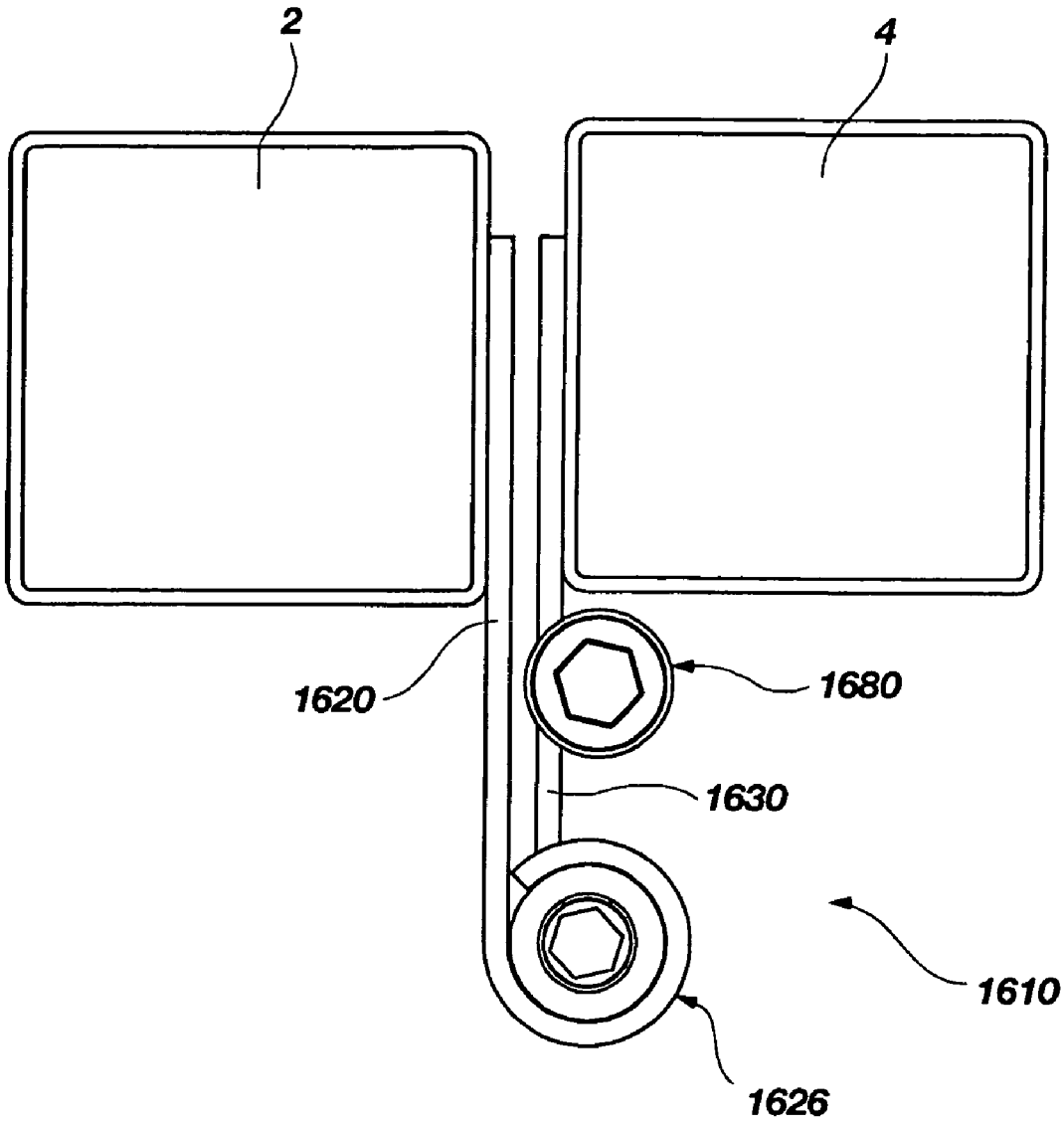
FIG. 52 illustrates another exemplary embodiment of an adjustable concealed hinge assembly.

FIG. 52 illustrates another exemplary embodiment of the adjustable concealed hinge assembly 1610. In this embodiment, the post bracket component 1626 and the horizontal adjustment barrel 1680 are disposed on the same side of the gap formed between the post 2 and the gate 4.

Figure 53:
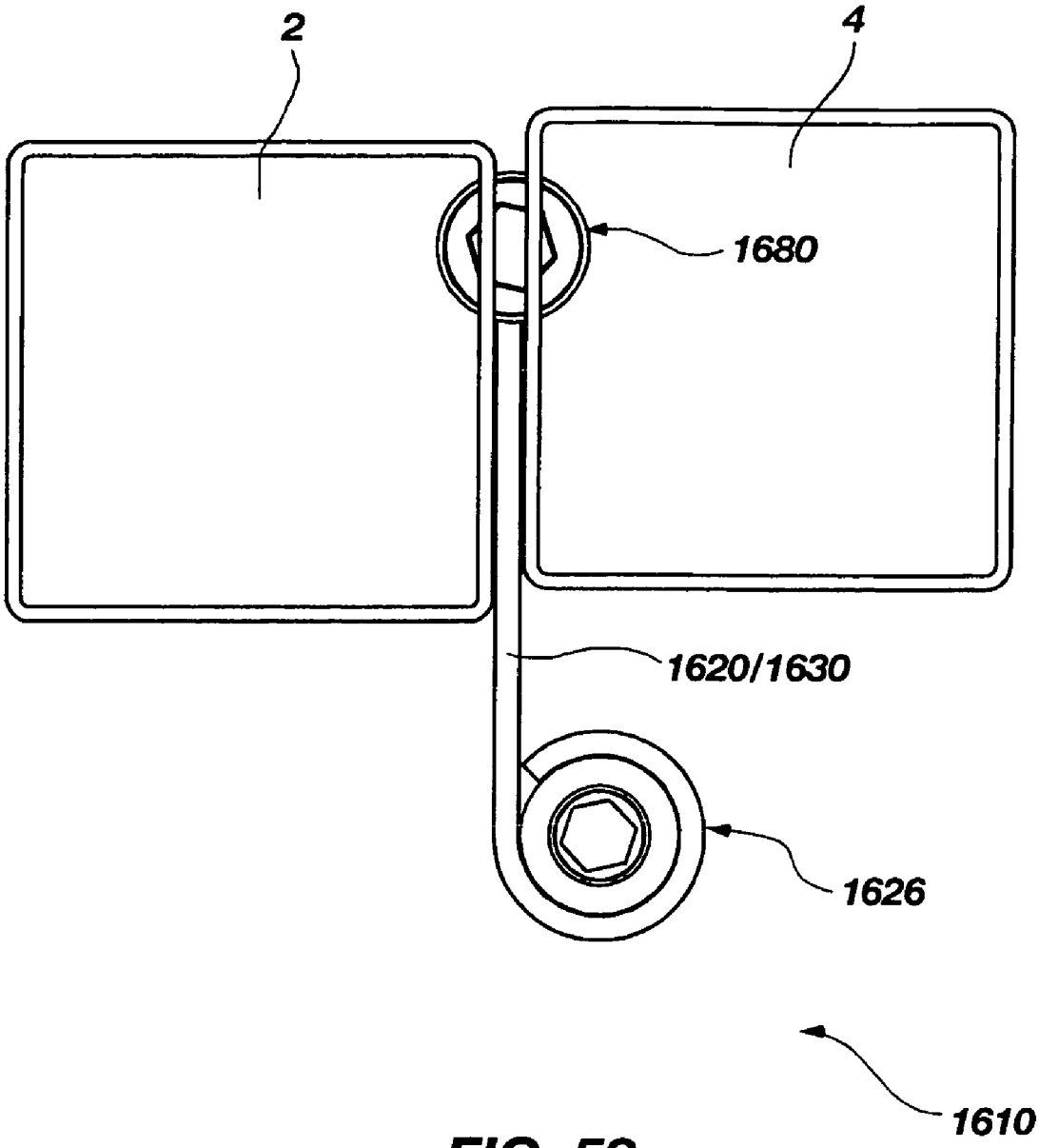
FIG. 53 illustrates still another exemplary embodiment of a concealed hinge assembly, wherein the post mounting portions are in a nested relationship as a result of various cut-out segments formed in one or both of the post mounting portions.

FIG. 53 illustrates another exemplary embodiment of the adjustable concealed hinge assembly 1610. In this embodiment, the post bracket component 1626 is contained without the hinged components, while the horizontal adjustment barrel 1680 is disposed within a recess or opening formed within each of the post 2 and gate 4. Providing openings within the sides of the post 2 and gate 4 allows the concealable hinge assembly 1610 to comprise different types of configurations without sacrificing a reduction in gap distance. FIG. 53 further illustrates post mounting portions 1620 and 1630 in a nested relationship as a result of various cut-out segments (not shown) formed in one or both of the post mounting portions 1620 and 1630.

FIG. 54 illustrates a perspective view of two complementary concealed hinge assemblies 1610 as mounted to a post 2 and gate 4 hinged component assembly. As can be seen, the two concealed hinges 1610 are operable with the vertical adjustment tool 1100 described above used to simultaneously adjust the vertical adjustment component 1650 of each hinge 1610, thus simultaneously adjusting the gate 4 with respect to the post 2 as taught above.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. An adjustable hinge assembly comprising:

a first hinge bracket configured to engage and secure to a first hinged component;

a second hinge bracket configured to engage and secure to a portion of a second hinged component and to pivot about said first hinge bracket;

a vertical adjustment component operably supported about said first hinge bracket and configured to rotate to effectuate vertical adjustment of said first hinge bracket with respect to said second hinge bracket;

a hinge barrel disposed about said vertical adjustment component and configured to vertically displace upon rotation of said vertical adjustment component;

a horizontal adjustment component operably supported about said second hinge bracket and configured to rotate to effectuate horizontal adjustment of said first hinge bracket with respect to said second hinge bracket;

a swivel joint configured to operably couple said hinge barrel and said horizontal adjustment component, said swivel joint permitting said horizontal adjustment component to rotate; and a collar fixedly coupled to said second hinge bracket and disposed about said horizontal adjustment component in support thereof, said collar configured to horizontally displace upon rotation of said horizontal adjustment component.

2. The adjustable hinge assembly of claim 1, wherein said first hinge bracket comprises at least one mounting portion and an extension portion, said mounting portion configured to engage and secure to said first hinged component via an attachment means, said extension portion configured to function as a support member for and to offset said vertical adjustment component from said first hinged component.

3. The adjustable hinge assembly of claim 2, wherein said first hinge bracket further comprises a pivot bracket configured to rotatably support said vertical adjustment component, said pivot bracket comprising:

a back portion configured to engage and secure to an inside surface of said extension portion; and first and second arm members extending orthogonally outward, in a common direction, from longitudinal ends of said back portion, such that said first and second arm members extend outward from said extension portion and said first hinged component, each of said first and second arm members including an arm opening defined therethrough sized and configured to rotatably receive respective ends of said vertical adjustment component, such that said vertical adjustment component is rotatably coupled within said arm openings and supported offset from said mounting portion and said first hinged component.

4. The adjustable hinge assembly of claim 3, wherein said extension portion and said pivot bracket are racked out so as to be oriented on an incline with respect to said mounting portion and said first hinged component for the purpose of offsetting said vertical adjustment component from said first hinged component, facilitating the proper alignment of said first hinge bracket with said first hinged component, and preventing any of the said elements of said hinge assembly from binding in a fully opened and overswing position.

5. The adjustable hinge assembly of claim 1, wherein said vertical adjustment component comprises a threaded outer surface formed along at least a portion of the length thereof.

6. The adjustable hinge assembly of claim 1, wherein said vertical adjustment component comprises at least one driving member formed therein, said driving member configured to facilitate the rotation of said vertical adjustment component, and therefore the vertical adjustment of said second hinge bracket with respect to said first hinge bracket.

7. The adjustable hinge assembly of claim 5, wherein said hinge barrel comprises a longitudinal bore having a threaded surface with a thread configuration corresponding to a thread configuration of said threaded outer surface of said vertical adjustment component.

8. The adjustable hinge assembly of claim 1, wherein said second hinge bracket comprises at least one mounting portion configured to engage and secure to said second hinged component via an attachment means.

9. The adjustable hinge assembly of claim 1, wherein said horizontal adjustment component comprises a threaded outer surface extending along at least a portion of the length thereof, and a smooth surface also extending along at least a portion of the length thereof for facilitating rotation within said swivel joint.

10. The adjustable hinge assembly of claim 1, wherein said horizontal adjustment component comprises at least one driving member formed therein, said driving member configured to facilitate the rotation of said horizontal adjustment component and therefore the horizontal adjustment of said second hinge bracket with respect to said first hinge bracket.

11. The adjustable hinge assembly of claim 1, wherein said collar comprises a collar bore having a threaded surface with a thread configuration corresponding to a thread configuration of said threaded outer surface of said horizontal adjustment component.

12. The adjustable hinge assembly of claim 1, wherein said second hinge bracket further comprises a raised portion for supporting said collar and said horizontal adjustment component in an offset position from said second hinged component.

13. The adjustable hinge assembly of claim 1, wherein said swivel joint comprises a longitudinal bore formed therein.

14. The adjustable hinge assembly of claim 13, wherein said longitudinal bore comprises a ledge.

15. The adjustable hinge assembly of claim 14, wherein said swivel joint further comprises means for rotatably coupling said horizontal adjustment component.

16. The adjustable hinge assembly of claim 15, wherein said means for coupling is selected from the group consisting of a fastener coupled to an end of said horizontal adjustment component, said fastener having a head configured to engage and rotate about said ledge; a flange portion located on said end of said horizontal adjustment component, said flange portion configured to engage and rotate about said ledge; a snap ring contained within an annular groove in said horizontal adjustment component, said snap ring configured to engage and rotate about said ledge; a protrusion formed annularly around an inside surface of said longitudinal bore that mates with an annular groove formed in said horizontal adjustment component; a clip configured to extend through a pair of slots formed within said swivel joint and to engage an annular groove formed in said horizontal adjustment component; a first hinged component configured to extend through an opening formed in said swivel joint and to engage an annular groove formed in said horizontal adjustment component; and a pin configured to extend through an opening formed in said swivel joint and to engage an annular groove formed in said horizontal adjustment component and an outer surface of said swivel joint.

17. The adjustable hinge assembly of claim 1, further comprising means for preventing said horizontal adjustment component from contacting said vertical adjustment component during operation and adjustment of said adjustable hinge assembly.

18. The adjustable hinge assembly of claim 1, further comprising biasing means configured to bias said second hinge bracket and said first hinge bracket into a closed position.

19. The adjustable hinge assembly of claim 1, wherein said vertical and horizontal adjustment components are located in a common plane offset from said first and second hinged components when in a closed position.

20. The adjustable hinge assembly of claim 1, wherein said vertical and horizontal adjustment components are configured to be selectively adjusted to align said second hinged component with said first hinged component, to prevent binding of said adjustable hinge assembly, and to facilitate repeated adjustment of said adjustable hinge assembly after installation.

21. An adjustable hinge assembly comprising:

a first hinge bracket configured to engage and secure to a first hinge component;

a second hinge bracket configured to engage and secure to a second hinge component;

a vertical adjustment component operably supported about said first hinge bracket and configured to rotate to effectuate vertical adjustment of said first hinge bracket with respect to said second hinge bracket;

a horizontal adjustment component operably supported about said second hinge bracket and independently operable from said vertical adjustment component, said horizontal adjustment component configured to rotate to effectuate horizontal adjustment of said first hinge bracket and said first hinged component with respect to said second bracket and said second hinged component, independent of said vertical adjustment; and means for coupling said vertical and horizontal adjustment components together, said means for coupling configured to displace vertically about said vertical adjustment component upon rotation thereof, as well as to facilitate the rotation of said horizontal adjustment component.

22. The adjustable hinge assembly of claim 21, wherein said means for coupling said vertical and horizontal components together comprises a hinge barrel disposed about said vertical adjustment component, said hinge barrel being operably coupled to a swivel joint, which is operably coupled to said horizontal adjustment component.

23. The adjustable hinge assembly of claim 21, wherein said means for coupling said vertical and horizontal components together comprises a swivel joint comprising:

a longitudinal bore configured to receive and rotatably support therein said horizontal adjustment component;

means for rotatably coupling said horizontal adjustment component within said longitudinal bore; and a lateral bore formed transverse to said longitudinal bore and configured to receive and rotatably support therein said vertical adjustment component, said swivel joint configured to vertically displace about said vertical adjustment component upon rotation thereof, thus facilitating vertical adjustment of said first and second hinge brackets with respect to one another.

24. The adjustable hinge assembly of claim 23, wherein said swivel joint further comprises an open end, which open end is opposite an end receiving said horizontal adjustment component.

25. The adjustable hinge assembly of claim 23, wherein said swivel joint further comprises a tapered end to enhance swing clearance.

26. The adjustable hinge assembly of claim 21, wherein said means for coupling said vertical and horizontal components together comprises a hinge barrel integrally formed with a swivel joint.

27. The adjustable hinge assembly of claim 21, wherein said second hinge bracket further comprises a collar fixed thereto configured to receive and couple said horizontal adjustment component.

28. The adjustable hinge assembly of claim 21, wherein said vertical and horizontal adjustment components comprise an internal driving configuration configured to facilitate rotation thereof.

29. The adjustable hinge assembly of claim 21, wherein said second hinge bracket further comprises an extension portion having first and second sidewalls with apertures formed therein, respectively, configured to receive and rotatably support said horizontal adjustment component, said second hinge bracket being displaceable about said horizontal adjustment component upon rotation thereof to effectuate horizontal adjustment of said hinge assembly.

30. The adjustable hinge assembly of claim 29, wherein said extension portion further comprises a threaded bridge to mate with a thread configuration formed on said horizontal adjustment component, thus further facilitating horizontal adjustment of said hinge assembly.

31. The adjustable hinge assembly of claim 21, wherein said second hinge bracket further comprises:

at least one mounting portion;

first and second tabs extending from said mounting portion with apertures formed therein, respectively, configured to receive and rotatably support said horizontal adjustment component, said second hinge bracket being displaceable about said horizontal adjustment component upon rotation thereof, to effectuate horizontal adjustment of said hinge assembly.

32. The adjustable hinge assembly of claim 21, wherein said second hinge bracket further comprises:

an extension portion;

slots formed adjacent said extension portion; and a u-shaped bracket having tabs extending through said slots to fix said u-shaped bracket to said second hinge bracket, said tabs having apertures formed therein, respectively, configured to receive and rotatably support said horizontal adjustment component, said second hinge bracket being displaceable about said horizontal adjustment component upon rotation thereof, to effectuate horizontal adjustment of said hinge assembly.

33. The adjustable hinge assembly of claim 21, wherein said first and second hinge brackets further comprise gearing means operable with vertical and horizontal adjustment means having a rack configuration thereon, said gearing means configured to effectuate and facilitate vertical and horizontal adjustment of said hinge assembly.

34. The adjustable hinge assembly of claim 21, wherein said second hinge bracket further comprises:

a clamping portion fixed to said second hinge bracket and having a longitudinal barrel configured to receive and rotatably couple said horizontal adjustment component;

at least one guide configured to interact with said horizontal adjustment component to effectuate horizontal adjustment upon rotation thereof.

35. The adjustable hinge assembly of claim 21, wherein said first hinge bracket and said second hinge bracket each comprises a planar configuration with a single mounting portion, said first hinge bracket having a pivot bracket extending from said mounting portion.

36. A method for hinging first and second hinged components together, said method comprising:

mounting a first hinge bracket to a first hinged component, said first hinge bracket supporting a vertical adjustment component;

mounting a second hinge bracket to a second hinged component, said second hinge bracket supporting a horizontal adjustment component;

relating said horizontal adjustment component to said vertical adjustment component;

rotating said vertical adjustment component to vertically align said first hinged component with said second hinged component;

rotating said horizontal adjustment component to horizontally align said first hinged component with said second hinged component.

37. An adjustable hinge assembly comprising:

a first hinge bracket configured to engage and secure to a first hinge component;

a second hinge bracket configured to engage and secure to a second hinge component;

a vertical adjustment component operably supported about said first hinge bracket and configured to rotate to effectuate vertical adjustment of said first hinge bracket with respect to said second hinge bracket;

a horizontal adjustment component operably supported about said second hinge bracket and configured to rotate to effectuate horizontal adjustment of said first hinge bracket and said first hinged component with respect to said second bracket and said second hinged component, independent of said vertical adjustment; and means for coupling said vertical and horizontal adjustment components together, said means for coupling configured to displace vertically about said vertical adjustment component upon rotation thereof, as well as to facilitate the rotation of said horizontal adjustment component.

38. An adjustable hinge assembly comprising:

a first hinge bracket configured to engage and secure to a first hinged component;

a second hinge bracket configured to engage and secure to a portion of a second hinged component and to pivot about said first hinge bracket;

a vertical adjustment component operably supported about said first hinge bracket and configured to rotate to effectuate vertical adjustment of said first hinge bracket with respect to said second hinge bracket;

a hinge barrel disposed about said vertical adjustment component and configured to vertically displace upon rotation of said vertical adjustment component;

a horizontal adjustment component operably supported about said second hinge bracket and independently operable from said vertical adjustment component, said horizontal adjustment component being configured to rotate to effectuate horizontal adjustment of said first hinge bracket with respect to said second hinge bracket independent of said vertical adjustment.

* * * * *